US009409390B1

(12) United States Patent
Nishikori et al.

(10) Patent No.: US 9,409,390 B1
(45) Date of Patent: Aug. 9, 2016

(54) PRINTING APPARATUS AND CONTROL METHOD THEREFOR

(71) Applicant: CANON KABUSHIKI KAISHA, Tokyo (JP)

(72) Inventors: Hitoshi Nishikori, Inagi (JP); Shigeyasu Nagoshi, Yokohama (JP); Yutaka Kano, Yokohama (JP); Nobuyuki Hirayama, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/055,996

(22) Filed: Feb. 29, 2016

(30) Foreign Application Priority Data

Mar. 6, 2015 (JP) ..... 2015-045082

(51) Int. Cl.
*B41J 2/355* (2006.01)
*B41J 2/045* (2006.01)

(52) U.S. Cl.
CPC ..... *B41J 2/04573* (2013.01); *B41J 2/04586* (2013.01)

(58) Field of Classification Search
CPC ..... B41J 2/04501; B41J 2/04503; B41J 2/04505; B41J 2/04506; B41J 2/04508; B41J 2/0451; B41J 2/04511; B41J 2/04513; B41J 2/04515; B41J 2/04516; B41J 2/04518; B41J 2/04525; B41J 2/04526; B41J 2/0453; B41J 2/04531; B41J 2/07; B41J 2/072; B41J 2/075; B41J 2/08; B41J 2/085; B41J 2/09; B41J 2/095; B41J 2/10; B41J 2/105; B41J 2/0457; B41J 2/04571; B41J 2/04573; B41J 2/04575; B41J 2/04576; B41J 2/04578; B41J 2/0458; B41J 2/04581; B41J 2/04583; B41J 2/04585; B41J 2/04586; B41J 2/04588; B41J 2/0459; B41J 2/04591; B41J 2/04595; B41J 2/04596; B41J 2/04598
See application file for complete search history.

(56) References Cited

U.S. PATENT DOCUMENTS

| | | | |
|---|---|---|---|
| 5,280,310 | A | 1/1994 | Otsuka et al. |
| 5,359,355 | A | 10/1994 | Nagoshi et al. |
| 5,477,248 | A | 12/1995 | Sugimoto et al. |
| 5,500,661 | A | 3/1996 | Matsubara et al. |

(Continued)

FOREIGN PATENT DOCUMENTS

| | | |
|---|---|---|
| JP | H09-104113 | 4/1997 |
| JP | 2009-006676 | 1/2009 |

OTHER PUBLICATIONS

U.S. Appl. No. 14/854,269, Yutaka Kano, filed Sep. 15, 2015.

(Continued)

*Primary Examiner* — Kristal Feggins
(74) *Attorney, Agent, or Firm* — Fitzpatrick, Cella, Harper & Scinto

(57) ABSTRACT

According to an embodiment, a printing apparatus for printing an image on a print medium by a printhead while relatively scanning the printhead, and discharging ink from the printhead to the print medium is controlled as follows. That is, a time corresponding to a print resolution in a scanning direction of the printhead is divided into a plurality of times, and these print elements are time-divisionally driven by using the divided times as driving timings. At this time, it is controlled to form a plurality of groups each including a predetermined number of adjacent print elements of the print elements, and change the driving timings for each of the groups using the divided time as a unit.

20 Claims, 44 Drawing Sheets

(56) References Cited

U.S. PATENT DOCUMENTS

| | | | | |
|---|---|---|---|---|
| 5,739,828 | A | 4/1998 | Moriyama et al. | |
| 5,880,751 | A | 3/1999 | Nishikori et al. | |
| 5,898,443 | A | 4/1999 | Yoshino et al. | |
| 5,943,073 | A | 8/1999 | Otsuka et al. | |
| 5,980,012 | A | 11/1999 | Fujita et al. | |
| 5,992,968 | A | 11/1999 | Uetsuki et al. | |
| 6,019,453 | A | 2/2000 | Tsuruoka | |
| 6,024,430 | A | 2/2000 | Koitabashi et al. | |
| 6,120,129 | A | 9/2000 | Iwasaki et al. | |
| 6,142,600 | A | 11/2000 | Takahashi et al. | |
| 6,145,950 | A | 11/2000 | Ohtsuka et al. | |
| 6,158,834 | A | 12/2000 | Kato et al. | |
| 6,158,836 | A | 12/2000 | Iwasaki et al. | |
| 6,244,681 | B1 | 6/2001 | Yano et al. | |
| 6,260,938 | B1 | 7/2001 | Ohtsuka et al. | |
| 6,325,492 | B1 | 12/2001 | Koitabashi et al. | |
| 6,352,327 | B1 | 3/2002 | Yano et al. | |
| 6,371,592 | B1 | 4/2002 | Otsuka et al. | |
| 6,390,586 | B1 | 5/2002 | Takahashi et al. | |
| 6,467,866 | B1 | 10/2002 | Nagoshi et al. | |
| 6,505,904 | B1 | 1/2003 | Hirayama | |
| 6,761,426 | B2 | 7/2004 | Tsuchiya et al. | |
| 6,764,154 | B2 | 7/2004 | Nishikori et al. | |
| 6,877,833 | B2 | 4/2005 | Teshigawara et al. | |
| 6,899,413 | B2 | 5/2005 | Otsuka et al. | |
| 7,097,268 | B2 | 8/2006 | Nagoshi | |
| 7,192,112 | B2 | 3/2007 | Nakanishi et al. | |
| 7,192,114 | B2 | 3/2007 | Suzuki et al. | |
| 7,258,412 | B2 | 8/2007 | Maru et al. | |
| 7,261,387 | B2 | 8/2007 | Nishikori et al. | |
| 7,287,830 | B2 | 10/2007 | Ide et al. | |
| 7,296,872 | B2 * | 11/2007 | Hayashi | B41J 29/393 347/19 |
| 7,303,247 | B2 | 12/2007 | Maru et al. | |
| 7,328,963 | B2 | 2/2008 | Tajika et al. | |
| 7,354,133 | B2 | 4/2008 | Ide et al. | |
| 7,404,612 | B2 | 7/2008 | Takamiya et al. | |
| 7,408,676 | B2 | 8/2008 | Yazawa et al. | |
| 7,515,318 | B2 | 4/2009 | Nishikori et al. | |
| 7,651,194 | B2 | 1/2010 | Yazawa et al. | |
| 7,690,744 | B2 | 4/2010 | Nakanishi et al. | |
| 7,699,430 | B2 | 4/2010 | Takamiya et al. | |
| 7,722,143 | B2 | 5/2010 | Yoshikawa et al. | |
| 7,819,497 | B2 | 10/2010 | Konno et al. | |
| 7,850,273 | B2 | 12/2010 | Yasutani et al. | |
| 7,862,149 | B2 | 1/2011 | Yasutani et al. | |
| 7,903,280 | B2 | 3/2011 | Yazawa et al. | |
| 8,079,659 | B2 | 12/2011 | Tajika et al. | |
| 8,186,783 | B2 | 5/2012 | Yasutani et al. | |
| 8,201,907 | B2 | 6/2012 | Teshigawara et al. | |
| 8,231,216 | B2 | 7/2012 | Yamamuro et al. | |
| 8,251,479 | B2 | 8/2012 | Seki et al. | |
| 8,287,074 | B2 | 10/2012 | Kano et al. | |
| 8,430,472 | B2 | 4/2013 | Nishikori et al. | |
| 8,444,246 | B2 | 5/2013 | Muro et al. | |
| 8,608,271 | B2 | 12/2013 | Murayama et al. | |
| 8,622,538 | B2 | 1/2014 | Miyakoshi et al. | |
| 8,651,614 | B2 | 2/2014 | Sakamoto et al. | |
| 8,675,250 | B2 | 3/2014 | Muro et al. | |
| 8,757,754 | B2 | 6/2014 | Azuma et al. | |
| 8,864,266 | B2 | 10/2014 | Suzuki et al. | |
| 8,876,280 | B2 | 11/2014 | Ishikawa et al. | |
| 8,944,584 | B2 | 2/2015 | Sakamoto et al. | |
| 8,979,238 | B2 | 3/2015 | Nishikori et al. | |
| 9,004,640 | B2 | 4/2015 | Ishikawa et al. | |
| 9,016,821 | B2 | 4/2015 | Masuda et al. | |
| 9,039,112 | B2 | 5/2015 | Murayama et al. | |
| 9,079,421 | B2 | 7/2015 | Kato et al. | |
| 9,108,403 | B2 | 8/2015 | Kawatoko et al. | |
| 9,138,989 | B2 | 9/2015 | Kawatoko et al. | |
| 9,174,436 | B2 * | 11/2015 | Suzuki | B41J 2/04541 |
| 2007/0008360 | A1 * | 1/2007 | Hayashi | B41J 29/393 347/12 |
| 2009/0002439 | A1 * | 1/2009 | Hayashi | B41J 2/04505 347/40 |
| 2011/0310152 | A1 | 12/2011 | Muro et al. | |
| 2012/0033006 | A1 | 2/2012 | Murayama et al. | |
| 2012/0050375 | A1 | 3/2012 | Kano et al. | |
| 2012/0069067 | A1 | 3/2012 | Torigoe et al. | |
| 2012/0274951 | A1 | 11/2012 | Nishikori et al. | |
| 2015/0284202 | A1 | 10/2015 | Asano et al. | |

OTHER PUBLICATIONS

U.S. Appl. No. 14/854,769, Norihiro Kawatoko, filed Sep. 15, 2015.
U.S. Appl. No. 14/858,374, Fumiko Suzuki, filed Sep. 18, 2015.

* cited by examiner

SET 0
NOZZLE GROUP 0
NOZZLE GROUP 1
MAIN SCANNING DIRECTION
INK ORIFICE NUMBER
DRIVING TIMING
TIME
CONCURRENT DISCHARGE NUMBER
DOT ARRANGEMENT ON PRINT MEDIUM

NOZZLE GROUP 0
NOZZLE GROUP 1
SET 0
MAIN SCANNING DIRECTION
INK ORIFICE NUMBER
DRIVING TIMING
TIME
CONCURRENT DISCHARGE NUMBER
DOT ARRANGEMENT ON PRINT MEDIUM

SET 0
NOZZLE GROUP 0
NOZZLE GROUP 1
MAIN SCANNING DIRECTION
INK ORIFICE NUMBER
DRIVING TIMING
TIME
CONCURRENT DISCHARGE NUMBER
DOT ARRANGEMENT ON PRINT MEDIUM

FIG. 11

| | Bank_0 | Bank_1 |
|---|---|---|
| SET 0 | 0h_1eh | 100h_11eh |
| SET 1 | 20h_3eh | 120h_13eh |
| SET 2 | 40h_5eh | 140h_15eh |
| SET 3 | 60h_7eh | 160h_17eh |
| SET 4 | 80h_9eh | 180h_19eh |
| SET 5 | a0h_beh | 1a0h_1beh |
| SET 6 | ch_deh | 1c0h_1deh |
| SET 7 | e0h_feh | 1e0h_1feh |

FIG. 14

| | | Bank_0 | Bank_1 | Bank_2 |
|---|---|---|---|---|
| BLOCK 0 | b0<br>b7 | Ad0h | Ad10h | Ad20h |
| BLOCK 1 | b0<br>b7 | Ad1h | Ad11h | Ad21h |
| BLOCK 2 | b0<br>b7 | Ad2h | Ad12h | Ad22h |
| BLOCK 3 | b0<br>b7 | Ad3h | Ad13h | Ad23h |
| BLOCK 4 | b0<br>b7 | Ad4h | Ad14h | Ad24h |
| BLOCK 5 | b0<br>b7 | Ad5h | Ad15h | Ad25h |
| BLOCK 6 | b0<br>b7 | Ad6h | Ad16h | Ad26h |
| BLOCK 7 | b0<br>b7 | Ad7h | Ad17h | Ad27h |
| BLOCK 8 | b0<br>b7 | Ad8h | Ad18h | Ad28h |
| BLOCK 9 | b0<br>b7 | Ad9h | Ad19h | Ad29h |
| BLOCK 10 | b0<br>b7 | Adah | Ad1ah | Ad2ah |
| BLOCK 11 | b0<br>b7 | Adbh | Ad1bh | Ad2bh |
| BLOCK 12 | b0<br>b7 | Adch | Ad1ch | Ad2ch |
| BLOCK 13 | b0<br>b7 | Addh | Ad1dh | Ad2dh |
| BLOCK 14 | b0<br>b7 | Adeh | Ad1eh | Ad2eh |
| BLOCK 15 | b0<br>b7 | Adfh | Ad1fh | Ad2fh |

FIG. 15

| | | | | |
|---|---|---|---|---|
| ADDRESS 0 | 0 | 0 | 0 | 0 |
| ADDRESS 1 | 0 | 1 | 0 | 1 |
| ADDRESS 2 | 1 | 0 | 1 | 0 |
| ADDRESS 3 | 1 | 1 | 0 | 1 |
| ADDRESS 4 | 0 | 1 | 0 | 0 |
| ADDRESS 5 | 1 | 0 | 0 | 1 |
| ADDRESS 6 | 1 | 1 | 1 | 0 |
| ADDRESS 7 | 0 | 0 | 1 | 1 |
| ADDRESS 8 | 1 | 0 | 0 | 0 |
| ADDRESS 9 | 1 | 1 | 0 | 1 |
| ADDRESS 10 | 0 | 0 | 1 | 0 |
| ADDRESS 11 | 0 | 1 | 1 | 1 |
| ADDRESS 12 | 1 | 1 | 0 | 0 |
| ADDRESS 13 | 0 | 0 | 0 | 1 |
| ADDRESS 14 | 0 | 1 | 1 | 0 |
| ADDRESS 15 | 1 | 0 | 1 | 1 |

FIG. 16

| | | | | | |
|---|---|---|---|---|---|
| NOZZLE GROUP 0 | 0 | 0 | 0 | 0 | 0 |
| NOZZLE GROUP 1 | 1 | 1 | 1 | 1 | 1 |
| NOZZLE GROUP 2 | 1 | 1 | 1 | 1 | 0 |
| NOZZLE GROUP 3 | 1 | 1 | 1 | 0 | 1 |
| NOZZLE GROUP 4 | 1 | 1 | 1 | 0 | 0 |
| NOZZLE GROUP 5 | 1 | 1 | 0 | 1 | 1 |
| NOZZLE GROUP 6 | 1 | 1 | 0 | 1 | 0 |
| NOZZLE GROUP 7 | 1 | 1 | 0 | 0 | 1 |
| NOZZLE GROUP 8 | 1 | 1 | 0 | 0 | 0 |
| NOZZLE GROUP 9 | 1 | 0 | 1 | 1 | 1 |
| NOZZLE GROUP 10 | 1 | 0 | 1 | 1 | 0 |
| NOZZLE GROUP 11 | 1 | 0 | 1 | 0 | 1 |
| NOZZLE GROUP 12 | 1 | 0 | 1 | 0 | 0 |
| NOZZLE GROUP 13 | 1 | 0 | 0 | 1 | 1 |
| NOZZLE GROUP 14 | 1 | 0 | 0 | 1 | 0 |
| NOZZLE GROUP 15 | 1 | 0 | 0 | 0 | 1 |

FIG. 17

| | NOZZLE NUMBER | CORRECTION VALUE |
|---|---|---|
| NOZZLE GROUP 0 | 0~7 | 0 |
| NOZZLE GROUP 1 | 8~15 | −1 |
| NOZZLE GROUP 2 | 16~23 | −2 |
| NOZZLE GROUP 3 | 24~31 | −3 |
| NOZZLE GROUP 4 | 32~39 | −4 |
| NOZZLE GROUP 5 | 40~47 | −5 |
| NOZZLE GROUP 6 | 48~55 | −6 |
| NOZZLE GROUP 7 | 56~63 | −7 |
| NOZZLE GROUP 8 | 64~71 | −8 |
| NOZZLE GROUP 9 | 72~79 | −9 |
| NOZZLE GROUP 10 | 80~87 | −10 |
| NOZZLE GROUP 11 | 88~95 | −11 |
| NOZZLE GROUP 12 | 96~103 | −12 |
| NOZZLE GROUP 13 | 104~111 | −13 |
| NOZZLE GROUP 14 | 112~119 | −14 |
| NOZZLE GROUP 15 | 120~127 | −15 |

FIG. 23

| ND | NO | SB | TS | DS | DATA 1col. | DATA 2col. | DATA 3col. | DATA 4col. |
|---|---|---|---|---|---|---|---|---|
| 0 | 0 | 0 | 0 | 1 | × | ○ | ○ | ○ |
| 1 | | 5 | 0 | 1 | × | ○ | ○ | ○ |
| 2 | | 10 | 0 | 1 | × | ○ | ○ | ○ |
| 3 | | 15 | 0 | 1 | × | ○ | ○ | ○ |
| 4 | | 4 | 0 | 1 | × | ○ | ○ | ○ |
| 5 | | 9 | 0 | 1 | × | ○ | ○ | ○ |
| 6 | | 14 | 0 | 1 | × | ○ | ○ | ○ |
| 7 | | 3 | 0 | 1 | × | ○ | ○ | ○ |
| 8 | 1 | 7 | 15 | 0 | ○ | ○ | ○ | × |
| 9 | | 12 | 15 | 0 | ○ | ○ | ○ | × |
| 10 | | 2 | 15 | 0 | ○ | ○ | ○ | × |
| 11 | | 8 | 15 | 0 | ○ | ○ | ○ | × |
| 12 | | 11 | 15 | 0 | ○ | ○ | ○ | × |
| 13 | | 0 | 15 | 0 | ○ | ○ | ○ | × |
| 14 | | 6 | 15 | 0 | ○ | ○ | ○ | × |
| 15 | | 10 | 15 | 0 | ○ | ○ | ○ | × |
| 16 | 2 | 14 | 14 | 0 | ○ | ○ | ○ | × |
| 17 | | 3 | 14 | 0 | ○ | ○ | ○ | × |
| 18 | | 8 | 14 | 0 | ○ | ○ | ○ | × |
| 19 | | 13 | 14 | 0 | ○ | ○ | ○ | × |
| 20 | | 2 | 14 | 0 | ○ | ○ | ○ | × |
| 21 | | 7 | 14 | 0 | ○ | ○ | ○ | × |
| 22 | | 12 | 14 | 0 | ○ | ○ | ○ | × |
| 23 | | 1 | 14 | 0 | ○ | ○ | ○ | × |
| 24 | 3 | 6 | 13 | 0 | ○ | ○ | ○ | × |
| 25 | | 10 | 13 | 0 | ○ | ○ | ○ | × |
| 26 | | 15 | 13 | 0 | ○ | ○ | ○ | × |
| 27 | | 4 | 13 | 0 | ○ | ○ | ○ | × |
| 28 | | 9 | 13 | 0 | ○ | ○ | ○ | × |
| 29 | | 14 | 13 | 0 | ○ | ○ | ○ | × |
| 30 | | 3 | 13 | 0 | ○ | ○ | ○ | × |
| 31 | | 8 | 13 | 0 | ○ | ○ | ○ | × |
| 32 | 4 | 12 | 12 | 0 | ○ | ○ | ○ | × |
| 33 | | 1 | 12 | 0 | ○ | ○ | ○ | × |
| 34 | | 6 | 12 | 0 | ○ | ○ | ○ | × |
| 35 | | 11 | 12 | 0 | ○ | ○ | ○ | × |
| 36 | | 0 | 12 | 0 | ○ | ○ | ○ | × |
| 37 | | 5 | 12 | 0 | ○ | ○ | ○ | × |
| 38 | | 10 | 12 | 0 | ○ | ○ | ○ | × |
| 39 | | 15 | 12 | 0 | ○ | ○ | ○ | × |
| 40 | 5 | 3 | 11 | 0 | ○ | ○ | ○ | × |
| 41 | | 8 | 11 | 0 | ○ | ○ | ○ | × |
| 42 | | 13 | 11 | 0 | ○ | ○ | ○ | × |
| 43 | | 2 | 11 | 0 | ○ | ○ | ○ | × |
| 44 | | 7 | 11 | 0 | ○ | ○ | ○ | × |
| 45 | | 12 | 11 | 0 | ○ | ○ | ○ | × |
| 46 | | 1 | 11 | 0 | ○ | ○ | ○ | × |
| 47 | | 6 | 11 | 0 | ○ | ○ | ○ | × |
| 48 | 6 | 10 | 10 | 0 | ○ | ○ | ○ | × |
| 49 | | 15 | 10 | 0 | ○ | ○ | ○ | × |
| 50 | | 4 | 10 | 0 | ○ | ○ | ○ | × |
| 51 | | 9 | 10 | 0 | ○ | ○ | ○ | × |
| 52 | | 14 | 10 | 0 | ○ | ○ | ○ | × |
| 53 | | 3 | 10 | 0 | ○ | ○ | ○ | × |
| 54 | | 8 | 10 | 0 | ○ | ○ | ○ | × |
| 55 | | 13 | 10 | 0 | ○ | ○ | ○ | × |
| 56 | 7 | 1 | 9 | 0 | ○ | ○ | ○ | × |
| 57 | | 6 | 9 | 0 | ○ | ○ | ○ | × |
| 58 | | 11 | 9 | 0 | ○ | ○ | ○ | × |
| 59 | | 0 | 9 | 0 | ○ | ○ | ○ | × |
| 60 | | 5 | 9 | 0 | ○ | ○ | ○ | × |
| 61 | | 10 | 9 | 0 | ○ | ○ | ○ | × |
| 62 | | 15 | 9 | 0 | ○ | ○ | ○ | × |
| 63 | | 4 | 9 | 0 | ○ | ○ | ○ | × |
| 64 | 8 | 8 | 8 | 0 | ○ | ○ | ○ | × |
| 65 | | 13 | 8 | 0 | ○ | ○ | ○ | × |
| 66 | | 2 | 8 | 0 | ○ | ○ | ○ | × |
| 67 | | 7 | 8 | 0 | ○ | ○ | ○ | × |
| 68 | | 12 | 8 | 0 | ○ | ○ | ○ | × |
| 69 | | 1 | 8 | 0 | ○ | ○ | ○ | × |
| 70 | | 6 | 8 | 0 | ○ | ○ | ○ | × |
| 71 | | 11 | 8 | 0 | ○ | ○ | ○ | × |
| 72 | 9 | 15 | 7 | 0 | ○ | ○ | ○ | × |
| 73 | | 4 | 7 | 0 | ○ | ○ | ○ | × |
| 74 | | 9 | 7 | 0 | ○ | ○ | ○ | × |
| 75 | | 14 | 7 | 0 | ○ | ○ | ○ | × |
| 76 | | 3 | 7 | 0 | ○ | ○ | ○ | × |
| 77 | | 8 | 7 | 0 | ○ | ○ | ○ | × |
| 78 | | 13 | 7 | 0 | ○ | ○ | ○ | × |
| 79 | | 2 | 7 | 0 | ○ | ○ | ○ | × |
| 80 | 10 | 6 | 6 | 0 | ○ | ○ | ○ | × |
| 81 | | 11 | 6 | 0 | ○ | ○ | ○ | × |
| 82 | | 0 | 6 | 0 | ○ | ○ | ○ | × |
| 83 | | 5 | 6 | 0 | ○ | ○ | ○ | × |
| 84 | | 10 | 6 | 0 | ○ | ○ | ○ | × |
| 85 | | 15 | 6 | 0 | ○ | ○ | ○ | × |
| 86 | | 4 | 6 | 0 | ○ | ○ | ○ | × |
| 87 | | 9 | 6 | 0 | ○ | ○ | ○ | × |
| 88 | 11 | 13 | 5 | 0 | ○ | ○ | ○ | × |
| 89 | | 2 | 5 | 0 | ○ | ○ | ○ | × |
| 90 | | 7 | 5 | 0 | ○ | ○ | ○ | × |
| 91 | | 12 | 5 | 0 | ○ | ○ | ○ | × |
| 92 | | 1 | 5 | 0 | ○ | ○ | ○ | × |
| 93 | | 6 | 5 | 0 | ○ | ○ | ○ | × |
| 94 | | 11 | 5 | 0 | ○ | ○ | ○ | × |
| 95 | | 0 | 5 | 0 | ○ | ○ | ○ | × |
| 96 | 12 | 4 | 4 | 0 | ○ | ○ | ○ | × |
| 97 | | 9 | 4 | 0 | ○ | ○ | ○ | × |
| 98 | | 14 | 4 | 0 | ○ | ○ | ○ | × |
| 99 | | 3 | 4 | 0 | ○ | ○ | ○ | × |
| 100 | | 8 | 4 | 0 | ○ | ○ | ○ | × |
| 101 | | 13 | 4 | 0 | ○ | ○ | ○ | × |
| 102 | | 2 | 4 | 0 | ○ | ○ | ○ | × |
| 103 | | 7 | 4 | 0 | ○ | ○ | ○ | × |
| 104 | 13 | 11 | 3 | 0 | ○ | ○ | ○ | × |
| 105 | | 0 | 3 | 0 | ○ | ○ | ○ | × |
| 106 | | 5 | 3 | 0 | ○ | ○ | ○ | × |
| 107 | | 10 | 3 | 0 | ○ | ○ | ○ | × |
| 108 | | 15 | 3 | 0 | ○ | ○ | ○ | × |
| 109 | | 4 | 3 | 0 | ○ | ○ | ○ | × |
| 110 | | 9 | 3 | 0 | ○ | ○ | ○ | × |
| 111 | | 14 | 3 | 0 | ○ | ○ | ○ | × |
| 112 | 14 | 2 | 2 | 0 | ○ | ○ | ○ | × |
| 113 | | 7 | 2 | 0 | ○ | ○ | ○ | × |
| 114 | | 12 | 2 | 0 | ○ | ○ | ○ | × |
| 115 | | 1 | 2 | 0 | ○ | ○ | ○ | × |
| 116 | | 6 | 2 | 0 | ○ | ○ | ○ | × |
| 117 | | 11 | 2 | 0 | ○ | ○ | ○ | × |
| 118 | | 0 | 2 | 0 | ○ | ○ | ○ | × |
| 119 | | 5 | 2 | 0 | ○ | ○ | ○ | × |
| 120 | 15 | 9 | 1 | 0 | ○ | ○ | ○ | × |
| 121 | | 14 | 1 | 0 | ○ | ○ | ○ | × |
| 122 | | 3 | 1 | 0 | ○ | ○ | ○ | × |
| 123 | | 8 | 1 | 0 | ○ | ○ | ○ | × |
| 124 | | 13 | 1 | 0 | ○ | ○ | ○ | × |
| 125 | | 2 | 1 | 0 | ○ | ○ | ○ | × |
| 126 | | 7 | 1 | 0 | ○ | ○ | ○ | × |
| 127 | | 12 | 1 | 0 | ○ | ○ | ○ | × |

DOT ARRANGEMENT: 1col. 2col. 3col. 4col.

FIG. 24

| SLANT | NG | TS | DS |
|---|---|---|---|
| 3 | 0 | 0 | 0 |
| | 1 | 3 | 0 |
| | 2 | 6 | 0 |
| | 3 | 9 | 0 |
| | 4 | 12 | 0 |
| | 5 | 15 | 0 |
| | 6 | 2 | 1 |
| | 7 | 5 | 1 |
| | 8 | 8 | 1 |
| | 9 | 11 | 1 |
| | 10 | 14 | 1 |
| | 11 | 1 | 2 |
| | 12 | 4 | 2 |
| | 13 | 7 | 2 |
| | 14 | 10 | 2 |
| | 15 | 13 | 2 |
| 2 | 0 | 0 | 0 |
| | 1 | 2 | 0 |
| | 2 | 4 | 0 |
| | 3 | 6 | 0 |
| | 4 | 8 | 0 |
| | 5 | 10 | 0 |
| | 6 | 12 | 0 |
| | 7 | 14 | 0 |
| | 8 | 0 | 1 |
| | 9 | 2 | 1 |
| | 10 | 4 | 1 |
| | 11 | 6 | 1 |
| | 12 | 8 | 1 |
| | 13 | 10 | 1 |
| | 14 | 12 | 1 |
| | 15 | 14 | 1 |

| | | | |
|---|---|---|---|
| 1 | 0 | 0 | 0 |
| | 1 | 1 | 0 |
| | 2 | 2 | 0 |
| | 3 | 3 | 0 |
| | 4 | 4 | 0 |
| | 5 | 5 | 0 |
| | 6 | 6 | 0 |
| | 7 | 7 | 0 |
| | 8 | 8 | 0 |
| | 9 | 9 | 0 |
| | 10 | 10 | 0 |
| | 11 | 11 | 0 |
| | 12 | 12 | 0 |
| | 13 | 13 | 0 |
| | 14 | 14 | 0 |
| | 15 | 15 | 0 |
| 0 | 0 | 0 | 0 |
| | 1 | 0 | 0 |
| | 2 | 0 | 0 |
| | 3 | 0 | 0 |
| | 4 | 0 | 0 |
| | 5 | 0 | 0 |
| | 6 | 0 | 0 |
| | 7 | 0 | 0 |
| | 8 | 0 | 0 |
| | 9 | 0 | 0 |
| | 10 | 0 | 0 |
| | 11 | 0 | 0 |
| | 12 | 0 | 0 |
| | 13 | 0 | 0 |
| | 14 | 0 | 0 |
| | 15 | 0 | 0 |

| | | | |
|---|---|---|---|
| −1 | 0 | 0 | 1 |
| | 1 | 15 | 0 |
| | 2 | 14 | 0 |
| | 3 | 13 | 0 |
| | 4 | 12 | 0 |
| | 5 | 11 | 0 |
| | 6 | 10 | 0 |
| | 7 | 9 | 0 |
| | 8 | 8 | 0 |
| | 9 | 7 | 0 |
| | 10 | 6 | 0 |
| | 11 | 5 | 0 |
| | 12 | 4 | 0 |
| | 13 | 3 | 0 |
| | 14 | 2 | 0 |
| | 15 | 1 | 0 |
| −2 | 0 | 0 | 2 |
| | 1 | 14 | 1 |
| | 2 | 12 | 1 |
| | 3 | 10 | 1 |
| | 4 | 8 | 1 |
| | 5 | 6 | 1 |
| | 6 | 4 | 1 |
| | 7 | 2 | 1 |
| | 8 | 0 | 1 |
| | 9 | 14 | 0 |
| | 10 | 12 | 0 |
| | 11 | 10 | 0 |
| | 12 | 8 | 0 |
| | 13 | 6 | 0 |
| | 14 | 4 | 0 |
| | 15 | 2 | 0 |

| | | | |
|---|---|---|---|
| −3 | 0 | 0 | 3 |
| | 1 | 13 | 2 |
| | 2 | 10 | 2 |
| | 3 | 7 | 2 |
| | 4 | 4 | 2 |
| | 5 | 1 | 2 |
| | 6 | 14 | 1 |
| | 7 | 11 | 1 |
| | 8 | 8 | 1 |
| | 9 | 5 | 1 |
| | 10 | 2 | 1 |
| | 11 | 15 | 0 |
| | 12 | 12 | 0 |
| | 13 | 9 | 0 |
| | 14 | 6 | 0 |
| | 15 | 3 | 0 |

SET 0
NOZZLE GROUP 0
NOZZLE GROUP 1
MAIN SCANNING DIRECTION
DRIVING TIMING
INK ORIFICE NUMBER
0 1 2 3 4 5 6 7 8 9 10 11 12 13 14 15
TIME
CONCURRENT DISCHARGE NUMBER
1 1 1 1 1 1 1 1 1 1 1 1 1 1 1 1
DOT ARRANGEMENT ON PRINT MEDIUM
NOZZLE GROUP 0
NOZZLE GROUP 1
MAIN SCANNING DIRECTION

NOZZLE GROUP 0
NOZZLE GROUP 1
MAIN SCANNING DIRECTION

DRIVING TIMING
0 1 2 3 4 5 6 7 8 9 10 11 12 13 14 15
INK ORIFICE NUMBER
TIME
CONCURRENT DISCHARGE NUMBER
1 1 1 1 1 1 1 1 1 1 1 1 1 1 1 1

NOZZLE GROUP 0
NOZZLE GROUP 1
MAIN SCANNING DIRECTION
DOT ARRANGEMENT ON PRINT MEDIUM

NOZZLE GROUP 0
NOZZLE GROUP 1
MAIN SCANNING DIRECTION

DRIVING TIMING
0 1 2 3 4 5 6 7 8 9 10 11 12 13 14 15
INK ORIFICE NUMBER
TIME
CONCURRENT DISCHARGE NUMBER
1 1 1 1 1 1 1 1 1 1 1 1 1 1 1 1

NOZZLE GROUP 0
NOZZLE GROUP 1
MAIN SCANNING DIRECTION
DOT ARRANGEMENT ON PRINT MEDIUM

NOZZLE GROUP 0
NOZZLE GROUP 1
MAIN SCANNING DIRECTION

DRIVING TIMING
INK ORIFICE NUMBER
TIME
CONCURRENT DISCHARGE NUMBER

NOZZLE GROUP 0
NOZZLE GROUP 1
MAIN SCANNING DIRECTION
DOT ARRANGEMENT ON PRINT MEDIUM

FIG. 30

| ND | NG | SB | TS | DS | DATA 1col. | DATA 2col. | DATA 3col. | DATA 4col. |
|---|---|---|---|---|---|---|---|---|
| 0 | 0 | 0 | 0 | 2 | × | ○ | ○ | × |
| 1 | | 8 | 0 | 2 | × | ○ | ○ | × |
| 2 | | 12 | 0 | 2 | × | ○ | ○ | × |
| 3 | | 2 | 0 | 2 | × | ○ | ○ | × |
| 4 | | 6 | 0 | 2 | × | ○ | ○ | × |
| 5 | | 3 | 0 | 2 | × | ○ | ○ | × |
| 6 | | 14 | 0 | 2 | × | ○ | ○ | × |
| 7 | | 4 | 0 | 2 | × | ○ | ○ | × |
| 8 | | 10 | 0 | 2 | × | ○ | ○ | × |
| 9 | 1 | 15 | 14 | 1 | × | ○ | ○ | ○ |
| 10 | | 5 | 14 | 1 | × | ○ | ○ | ○ |
| 11 | | 11 | 14 | 1 | × | ○ | ○ | ○ |
| 12 | | 1 | 14 | 1 | × | ○ | ○ | ○ |
| 13 | | 7 | 14 | 1 | × | ○ | ○ | ○ |
| 14 | | 13 | 14 | 1 | × | ○ | ○ | ○ |
| 15 | | 3 | 14 | 1 | × | ○ | ○ | ○ |
| 16 | | 9 | 14 | 1 | × | ○ | ○ | ○ |
| 17 | 2 | 12 | 12 | 1 | × | ○ | ○ | ○ |
| 18 | | 2 | 12 | 1 | × | ○ | ○ | ○ |
| 19 | | 8 | 12 | 1 | × | ○ | ○ | ○ |
| 20 | | 14 | 12 | 1 | × | ○ | ○ | ○ |
| 21 | | 4 | 12 | 1 | × | ○ | ○ | ○ |
| 22 | | 10 | 12 | 1 | × | ○ | ○ | ○ |
| 23 | | 0 | 12 | 1 | × | ○ | ○ | ○ |
| 24 | | 6 | 12 | 1 | × | ○ | ○ | ○ |
| 25 | 3 | 11 | 10 | 1 | × | ○ | ○ | ○ |
| 26 | | 1 | 10 | 1 | × | ○ | ○ | ○ |
| 27 | | 7 | 10 | 1 | × | ○ | ○ | ○ |
| 28 | | 13 | 10 | 1 | × | ○ | ○ | ○ |
| 29 | | 3 | 10 | 1 | × | ○ | ○ | ○ |
| 30 | | 9 | 10 | 1 | × | ○ | ○ | ○ |
| 31 | | 15 | 10 | 1 | × | ○ | ○ | ○ |
| 32 | | 5 | 10 | 1 | × | ○ | ○ | ○ |
| 33 | 4 | 8 | 8 | 1 | × | ○ | ○ | ○ |
| 34 | | 14 | 8 | 1 | × | ○ | ○ | ○ |
| 35 | | 4 | 8 | 1 | × | ○ | ○ | ○ |
| 36 | | 10 | 8 | 1 | × | ○ | ○ | ○ |
| 37 | | 0 | 8 | 1 | × | ○ | ○ | ○ |
| 38 | | 6 | 8 | 1 | × | ○ | ○ | ○ |
| 39 | | 12 | 8 | 1 | × | ○ | ○ | ○ |
| 40 | | 2 | 8 | 1 | × | ○ | ○ | ○ |
| 41 | 5 | 7 | 6 | 1 | × | ○ | ○ | ○ |
| 42 | | 13 | 6 | 1 | × | ○ | ○ | ○ |
| 43 | | 3 | 6 | 1 | × | ○ | ○ | ○ |
| 44 | | 9 | 6 | 1 | × | ○ | ○ | ○ |
| 45 | | 15 | 6 | 1 | × | ○ | ○ | ○ |
| 46 | | 5 | 6 | 1 | × | ○ | ○ | ○ |
| 47 | | 11 | 6 | 1 | × | ○ | ○ | ○ |
| 48 | | 1 | 6 | 1 | × | ○ | ○ | ○ |
| 49 | 6 | 4 | 4 | 1 | × | ○ | ○ | ○ |
| 50 | | 10 | 4 | 1 | × | ○ | ○ | ○ |
| 51 | | 0 | 4 | 1 | × | ○ | ○ | ○ |
| 52 | | 6 | 4 | 1 | × | ○ | ○ | ○ |
| 53 | | 12 | 4 | 1 | × | ○ | ○ | ○ |
| 54 | | 2 | 4 | 1 | × | ○ | ○ | ○ |
| 55 | | 8 | 4 | 1 | × | ○ | ○ | ○ |
| 56 | | 14 | 4 | 1 | × | ○ | ○ | ○ |
| 57 | 7 | 3 | 2 | 1 | × | ○ | ○ | ○ |
| 58 | | 9 | 2 | 1 | × | ○ | ○ | ○ |
| 59 | | 15 | 2 | 1 | × | ○ | ○ | ○ |
| 60 | | 5 | 2 | 1 | × | ○ | ○ | ○ |
| 61 | | 11 | 2 | 1 | × | ○ | ○ | ○ |
| 62 | | 1 | 2 | 1 | × | ○ | ○ | ○ |
| 63 | | 7 | 2 | 1 | × | ○ | ○ | ○ |
| 64 | | 13 | 2 | 1 | × | ○ | ○ | ○ |
| 65 | 8 | 0 | 0 | 1 | × | ○ | ○ | ○ |
| 66 | | 6 | 0 | 1 | × | ○ | ○ | ○ |
| 67 | | 12 | 0 | 1 | × | ○ | ○ | ○ |
| 68 | | 2 | 0 | 1 | × | ○ | ○ | ○ |
| 69 | | 8 | 0 | 1 | × | ○ | ○ | ○ |
| 70 | | 14 | 0 | 1 | × | ○ | ○ | ○ |
| 71 | | 4 | 0 | 1 | × | ○ | ○ | ○ |
| 72 | | 10 | 0 | 1 | × | ○ | ○ | ○ |
| 73 | 9 | 15 | 14 | 0 | ○ | ○ | ○ | × |
| 74 | | 5 | 14 | 0 | ○ | ○ | ○ | × |
| 75 | | 11 | 14 | 0 | ○ | ○ | ○ | × |
| 76 | | 1 | 14 | 0 | ○ | ○ | ○ | × |
| 77 | | 7 | 14 | 0 | ○ | ○ | ○ | × |
| 78 | | 13 | 14 | 0 | ○ | ○ | ○ | × |
| 79 | | 3 | 14 | 0 | ○ | ○ | ○ | × |
| 80 | | 9 | 14 | 0 | ○ | ○ | ○ | × |
| 81 | 10 | 12 | 12 | 0 | ○ | ○ | ○ | × |
| 82 | | 2 | 12 | 0 | ○ | ○ | ○ | × |
| 83 | | 8 | 12 | 0 | ○ | ○ | ○ | × |
| 84 | | 14 | 12 | 0 | ○ | ○ | ○ | × |
| 85 | | 4 | 12 | 0 | ○ | ○ | ○ | × |
| 86 | | 10 | 12 | 0 | ○ | ○ | ○ | × |
| 87 | | 0 | 12 | 0 | ○ | ○ | ○ | × |
| 88 | | 6 | 12 | 0 | ○ | ○ | ○ | × |
| 89 | 11 | 11 | 10 | 0 | ○ | ○ | ○ | × |
| 90 | | 1 | 10 | 0 | ○ | ○ | ○ | × |
| 91 | | 7 | 10 | 0 | ○ | ○ | ○ | × |
| 92 | | 13 | 10 | 0 | ○ | ○ | ○ | × |
| 93 | | 3 | 10 | 0 | ○ | ○ | ○ | × |
| 94 | | 9 | 10 | 0 | ○ | ○ | ○ | × |
| 95 | | 15 | 10 | 0 | ○ | ○ | ○ | × |
| 96 | | 5 | 10 | 0 | ○ | ○ | ○ | × |
| 97 | 12 | 8 | 8 | 0 | ○ | ○ | ○ | × |
| 98 | | 14 | 8 | 0 | ○ | ○ | ○ | × |
| 99 | | 4 | 8 | 0 | ○ | ○ | ○ | × |
| 100 | | 10 | 8 | 0 | ○ | ○ | ○ | × |
| 101 | | 0 | 8 | 0 | ○ | ○ | ○ | × |
| 102 | | 6 | 8 | 0 | ○ | ○ | ○ | × |
| 103 | | 12 | 8 | 0 | ○ | ○ | ○ | × |
| 104 | | 2 | 8 | 0 | ○ | ○ | ○ | × |
| 105 | 13 | 7 | 6 | 0 | ○ | ○ | ○ | × |
| 106 | | 13 | 6 | 0 | ○ | ○ | ○ | × |
| 107 | | 3 | 6 | 0 | ○ | ○ | ○ | × |
| 108 | | 9 | 6 | 0 | ○ | ○ | ○ | × |
| 109 | | 15 | 6 | 0 | ○ | ○ | ○ | × |
| 110 | | 5 | 6 | 0 | ○ | ○ | ○ | × |
| 111 | | 11 | 6 | 0 | ○ | ○ | ○ | × |
| 112 | | 1 | 6 | 0 | ○ | ○ | ○ | × |
| 113 | 14 | 4 | 4 | 0 | ○ | ○ | ○ | × |
| 114 | | 10 | 4 | 0 | ○ | ○ | ○ | × |
| 115 | | 0 | 4 | 0 | ○ | ○ | ○ | × |
| 116 | | 6 | 4 | 0 | ○ | ○ | ○ | × |
| 117 | | 12 | 4 | 0 | ○ | ○ | ○ | × |
| 118 | | 2 | 4 | 0 | ○ | ○ | ○ | × |
| 119 | | 8 | 4 | 0 | ○ | ○ | ○ | × |
| 120 | | 14 | 4 | 0 | ○ | ○ | ○ | × |
| 121 | 15 | 3 | 2 | 0 | ○ | ○ | ○ | × |
| 122 | | 9 | 2 | 0 | ○ | ○ | ○ | × |
| 123 | | 15 | 2 | 0 | ○ | ○ | ○ | × |
| 124 | | 5 | 2 | 0 | ○ | ○ | ○ | × |
| 125 | | 11 | 2 | 0 | ○ | ○ | ○ | × |
| 126 | | 1 | 2 | 0 | ○ | ○ | ○ | × |
| 127 | | 7 | 2 | 0 | ○ | ○ | ○ | × |
| | | 13 | 2 | 0 | ○ | ○ | ○ | × |

DOT ARRANGEMENT: 1col. 2col. 3col. 4col.

FIG. 31

| SLANT | NG | TS | DS |
|---|---|---|---|
| 3 | 0 | 0 | 0 |
| | 1 | 2 | 0 |
| | 2 | 4 | 0 |
| | 3 | 6 | 0 |
| | 4 | 8 | 0 |
| | 5 | 10 | 0 |
| | 6 | 12 | 1 |
| | 7 | 14 | 1 |
| | 8 | 0 | 1 |
| | 9 | 2 | 1 |
| | 10 | 4 | 1 |
| | 11 | 6 | 2 |
| | 12 | 8 | 2 |
| | 13 | 10 | 2 |
| | 14 | 12 | 2 |
| | 15 | 14 | 2 |
| 2 | 0 | 0 | 0 |
| | 1 | 2 | 0 |
| | 2 | 4 | 0 |
| | 3 | 6 | 0 |
| | 4 | 8 | 0 |
| | 5 | 10 | 0 |
| | 6 | 12 | 0 |
| | 7 | 14 | 0 |
| | 8 | 0 | 1 |
| | 9 | 2 | 1 |
| | 10 | 4 | 1 |
| | 11 | 6 | 1 |
| | 12 | 8 | 1 |
| | 13 | 10 | 1 |
| | 14 | 12 | 1 |
| | 15 | 14 | 1 |

| | | | |
|---|---|---|---|
| 1 | 0 | 0 | 0 |
| | 1 | 0 | 0 |
| | 2 | 0 | 0 |
| | 3 | 0 | 0 |
| | 4 | 0 | 0 |
| | 5 | 0 | 0 |
| | 6 | 0 | 0 |
| | 7 | 0 | 0 |
| | 8 | 0 | 0 |
| | 9 | 0 | 0 |
| | 10 | 0 | 0 |
| | 11 | 0 | 0 |
| | 12 | 0 | 0 |
| | 13 | 0 | 0 |
| | 14 | 0 | 0 |
| | 15 | 0 | 0 |
| 0 | 0 | 0 | 0 |
| | 1 | 0 | 0 |
| | 2 | 0 | 0 |
| | 3 | 0 | 0 |
| | 4 | 0 | 0 |
| | 5 | 0 | 0 |
| | 6 | 0 | 0 |
| | 7 | 0 | 0 |
| | 8 | 0 | 0 |
| | 9 | 0 | 0 |
| | 10 | 0 | 0 |
| | 11 | 0 | 0 |
| | 12 | 0 | 0 |
| | 13 | 0 | 0 |
| | 14 | 0 | 0 |
| | 15 | 0 | 0 |

| | | | |
|---|---|---|---|
| −1 | 0 | 0 | 1 |
| | 1 | 0 | 0 |
| | 2 | 0 | 0 |
| | 3 | 0 | 0 |
| | 4 | 0 | 0 |
| | 5 | 0 | 0 |
| | 6 | 0 | 0 |
| | 7 | 0 | 0 |
| | 8 | 0 | 0 |
| | 9 | 0 | 0 |
| | 10 | 0 | 0 |
| | 11 | 0 | 0 |
| | 12 | 0 | 0 |
| | 13 | 0 | 0 |
| | 14 | 0 | 0 |
| | 15 | 0 | 0 |
| −2 | 0 | 0 | 2 |
| | 1 | 14 | 1 |
| | 2 | 12 | 1 |
| | 3 | 10 | 1 |
| | 4 | 8 | 1 |
| | 5 | 6 | 1 |
| | 6 | 4 | 1 |
| | 7 | 2 | 1 |
| | 8 | 0 | 1 |
| | 9 | 14 | 0 |
| | 10 | 12 | 0 |
| | 11 | 10 | 0 |
| | 12 | 8 | 0 |
| | 13 | 6 | 0 |
| | 14 | 4 | 0 |
| | 15 | 2 | 0 |

| | | | |
|---|---|---|---|
| −3 | 0 | 0 | 3 |
| | 1 | 14 | 2 |
| | 2 | 12 | 2 |
| | 3 | 10 | 2 |
| | 4 | 8 | 2 |
| | 5 | 6 | 2 |
| | 6 | 4 | 1 |
| | 7 | 2 | 1 |
| | 8 | 0 | 1 |
| | 9 | 14 | 1 |
| | 10 | 12 | 1 |
| | 11 | 10 | 0 |
| | 12 | 8 | 0 |
| | 13 | 6 | 0 |
| | 14 | 4 | 0 |
| | 15 | 2 | 0 |

NOZZLE GROUP 0, SET 0
INK ORIFICE NUMBER
DRIVING TIMING
0 1 2 3 4 5 6 7 8 9 10 11 12 13 14 15
0 1 2 3 4 5 6 7 8 9 10 11 12 13 14 15 16 17 18 19 20 21 22 23 24 25 26 27 28 29 30 31
MAIN SCANNING DIRECTION
TIME
2 2 2 2 2 2 2 2 2 2 2 2 2 2 2 2
CONCURRENT DISCHARGE NUMBER
MAIN SCANNING DIRECTION
DOT ARRANGEMENT ON PRINT MEDIUM
NOZZLE GROUP 1, SET 1

NOZZLE GROUP 0
INK ORIFICE NUMBER
DRIVING TIMING
0 1 2 3 4 5 6 7 8 9 10 11 12 13 14 15
0 1 2 3 4 5 6 7 8 9 10 11 12 13 14 15 16 17 18 19 20 21 22 23 24 25 26 27 28 29 30 31
MAIN SCANNING DIRECTION
TIME
MAIN SCANNING DIRECTION
2 2 2 2 2 2 2 2 2 2 2 2 2 2 2 2
CONCURRENT DISCHARGE NUMBER
DOT ARRANGEMENT ON PRINT MEDIUM
NOZZLE GROUP 1

NOZZLE GROUP 0
INK ORIFICE NUMBER
DRIVING TIMING
0 1 2 3 4 5 6 7 8 9 10 11 12 13 14 15
0 1 2 3 4 5 6 7 8 9 10 11 12 13 14 15 16 17 18 19 20 21 22 23 24 25 26 27 28 29 30 31
MAIN SCANNING DIRECTION
TIME
2 2 2 2 2 2 2 2 2 2 2 2 2 2 2 2 2
CONCURRENT DISCHARGE NUMBER
MAIN SCANNING DIRECTION
DOT ARRANGEMENT ON PRINT MEDIUM
NOZZLE GROUP 1

FIG. 37

| ND | NG | SB | TS | DS | DATA 1col. | DATA 2col. | DATA 3col. | DATA 4col. | DOT ARRANGEMENT 1col. | DOT ARRANGEMENT 2col. | DOT ARRANGEMENT 3col. | DOT ARRANGEMENT 4col. |
|---|---|---|---|---|---|---|---|---|---|---|---|---|
| 0 | 0 | 0 | 0 | 1 | × | ○ | ○ | ○ | | | | |
| 1 | | 5 | 0 | 1 | × | ○ | ○ | ○ | | | | |
| 2 | | 10 | 0 | 1 | × | ○ | ○ | ○ | | | | |
| 3 | | 15 | 0 | 1 | × | ○ | ○ | ○ | | | | |
| 4 | | 4 | 0 | 1 | × | ○ | ○ | ○ | | | | |
| 5 | | 9 | 0 | 1 | × | ○ | ○ | ○ | | | | |
| 6 | | 14 | 0 | 1 | × | ○ | ○ | ○ | | | | |
| 7 | | 3 | 0 | 1 | × | ○ | ○ | ○ | | | | |
| 8 | | 8 | 0 | 1 | × | ○ | ○ | ○ | | | | |
| 9 | | 13 | 0 | 1 | × | ○ | ○ | ○ | | | | |
| 10 | | 2 | 0 | 1 | × | ○ | ○ | ○ | | | | |
| 11 | | 7 | 0 | 1 | × | ○ | ○ | ○ | | | | |
| 12 | | 12 | 0 | 1 | × | ○ | ○ | ○ | | | | |
| 13 | | 1 | 0 | 1 | × | ○ | ○ | ○ | | | | |
| 14 | | 6 | 0 | 1 | × | ○ | ○ | ○ | | | | |
| 15 | | 11 | 0 | 1 | × | ○ | ○ | ○ | | | | |
| 16 | 1 | 14 | 14 | 0 | ○ | ○ | ○ | × | | | | |
| 17 | | 3 | 14 | 0 | ○ | ○ | ○ | × | | | | |
| 18 | | 8 | 14 | 0 | ○ | ○ | ○ | × | | | | |
| 19 | | 13 | 14 | 0 | ○ | ○ | ○ | × | | | | |
| 20 | | 2 | 14 | 0 | ○ | ○ | ○ | × | | | | |
| 21 | | 7 | 14 | 0 | ○ | ○ | ○ | × | | | | |
| 22 | | 12 | 14 | 0 | ○ | ○ | ○ | × | | | | |
| 23 | | 1 | 14 | 0 | ○ | ○ | ○ | × | | | | |
| 24 | | 6 | 14 | 0 | ○ | ○ | ○ | × | | | | |
| 25 | | 11 | 14 | 0 | ○ | ○ | ○ | × | | | | |
| 26 | | 0 | 14 | 0 | ○ | ○ | ○ | × | | | | |
| 27 | | 5 | 14 | 0 | ○ | ○ | ○ | × | | | | |
| 28 | | 10 | 14 | 0 | ○ | ○ | ○ | × | | | | |
| 29 | | 15 | 14 | 0 | ○ | ○ | ○ | × | | | | |
| 30 | | 4 | 14 | 0 | ○ | ○ | ○ | × | | | | |
| 31 | | 9 | 14 | 0 | ○ | ○ | ○ | × | | | | |
| 32 | 2 | 12 | 12 | 0 | ○ | ○ | ○ | × | | | | |
| 33 | | 1 | 12 | 0 | ○ | ○ | ○ | × | | | | |
| 34 | | 6 | 12 | 0 | ○ | ○ | ○ | × | | | | |
| 35 | | 11 | 12 | 0 | ○ | ○ | ○ | × | | | | |
| 36 | | 0 | 12 | 0 | ○ | ○ | ○ | × | | | | |
| 37 | | 5 | 12 | 0 | ○ | ○ | ○ | × | | | | |
| 38 | | 10 | 12 | 0 | ○ | ○ | ○ | × | | | | |
| 39 | | 15 | 12 | 0 | ○ | ○ | ○ | × | | | | |
| 40 | | 4 | 12 | 0 | ○ | ○ | ○ | × | | | | |
| 41 | | 9 | 12 | 0 | ○ | ○ | ○ | × | | | | |
| 42 | | 14 | 12 | 0 | ○ | ○ | ○ | × | | | | |
| 43 | | 3 | 12 | 0 | ○ | ○ | ○ | × | | | | |
| 44 | | 8 | 12 | 0 | ○ | ○ | ○ | × | | | | |
| 45 | | 13 | 12 | 0 | ○ | ○ | ○ | × | | | | |
| 46 | | 2 | 12 | 0 | ○ | ○ | ○ | × | | | | |
| 47 | | 7 | 12 | 0 | ○ | ○ | ○ | × | | | | |
| 48 | 3 | 10 | 10 | 0 | ○ | ○ | ○ | × | | | | |
| 49 | | 15 | 10 | 0 | ○ | ○ | ○ | × | | | | |
| 50 | | 4 | 10 | 0 | ○ | ○ | ○ | × | | | | |
| 51 | | 9 | 10 | 0 | ○ | ○ | ○ | × | | | | |
| 52 | | 14 | 10 | 0 | ○ | ○ | ○ | × | | | | |
| 53 | | 3 | 10 | 0 | ○ | ○ | ○ | × | | | | |
| 54 | | 8 | 10 | 0 | ○ | ○ | ○ | × | | | | |
| 55 | | 13 | 10 | 0 | ○ | ○ | ○ | × | | | | |
| 56 | | 2 | 10 | 0 | ○ | ○ | ○ | × | | | | |
| 57 | | 7 | 10 | 0 | ○ | ○ | ○ | × | | | | |
| 58 | | 12 | 10 | 0 | ○ | ○ | ○ | × | | | | |
| 59 | | 1 | 10 | 0 | ○ | ○ | ○ | × | | | | |
| 60 | | 6 | 10 | 0 | ○ | ○ | ○ | × | | | | |
| 61 | | 11 | 10 | 0 | ○ | ○ | ○ | × | | | | |
| 62 | | 0 | 10 | 0 | ○ | ○ | ○ | × | | | | |
| 63 | | 5 | 10 | 0 | ○ | ○ | ○ | × | | | | |
| 64 | 4 | 8 | 8 | 0 | ○ | ○ | ○ | × | | | | |
| 65 | | 13 | 8 | 0 | ○ | ○ | ○ | × | | | | |
| 66 | | 2 | 8 | 0 | ○ | ○ | ○ | × | | | | |
| 67 | | 7 | 8 | 0 | ○ | ○ | ○ | × | | | | |
| 68 | | 12 | 8 | 0 | ○ | ○ | ○ | × | | | | |
| 69 | | 1 | 8 | 0 | ○ | ○ | ○ | × | | | | |
| 70 | | 6 | 8 | 0 | ○ | ○ | ○ | × | | | | |
| 71 | | 11 | 8 | 0 | ○ | ○ | ○ | × | | | | |
| 72 | | 0 | 8 | 0 | ○ | ○ | ○ | × | | | | |
| 73 | | 5 | 8 | 0 | ○ | ○ | ○ | × | | | | |
| 74 | | 10 | 8 | 0 | ○ | ○ | ○ | × | | | | |
| 75 | | 15 | 8 | 0 | ○ | ○ | ○ | × | | | | |
| 76 | | 4 | 8 | 0 | ○ | ○ | ○ | × | | | | |
| 77 | | 9 | 8 | 0 | ○ | ○ | ○ | × | | | | |
| 78 | | 14 | 8 | 0 | ○ | ○ | ○ | × | | | | |
| 79 | | 3 | 8 | 0 | ○ | ○ | ○ | × | | | | |
| 80 | 5 | 6 | 6 | 0 | ○ | ○ | ○ | × | | | | |
| 81 | | 11 | 6 | 0 | ○ | ○ | ○ | × | | | | |
| 82 | | 0 | 6 | 0 | ○ | ○ | ○ | × | | | | |
| 83 | | 5 | 6 | 0 | ○ | ○ | ○ | × | | | | |
| 84 | | 10 | 6 | 0 | ○ | ○ | ○ | × | | | | |
| 85 | | 15 | 6 | 0 | ○ | ○ | ○ | × | | | | |
| 86 | | 4 | 6 | 0 | ○ | ○ | ○ | × | | | | |
| 87 | | 9 | 6 | 0 | ○ | ○ | ○ | × | | | | |
| 88 | | 14 | 6 | 0 | ○ | ○ | ○ | × | | | | |
| 89 | | 3 | 6 | 0 | ○ | ○ | ○ | × | | | | |
| 90 | | 8 | 6 | 0 | ○ | ○ | ○ | × | | | | |
| 91 | | 13 | 6 | 0 | ○ | ○ | ○ | × | | | | |
| 92 | | 2 | 6 | 0 | ○ | ○ | ○ | × | | | | |
| 93 | | 7 | 6 | 0 | ○ | ○ | ○ | × | | | | |
| 94 | | 12 | 6 | 0 | ○ | ○ | ○ | × | | | | |
| 95 | | 1 | 6 | 0 | ○ | ○ | ○ | × | | | | |
| 96 | 6 | 4 | 4 | 0 | ○ | ○ | ○ | × | | | | |
| 97 | | 9 | 4 | 0 | ○ | ○ | ○ | × | | | | |
| 98 | | 14 | 4 | 0 | ○ | ○ | ○ | × | | | | |
| 99 | | 3 | 4 | 0 | ○ | ○ | ○ | × | | | | |
| 100 | | 8 | 4 | 0 | ○ | ○ | ○ | × | | | | |
| 101 | | 13 | 4 | 0 | ○ | ○ | ○ | × | | | | |
| 102 | | 2 | 4 | 0 | ○ | ○ | ○ | × | | | | |
| 103 | | 7 | 4 | 0 | ○ | ○ | ○ | × | | | | |
| 104 | | 12 | 4 | 0 | ○ | ○ | ○ | × | | | | |
| 105 | | 1 | 4 | 0 | ○ | ○ | ○ | × | | | | |
| 106 | | 6 | 4 | 0 | ○ | ○ | ○ | × | | | | |
| 107 | | 11 | 4 | 0 | ○ | ○ | ○ | × | | | | |
| 108 | | 0 | 4 | 0 | ○ | ○ | ○ | × | | | | |
| 109 | | 5 | 4 | 0 | ○ | ○ | ○ | × | | | | |
| 110 | | 10 | 4 | 0 | ○ | ○ | ○ | × | | | | |
| 111 | | 15 | 4 | 0 | ○ | ○ | ○ | × | | | | |
| 112 | 7 | 2 | 2 | 0 | ○ | ○ | ○ | × | | | | |
| 113 | | 7 | 2 | 0 | ○ | ○ | ○ | × | | | | |
| 114 | | 12 | 2 | 0 | ○ | ○ | ○ | × | | | | |
| 115 | | 1 | 2 | 0 | ○ | ○ | ○ | × | | | | |
| 116 | | 6 | 2 | 0 | ○ | ○ | ○ | × | | | | |
| 117 | | 11 | 2 | 0 | ○ | ○ | ○ | × | | | | |
| 118 | | 0 | 2 | 0 | ○ | ○ | ○ | × | | | | |
| 119 | | 5 | 2 | 0 | ○ | ○ | ○ | × | | | | |
| 120 | | 10 | 2 | 0 | ○ | ○ | ○ | × | | | | |
| 121 | | 15 | 2 | 0 | ○ | ○ | ○ | × | | | | |
| 122 | | 4 | 2 | 0 | ○ | ○ | ○ | × | | | | |
| 123 | | 9 | 2 | 0 | ○ | ○ | ○ | × | | | | |
| 124 | | 14 | 2 | 0 | ○ | ○ | ○ | × | | | | |
| 125 | | 3 | 2 | 0 | ○ | ○ | ○ | × | | | | |
| 126 | | 8 | 2 | 0 | ○ | ○ | ○ | × | | | | |
| 127 | | 13 | 2 | 0 | ○ | ○ | ○ | × | | | | |

FIG. 38

| SLANT | NG | TS | DS |
|---|---|---|---|
| 3 | 0 | 0 | 0 |
| | 1 | 6 | 0 |
| | 2 | 12 | 0 |
| | 3 | 2 | 1 |
| | 4 | 8 | 1 |
| | 5 | 14 | 1 |
| | 6 | 4 | 2 |
| | 7 | 10 | 2 |
| 2 | 0 | 0 | 0 |
| | 1 | 4 | 0 |
| | 2 | 8 | 0 |
| | 3 | 12 | 0 |
| | 4 | 0 | 1 |
| | 5 | 4 | 1 |
| | 6 | 8 | 1 |
| | 7 | 12 | 1 |
| 1 | 0 | 0 | 0 |
| | 1 | 2 | 0 |
| | 2 | 4 | 0 |
| | 3 | 6 | 0 |
| | 4 | 8 | 0 |
| | 5 | 10 | 0 |
| | 6 | 12 | 0 |
| | 7 | 14 | 0 |
| 0 | 0 | 0 | 0 |
| | 1 | 0 | 0 |
| | 2 | 0 | 0 |
| | 3 | 0 | 0 |
| | 4 | 0 | 0 |
| | 5 | 0 | 0 |
| | 6 | 0 | 0 |
| | 7 | 0 | 0 |
| −1 | 0 | 0 | 1 |
| | 1 | 14 | 0 |
| | 2 | 12 | 0 |
| | 3 | 10 | 0 |
| | 4 | 8 | 0 |
| | 5 | 6 | 0 |
| | 6 | 4 | 0 |
| | 7 | 2 | 0 |
| −2 | 0 | 0 | 2 |
| | 1 | 12 | 1 |
| | 2 | 8 | 1 |
| | 3 | 4 | 1 |
| | 4 | 0 | 1 |
| | 5 | 12 | 0 |
| | 6 | 8 | 0 |
| | 7 | 4 | 0 |
| −3 | 0 | 0 | 3 |
| | 1 | 10 | 2 |
| | 2 | 4 | 2 |
| | 3 | 14 | 1 |
| | 4 | 8 | 1 |
| | 5 | 2 | 1 |
| | 6 | 12 | 0 |
| | 7 | 6 | 0 |

NOZZLE GROUP 0
NOZZLE GROUP 1
MAIN SCANNING DIRECTION

DRIVING TIMING
0 1 2 3 4 5 6 7 8 9 10 11 12 13 14 15
INK ORIFICE NUMBER
TIME
CONCURRENT DISCHARGE NUMBER
1 1 1 1 1 1 1 1 1 1 1 1 1 1 1 1

NOZZLE GROUP 0
NOZZLE GROUP 1
DOT ARRANGEMENT ON PRINT MEDIUM
MAIN SCANNING DIRECTION

DRIVING TIMING
NOZZLE GROUP 0
NOZZLE GROUP 1
SET 0
MAIN SCANNING DIRECTION
INK ORIFICE NUMBER
TIME
CONCURRENT DISCHARGE NUMBER
DOT ARRANGEMENT ON PRINT MEDIUM

PRINTING APPARATUS AND CONTROL METHOD THEREFOR

BACKGROUND OF THE INVENTION

1. Field of the Invention

The present invention relates to a printing apparatus for printing an image on a print medium by discharging ink droplets from respective ink orifices provided in a printhead based on image data, and a control method therefor, and particularly to a printing apparatus capable of obtaining a satisfactory image by correcting a shift of a dot forming position caused by a slant of a printhead, and a control method therefor.

2. Description of the Related Art

A general inkjet printing apparatus (to be referred to as a printing apparatus hereinafter) includes a printhead formed by arraying, in correspondence with each other, ink orifices and print elements each serving as an energy generation unit such as a heater or piezo element for discharging ink droplets. The printing apparatus discharges ink droplets to the print medium while moving a carriage mounted with the printhead in a predetermined direction (main scanning direction). Upon end of printing for one scan (printing scan), the printing apparatus conveys the print medium in a direction (sub-scanning direction: print element array direction) intersecting the main scanning direction. By repeating this operation, the printing apparatus completes image printing on the print medium. This printing is called serial printing.

Alternatively, there is provided a method of performing image printing while relatively moving the print medium and the printhead in the direction (sub-scanning direction) intersecting the array direction (main scanning direction) of the plurality of print elements mounted in the printhead.

It is not desirable for the printing apparatus to include a power supply necessary to simultaneously discharge ink droplets from all the ink orifices of each ink orifice array (print element array) of the printhead since the apparatus cost increases and noise is generated due to the flow of a large current. To solve this problem, conventionally, the plurality of print elements are time-divisionally driven.

Time-divisional driving is summarized as follows. A plurality of print elements forming each ink orifice array are divided into a plurality of groups each including a plurality of adjacent print elements, and the plurality of print elements included in each group are assigned to different blocks. The plurality of print elements of the respective blocks are sequentially driven at certain time intervals to drive all the print elements. This is called one driving cycle. In actual printing, printing is executed in a print region by repeating this cycle.

The printhead may be slanted and attached to the carriage of the printing apparatus due to a built-in error of the printhead and an attachment error caused when the printhead is attached to the printing apparatus. Consequently, the forming position of a print dot may shift in accordance with the slant. That is, a so-called shift by a slant may occur. This will be referred to as a printhead slant hereinafter.

Japanese Patent Laid-Open No. 2009-6676 proposes an arrangement of transferring print data, correcting a printhead slant by shifting print elements to be driven for each printing scan, and printing an image. Furthermore, Japanese Patent Laid-Open No. 9-104113 discloses an example in which a plurality of nozzles (print elements) are divided into a plurality of groups, and an image is formed while correcting a printhead slant by adjusting driving timings.

On the other hand, there is provided a method of arranging ink droplets on the print medium in line by adjusting ink discharge positions in correspondence with the above-described driving timings in order to improve the image quality of characters and thin lines.

FIGS. 44A to 44C are views showing the relationship between the driving timings of the printhead including 16 ink orifices and a dot arrangement on the print medium.

As shown in FIG. 44A, the ink orifices (orifices) are not vertically arranged in line in the array direction but arranged while shifting in a carriage moving direction. As is apparent from FIG. 44B, this shift corresponds to the above-described timings of time-divisional driving. Thus, discharge of ink droplets, and relative movements of the print medium and a printhead 11 make it possible to print a straight line, as indicated by dot positions on the print medium, which are represented by hatched circles in FIG. 44C.

The printhead 11 indicated by dotted lines in FIG. 44A represents a state in which the printhead 11 is slanted due to an attachment error to the printing apparatus, manufacturing variations, and the like. In printing in this state, it is impossible to print a straight line as described above, resulting in a slanted dot arrangement as indicated by dotted open circles in FIG. 44C.

In this state, the method proposed in Japanese Patent Laid-Open No. 2009-6676 adjusts, for example, the driving timings of print elements 200-0 to 200-7 included in an orifice group 200. However, even if such adjustment is performed, a printed dot group 2001 is only translated in a carriage moving direction while being slanted, and thus a shift of the landing position of an ink droplet occurs at the boundary between a dot which is translated and a dot which is not translated. As a result, no straight line is printed. Furthermore, when the printhead slant overlaps, on the print medium, a dot group printed by another printhead for discharging ink of a different color, a shift of dot coverage occurs due to the occurrence of a local shift in the dot arrangement, as described above, thereby causing band unevenness.

In addition, even if the printhead slant is corrected in accordance with the arrangement proposed in Japanese Patent Laid-Open No. 9-104113, the number of print elements which are driven at the same timing may change. The number of print elements which are driven at the same timing is defined as a "maximum concurrent drive number". If this value is exceeded, discharge failure or image deterioration may occur due to a drive voltage drop of the printhead, and thus the value should be managed so as to not be exceeded. Furthermore, it is necessary to set the power supply capacity of the printing apparatus very large to make the maximum concurrent drive number changeable. This increases the apparatus cost.

SUMMARY OF THE INVENTION

Accordingly, the present invention is conceived as a response to the above-described disadvantages of the conventional art.

For example, a printing apparatus and a control method therefor according to this invention are capable of implementing high quality image printing by changing time-divisional driving timings even if a printhead is slanted and attached.

According to one aspect of the present invention, there is provided a printing apparatus which mounts a printhead including a plurality of print elements arrayed in a predetermined pitch in a predetermined direction, and prints an image on a print medium while relatively scanning the printhead, and discharging ink from the printhead to the print medium, the apparatus comprising: a time-divisional drive unit configured to time-divisionally drive the plurality of print elements in predetermined order by dividing a time corresponding to a print resolution in a scanning direction of the printhead into a plurality of times such that one print element of the plurality of print elements which is driven at one driving timing and another print element of the plurality of print elements which is driven at a next driving timing are apart from each other for more than two print element pitch, and setting the divided times as driving timings; and a change unit configured to change, using the divided time as a unit, the driving timings for each of a plurality of groups, which is formed from a predetermined number of adjacent print elements of the plurality of print elements in the time-divisional driving.

According to another aspect of the present invention, there is provided a control method for a printing apparatus which mounts a printhead including a plurality of print elements arrayed in a predetermined pitch in a predetermined direction, and prints an image on a print medium while relatively scanning the printhead, and discharging ink from the printhead to the print medium, the method comprising: dividing a time corresponding to a print resolution in a scanning direction of the printhead into a plurality of times such that one print element of the plurality of print elements which is driven at one driving timing of a time divisional drive and another print element of the plurality of print elements which is driven at a next driving timing of the time divisional drive are apart from each other for more than two print element pitch; forming a plurality of groups each including a predetermined number of adjacent print elements of the plurality of print elements upon time-divisionally driving the plurality of print elements in predetermined order by setting the divided times as driving timings; and controlling to execute printing by changing, using the divided time as a unit, the driving timings for each of the plurality of groups.

The invention is particularly advantageous since time-divisional driving timings are appropriately changed even if a printhead slant occurs, and it is thus possible to execute high quality image printing. Furthermore, since the maximum concurrent drive number in time-divisional driving is not exceeded even if the driving timings are changed, there is an advantage that the power supply capacity of the printing apparatus does not become large.

Further features of the present invention will become apparent from the following description of exemplary embodiments (with reference to the attached drawings).

BRIEF DESCRIPTION OF THE DRAWINGS

FIG. 11 is a table showing the internal arrangement of a nozzle buffer 211.

FIG. 14 is a table showing the arrangement of a transfer buffer 213.

FIG. 15 is a table showing an example of block drive sequence data written at addresses 0 to 15 in a block drive sequence data memory 214.

FIG. 16 is a table showing an example in which data for shifting the print timings of nozzle groups 0 to 15 stored in a timing shift data memory 220 are stored.

FIG. 17 is a table showing the relationship between each nozzle group, ink orifice numbers (nozzle numbers), and a correction value after measurement of a printhead slant amount.

FIG. 23 is a table showing an ink orifice number (nozzle number) assigned to each of the print elements of nozzle groups 0 to 15, a block, a timing shift amount for each nozzle group, print data, and a dot arrangement in a case where the slant of the printhead is −1.

FIG. 24 is a table showing a driving timing shift amount and a data readout position change for each nozzle group with respect to a head slant of +3 to −3 of the printhead including the print elements of nozzle groups 0 to 15.

FIG. 30 is a table showing the driving timing for each nozzle (ink orifice) and a dot arrangement in a case where correction of a head slant of −2 is performed in the printhead 11 including 128 ink orifices.

FIG. 31 is a table showing a print element timing shift amount and a print data readout position setting for each nozzle group with respect to the measurement value of the printhead slant according to the first embodiment.

FIG. 37 is a schematic table showing an example of a driving timing for each ink orifice and a dot arrangement in a case where correction is performed for the printhead with a shift of −1 by a slant according to the second embodiment.

FIG. 38 is a table showing the relationship between a driving timing shift amount and a print data shift amount for each nozzle group.

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element (nozzle)" generically means an ink orifice or a liquid channel communicating with it, and an element for generating energy used to discharge ink, unless otherwise specified.

An element substrate (head substrate) for a printhead to be used below indicates not a mere base made of silicon semiconductor but a component provided with elements, wirings, and the like.

"On the substrate" not only simply indicates above the element substrate but also indicates the surface of the element substrate and the inner side of the element substrate near the surface. In the present invention, "built-in" is a term not indicating simply arranging separate elements on the substrate surface as separate members but indicating integrally forming and manufacturing the respective elements on the element substrate in, for example, a semiconductor circuit manufacturing process.

<Arrangement of Printing Apparatus (FIG. 1)>

Figure 1:
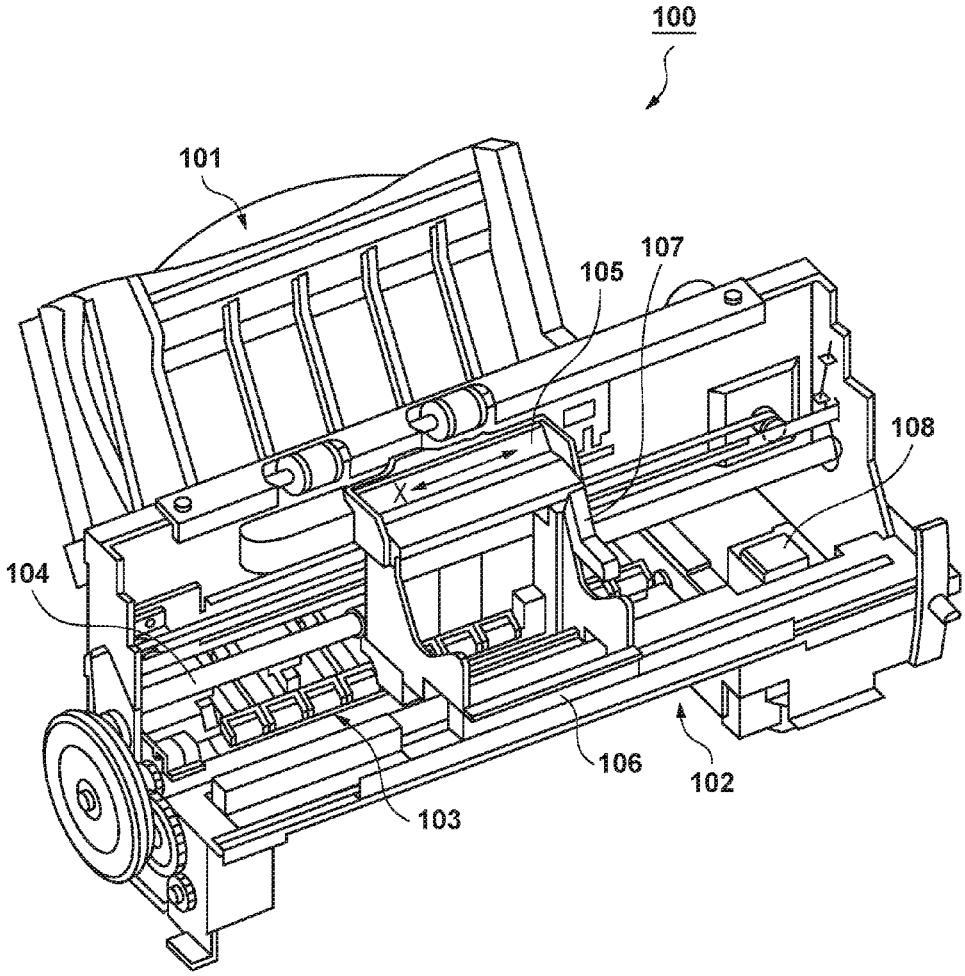
FIG. 1 is a perspective view showing the schematic outer arrangement of an inkjet printing apparatus as an exemplary embodiment of the present invention.

FIG. 1 is a perspective view showing the schematic outer arrangement of an inkjet printing apparatus (to be referred to as a printing apparatus hereinafter) as an exemplary embodiment of the present invention.

A printing apparatus 100 includes an automatic feeding unit 101 for automatically feeding print media such as paper sheets into an apparatus main body, and a conveyance unit 103 for guiding, to a predetermined print position, the print media sent from the automatic feeding unit 101 one by one, and guiding the print media from the print position to a discharge unit 102. The printing apparatus 100 also includes a print unit for executing desired printing on the print medium conveyed to the print position, and a recovery unit 108 for performing recovery processing for the print unit.

The print unit is formed from a carriage 105 supported by a carriage shaft 104 to be movable in a direction (main scanning direction) of an arrow X, and a printhead (not shown) mounted to be detachable from the carriage 105. Therefore, the main scanning direction corresponds to a carriage moving direction. Note that the printhead includes a print element array in which a plurality of print elements are arrayed, and the main scanning direction of the arrow X corresponds to a direction intersecting a print element array direction. Note that the print medium is fed by the automatic feeding unit 101 in a direction orthogonal to the carriage moving direction (main scanning direction), and conveyed by a conveyance mechanism. The feed/conveyance direction of the print medium will be referred to as a sub-scanning direction hereinafter. If the printhead is mounted in the carriage 105, the print element array direction forms a predetermined angle with the sub-scanning direction but may be slanted with respect to a normal attachment angle due to various factors.

In the present invention, in a case where the printhead is attached so that the main scanning direction of the arrow X and the print element array direction diagonally intersect each other, a slant error in the printing apparatus is corrected.

The carriage 105 includes a carriage cover 106 which is engaged with the carriage 105 to guide the printhead to a predetermined attachment position on the carriage 105. Furthermore, the carriage 105 includes a head set lever 107 which is engaged with the tank holder of the printhead to press the printhead to be set at the predetermined attachment position.

A head set plate (not shown) is provided in an upper portion of the carriage 105 to be pivotal about a head set lever shaft, and biased, by a spring, against the engaging portion with the printhead. By this spring force, the head set lever 107 is configured to attach the printhead to the carriage 105 while pressing it.

<Arrangement of Printhead (FIGS. 2A, 2B, and 3)>

Figure 2B:
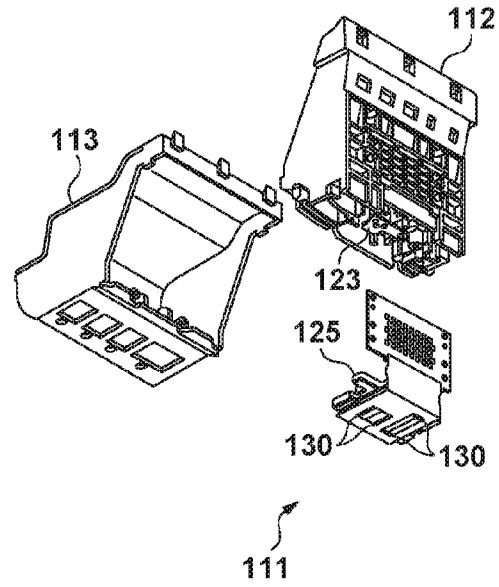
FIGS. 2A and 2B are exploded perspective views each showing the arrangement of a printhead mounted in the printing apparatus shown in FIG. 1.
Figure 2A:
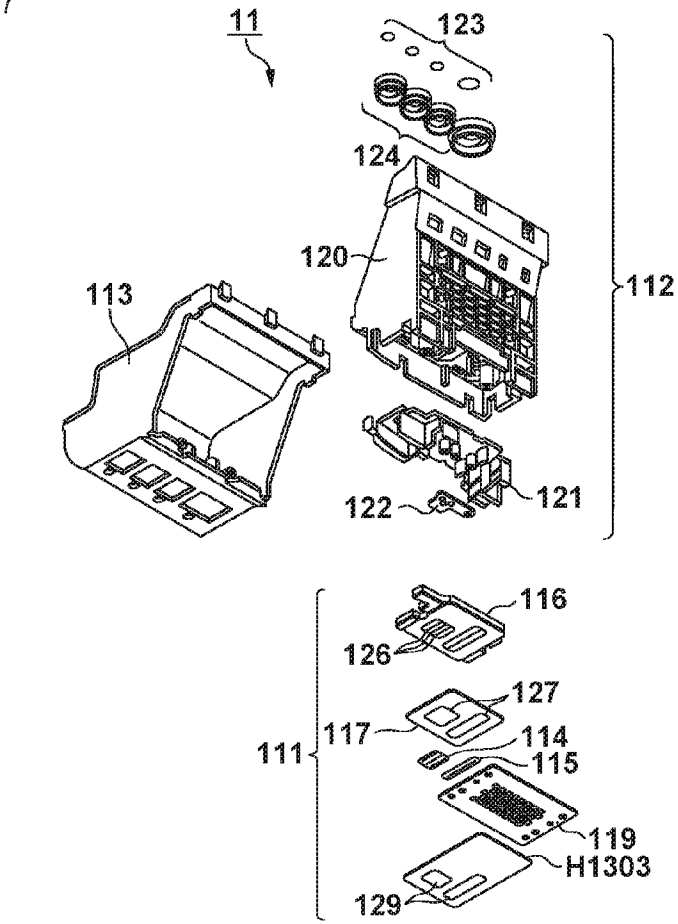

FIGS. 2A and 2B are exploded perspective views each showing the arrangement of a printhead 11 of FIG. 1. FIG. 2A is an exploded perspective view showing the printhead 11 in detail. FIG. 2B is an exploded perspective view schematically showing the printhead 11. The printhead 11 is an inkjet printhead, and is formed from a print element unit 111, an ink supply unit 112, and a tank holder 113. Furthermore, the print element unit 111 is formed from a first element substrate 114, a second element substrate 115, a first plate 116, an electric wiring tape 119, and a second plate 117.

The ink supply unit 112 is formed from an ink supply member 120, a channel forming member 121, a joint rubber member 122, filters 123, and sealing rubber members 124.

The print element unit 111 will be described next.

As shown in FIG. 2B, the print element unit 111 is mounted by forming a plate joint body 125 by joining the first plate 116 and the second plate 117, and mounting the first element substrate 114 and the second element substrate 115 on the plate joint body 125. Furthermore, the print element unit 111 is mounted by stacking the electric wiring tape 119, electrically joining the first element substrate 114 and the second element substrate 115, and sealing the electrical connection portion and the like.

The first plate 116 which is required to have plane accuracy since it influences a droplet discharge direction is made of an alumina ($Al_2O_3$) material with a thickness of 0.5 to 10 mm. In the first plate 116, ink supply ports 126 for supplying ink to the first element substrate 114 and the second element substrate 115 are formed.

The second plate 117 is one plate member with a thickness of 0.5 to 1 mm, and has window-like openings 127 larger than the outer shape dimensions of the first element substrate 114 and second element substrate 115 which are adhered and fixed to the first plate 116. The second plate 117 is stacked and fixed to the first plate 116 by an adhesive, thereby forming the plate joint body 125.

The first element substrate 114 and the second element substrate 115 are adhered and fixed to the surface of the first plate 116 but are extremely difficult to be mounted with high accuracy due to the accuracy at the time of mounting, movement of an adhesive, and the like. Therefore, this is one of factors for an error caused when assembling the printhead, which poses a problem in the present invention.

Each of the first element substrate 114 and second element substrate 115, which has an ink orifice array including a plurality of ink orifices, has a structure known as a side-shooter type bubble Jet® substrate. Each of the first element substrate 114 and second element substrate 115 includes, on an Si substrate with a thickness of 0.5 to 1 mm, an ink supply port formed from a long groove-shaped through-hole as an ink channel, and heater arrays as energy generation units which are arrayed in a staggered pattern so that one heater array is arrayed on each side of the ink supply port. Each of the first element substrate 114 and second element substrate 115 includes, on a side orthogonal to the heater array, an electrode portion which is connected to the heaters and in which connection pads are arrayed on the two outer sides of the substrate.

A TAB tape is adopted as the electric wiring tape 119. The TAB tape is a laminate of a tape base material (base film), copper foil wiring, and cover layer.

Inner leads 129 as connection terminals extend to the two connection sides of device holes corresponding to the electrode portions of the first element substrate 114 and second element substrate 115. The cover layer side of the electric wiring tape 119 is adhered and fixed to the surface of the second plate 117 by a thermosetting epoxy resin adhesive layer, and the base film of the electric wiring tape 119 serves as a smooth capping surface against which the capping member of the print element unit 111 abuts.

The electric wiring tape 119 and the two element substrates 114 and 115 are electrically connected by a thermal ultrasonic pressing method or via an anisotropic conductive tape. In the case of the TAB tape, inner lead bonding (ILB) by a thermal ultrasonic pressing method is desirable. In the print element unit 111, the leads of the electric wiring tape 119 and stud bumps on the first element substrate 114 and second element substrate 115 are ILB-connected.

After the electric wiring tape 119 and the two element substrates 114 and 115 are electrically connected, they are sealed by a first sealant 130 and a second sealant H1303 to protect the electrical connection portion from corrosion caused by ink and an external shock. The first sealant 130 mainly seals the peripheral portions of the mounted element substrates, and the second sealant H1303 seals the front side of the electrical connection portion of the electric wiring tape 119 and the element substrates 114 and 115.

Figure 3:
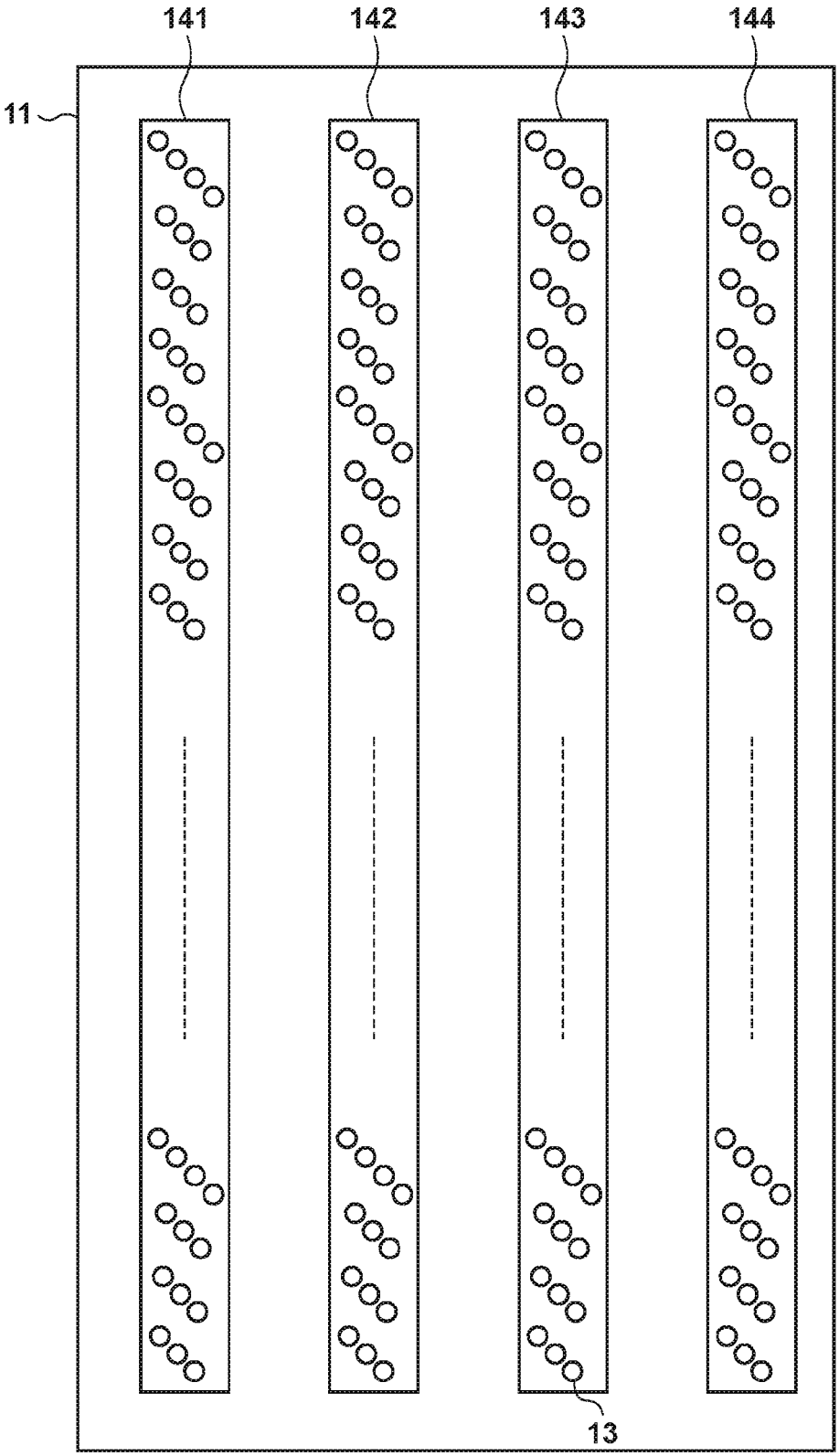
FIG. 3 is a view showing a plurality of ink orifice arrays when viewing the printhead from an ink orifice surface.

FIG. 3 is a view showing a plurality of ink orifice arrays when viewing the printhead 11 from the ink orifice surface. As shown in FIG. 3, 128 ink orifices 13 are arrayed to form each of four ink orifice arrays 141, 142, 143, and 144. The ink orifice arrays discharge ink droplets of black, cyan, magenta, and yellow, respectively.

Note that the present invention does not have the arrangement of the printhead 11 as a technical feature, and each of the ink orifice arrays 141, 142, 143, and 144 of the respective colors may include two rows on which the ink orifices 13 are alternately arranged in the sub-scanning direction. Furthermore, the number of ink orifices 13 in the ink orifice array 141 of black may be larger than those of ink orifices 13 in the ink orifice arrays 142, 143, and 144 of the remaining colors.

A description will be provided by paying attention to one ink orifice array (the ink orifice array 141 of black). However, it is possible to correct a shift by a slant in the same manner with respect to the remaining ink orifice arrays 142, 143, and 144.

As is apparent from FIG. 3, each of the four ink orifice arrays is not formed by linearly arraying a plurality of ink orifices but formed by arranging ink orifices in a staggered pattern by setting three or four ink orifices as a unit. The ink orifices are arranged so that the landing positions of the ink droplets on the print medium are aligned along the conveyance direction of the print medium by discharging ink in accordance with driving timings of time-divisional driving (to be described later).

This arrangement will be described with reference to the accompanying drawings.

Figures 4A, 4B, 4C:
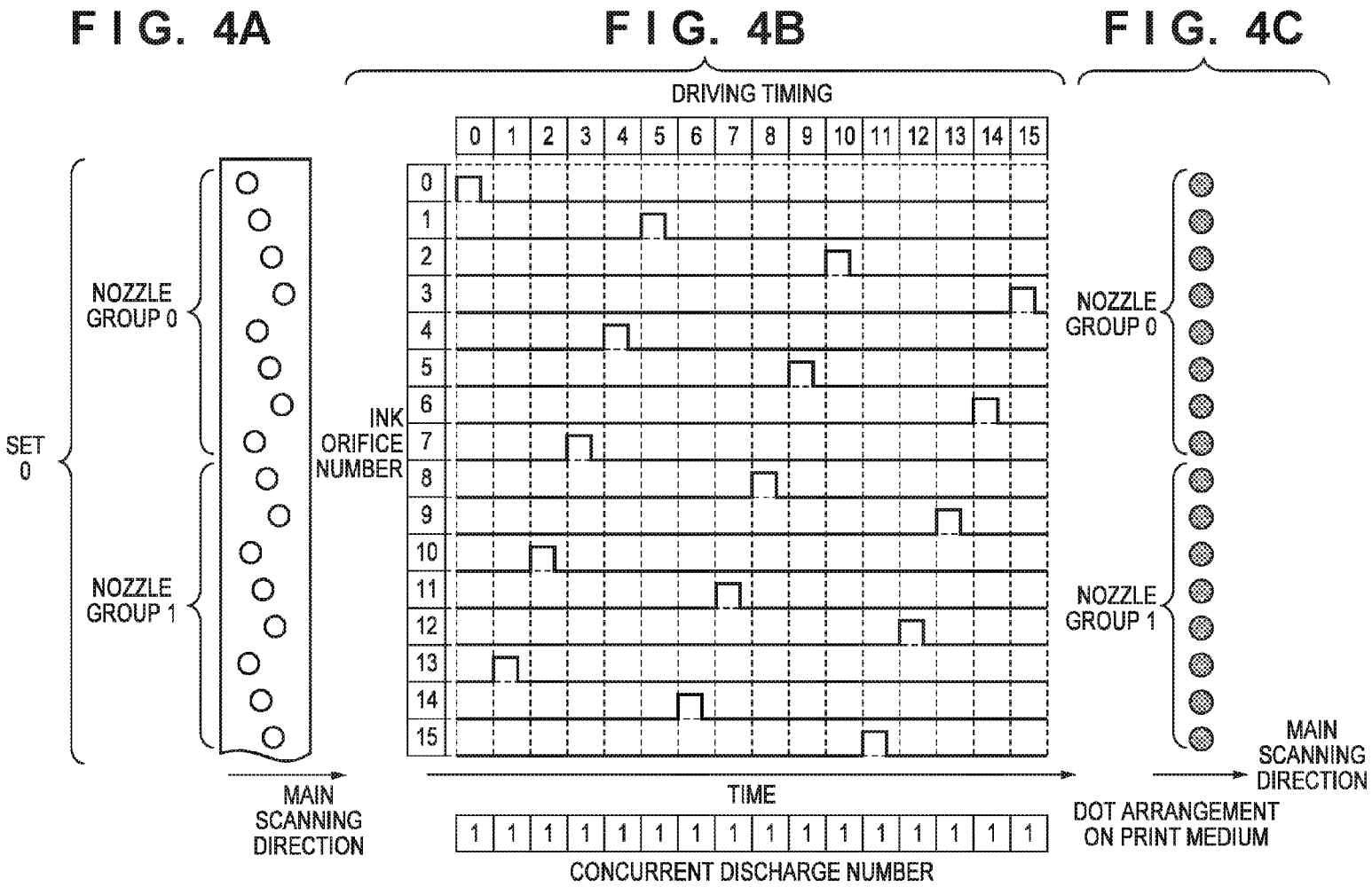
FIGS. 4A, 4B, and 4C are views showing a case in which upper 16 ink orifices of the ink orifice array of the printhead are divided into 16 blocks and time-divisionally driven.

FIGS. 4A to 4C are views showing a case in which upper 16 ink orifices of the ink orifice array 141 of the printhead 11 are divided into 16 blocks and time-divisionally driven.

FIG. 4A shows the arrangement of the 16 ink orifices (nozzles) in which adjacent ink orifices (nozzles) are defined as one nozzle group. In this example, eight adjacent ink orifices form one nozzle group, and the upper group is defined as nozzle group 0 and the lower group is defined as nozzle group 1. Note that since each ink orifice array of the printhead 11 is formed from 128 ink orifices, nozzle groups 0, 1, . . . , 7 are defined from one end to the other end.

FIG. 4B shows an example of driving timings of time-divisional driving. In this example, different driving timings (0 to 15) are assigned to the 16 ink orifices (0 to 15). If the 16 blocks are time-divisionally driven in this way, the time necessary to time-divisionally drive the 16 blocks or a length corresponding to the time corresponds to a print resolution (one column) in the carriage moving direction. In accordance with assignment of each driving timing, an ink orifice and print element are selected, and ink is discharged by driving the selected print element, thereby printing an image. As is apparent from FIG. 4B, at each of driving timings 0 to 15, the print element of one of ink orifice numbers 1 to 15 is driven to discharge an ink droplet. Therefore, the number (concurrent discharge number) of print elements concurrently driven at each driving timing is 1. As understood from FIGS. 4A and 4B, adjacent print elements are not driven in continuous order. In an example of FIG. 4B, the driving order of ink orifice number 0-15 is 0, 13, 10, 7, 4, 1, 14, 11, 8, 5, 2, 15, 12, 9, 6 and 3. In other words, in this example, one print element which is driven at one driving timing and another print element which is driven at the next driving timing is always apart from each other for more than two print element pitch. In this way, continuously arranged print elements as shown in FIG. 4A are dispersedly driven. This driving is called dispersed driving. In the example of FIG. 4B, every time the ink orifice number is incremented by 1, the driving timing (driving order) of the corresponding ink orifice is cyclically incremented by 5. In other words, if the driving timing reaches 15, the next driving timing returns to zero (0).

In this case, the ink orifices are arranged at positions corresponding to the driving timings, as shown in FIG. 4A, so that the landing positions of ink droplets are aligned in the carriage moving direction on the print medium even if the timings of time-divisional driving are different. This makes it possible to align the landing positions of ink droplets on the print medium, as shown in FIG. 4C.

<Time-Divisional Driving Timing Change for Correction of Printhead Slant>

Figure 5A:
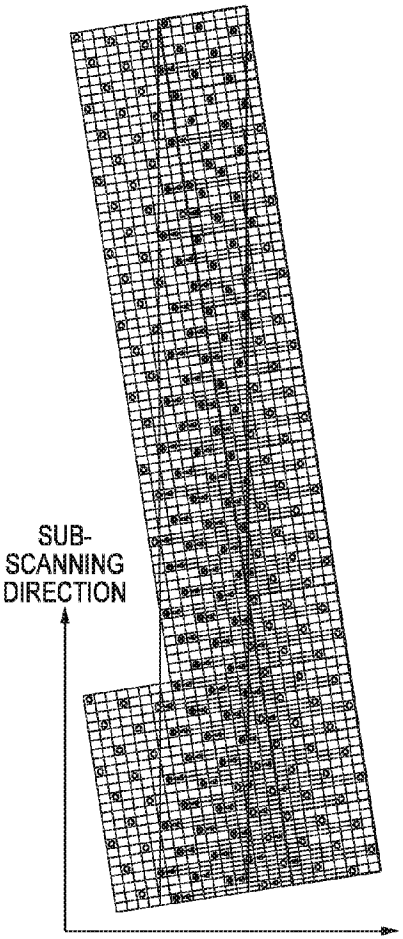
FIGS. 5A, 5B, and 5C are views each showing the positions of dots printed on a print medium by the slanted printhead.
Figure 5B:
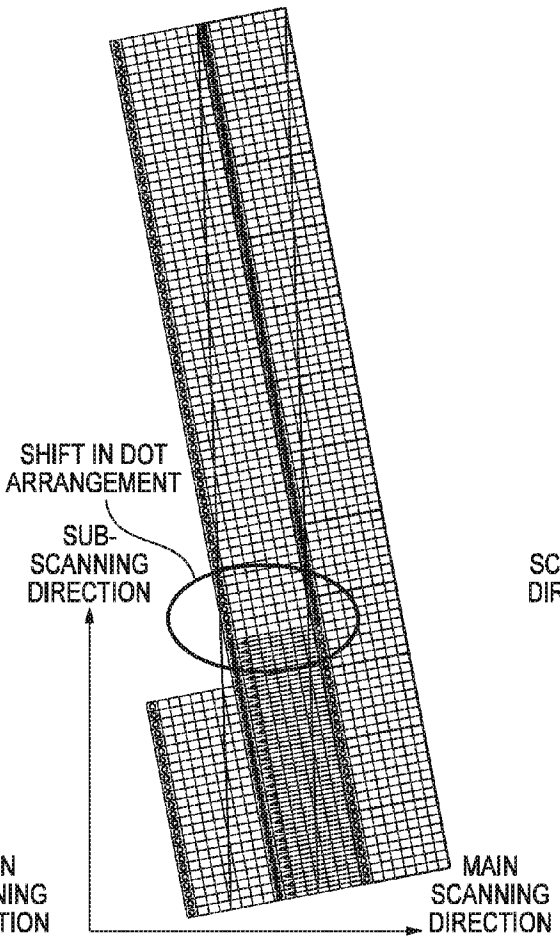
Figure 5C:
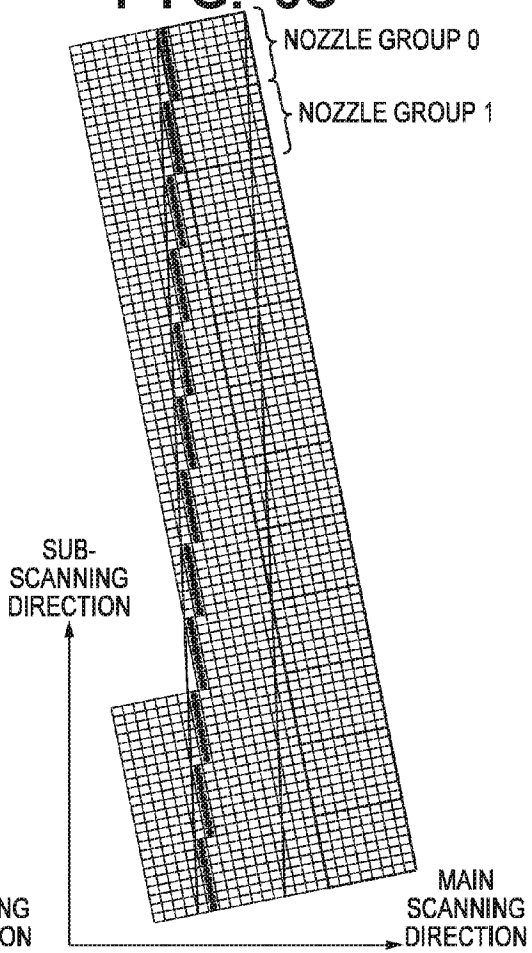

FIGS. 5A to 5C are views each showing the positions of dots printed on the print medium by the slanted printhead.

Referring to FIGS. 5A to 5C, the ordinate represents the sub-scanning direction and the abscissa represents the main scanning direction. For the sake of simplicity, each of FIGS. 5A to 5C shows an example in which printing is time-divisionally executed eight times for the print resolution (one column) in the main scanning direction.

FIG. 5A shows the arrangement of dots printed by executing time-divisional driving according to a correction method of Japanese Patent Laid-Open No. 2009-6676. Referring to FIG. 5A, solid-line grids indicate the positions, on the print medium, of the dots printed by time-divisionally driving the printhead slanted and attached. Vertical solid lines indicate a target print area with a width of the print resolution (one column).

Accordance to a correction method of Japanese Patent Laid-Open No. 2009-6676, a print position is corrected by shifting corresponding print data in the main scanning direction for each ink orifice on a print resolution basis, as shown in FIG. 5A. Referring to FIG. 5A, each open circle indicates a dot print position before correction and each solid circle indicates a dot print position after correction.

FIG. 5B shows a dot arrangement when printing is executed by applying the correction method according to Japanese Patent Laid-Open No. 2009-6676 to correct a head slant using the printhead in which the ink orifices are arranged so that dot print positions on the print medium are aligned even if the timings of time-divisional driving are different, as shown in FIGS. 4A to 4C. Referring to FIG. 5B, each open circle indicates a dot print position before correction and each solid circle indicates a dot print position after correction. In this case, since the ink orifices of the printhead are arranged in correspondence with the driving timings, the dot print positions before correction are aligned in line, and thus a shift occurs in the dot arrangement printed as shown in FIG. 5B due to correction of the head slant. Therefore, even if the landing positions of ink droplets by time-divisional driving of the printhead are corrected by the arrangement of the ink orifices, no straight line can be printed. Furthermore, when the printhead slant overlaps, on the print medium, a dot group printed by a printhead for discharging ink of a different color, if a local shift occurs in the dot arrangement as described above, a shift of dot coverage may occur, thereby causing band unevenness.

FIG. 5C shows the arrangement of print dots when time-divisional driving is performed according to the embodiment of the present invention to correct the printhead slant. In this example, with respect to the printhead slant, the plurality of orifices are divided into a plurality of nozzle groups, and the ink discharge timings are changed at a time interval shorter than the time necessary to print dots for one column. This corrects the dot arrangement on the print medium at a length shorter than that corresponding to one column.

A discharge timing change applied to the example shown in FIG. 5C will be described with reference to FIGS. 6A to 7C. Note that as will be apparent by comparing FIGS. 6A to 7C with FIGS. 4A to 4C, the arrangement of the ink orifices of the printhead and the division number and timings of time-divisional driving are the same. Thus, a description of the arrangement already described with reference to FIGS. 4A to 4C will be omitted and only an arrangement characteristic to FIGS. 6A to 7C will be described.

Figures 6A, 6B, 6C:
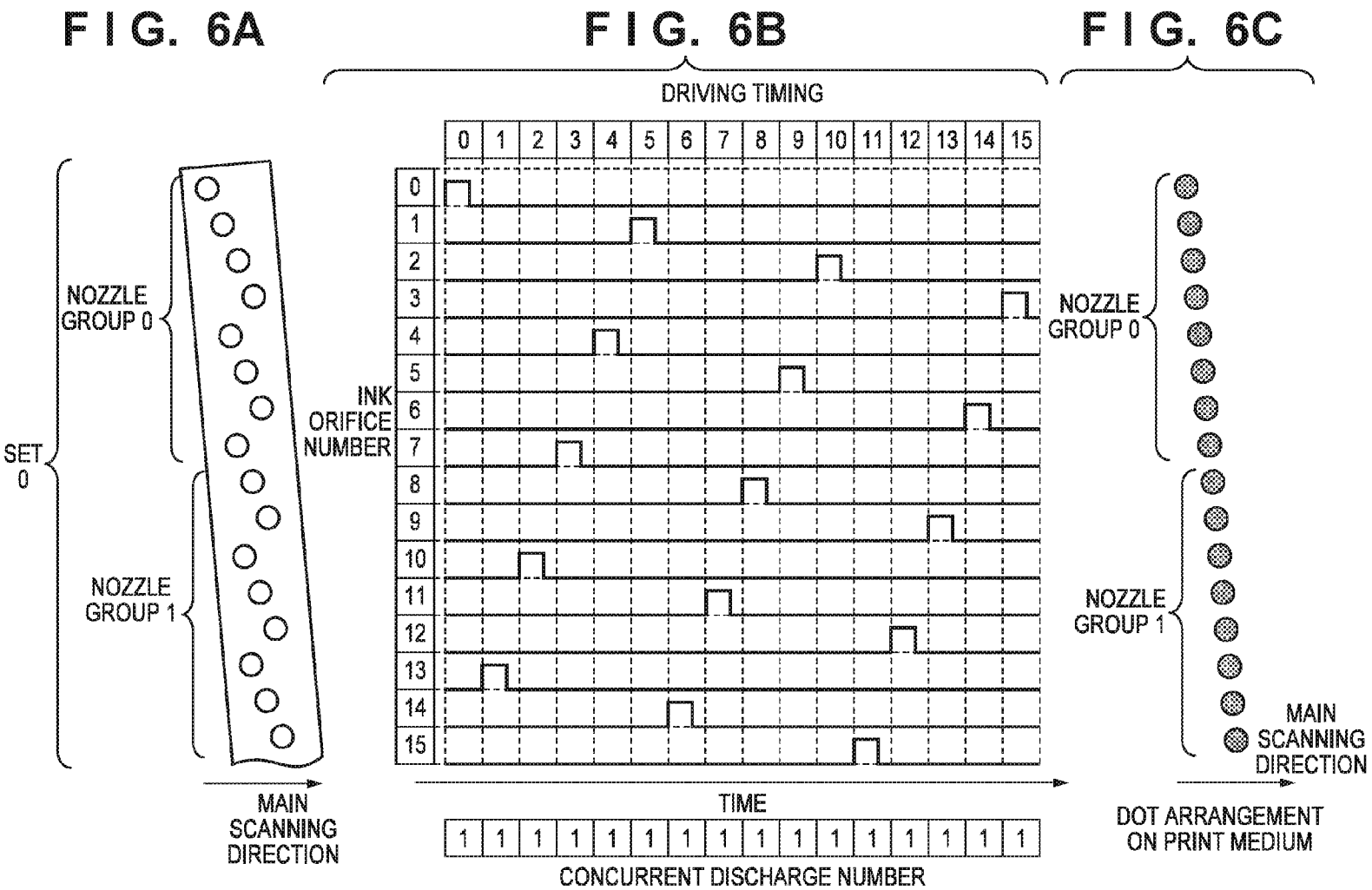
FIGS. 6A, 6B, and 6C are views showing a case in which printing is executed without correcting a printhead slant although the printhead is slanted under conditions described with reference to FIGS. 4A to 4C.

FIGS. 6A to 6C show a case in which printing is executed without correcting the printhead slant although the printhead is slanted under the conditions described with reference to FIGS. 4A to 4C. Therefore, the positions of the ink orifices (nozzles) shown in FIG. 6A are also slanted with respect to those shown in FIG. 4A. As a result, the landing positions of ink droplets on the print medium shown in FIG. 6C are different, and the arrangement of printed dots is slanted.

Figures 7A, 7B, 7C:
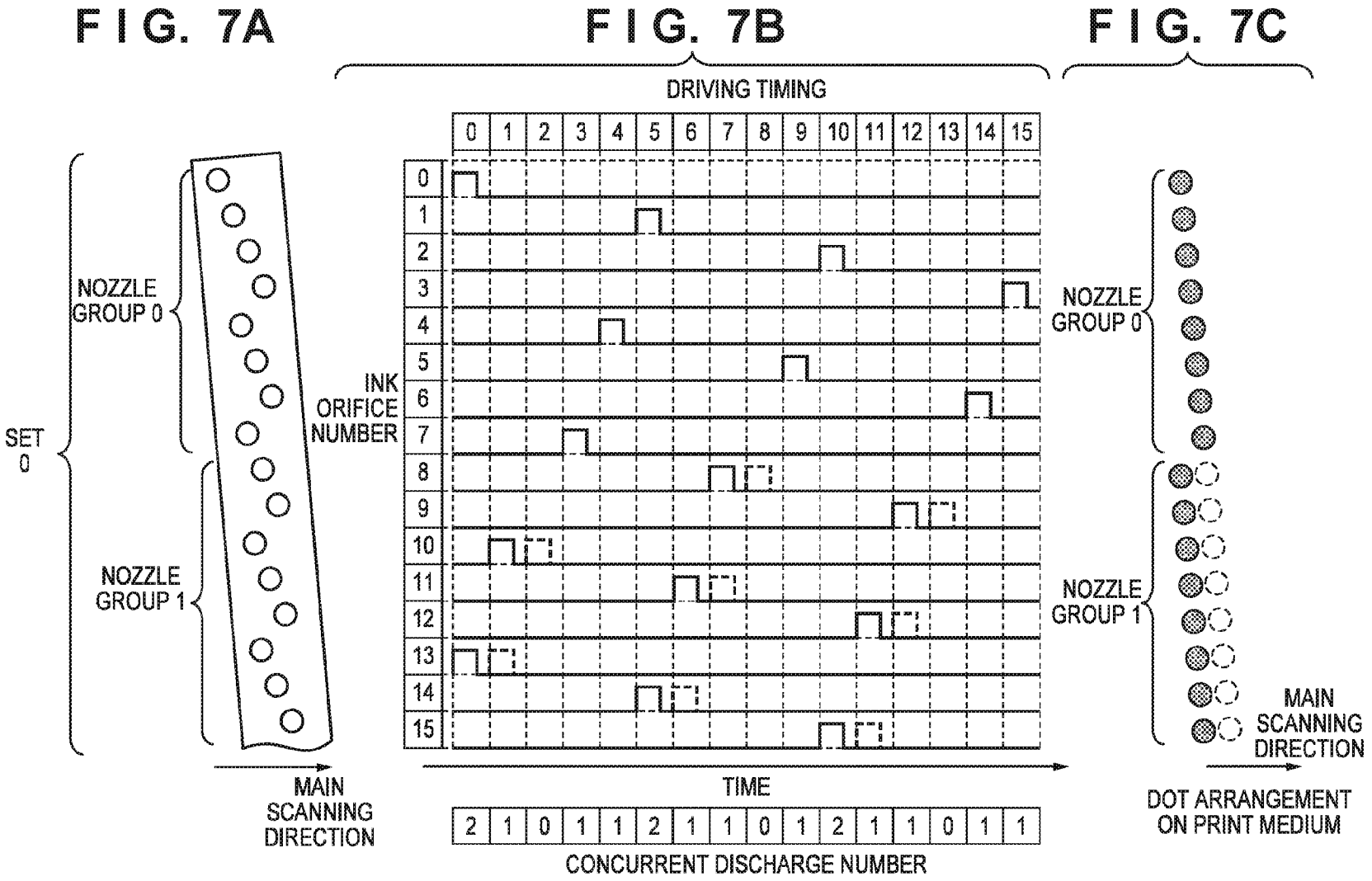
FIGS. 7A, 7B, and 7C are views showing a case in which printing is executed by correcting the printhead slant since the printhead is slanted under the conditions described with reference to FIGS. 4A to 4C.

To the contrary, FIGS. 7A to 7C show a case in which printing is executed by correcting the printhead slant since the printhead is slanted under the conditions described with reference to FIGS. 4A to 4C.

As will be apparent by comparing FIGS. 7B and 4B, the landing positions of ink droplets on the print medium are corrected by shifting the driving timings of nozzle group 1 by the driving timing of time-divisional driving. This changes dot positions to be printed, as shown in FIG. 7C, thereby making it possible to perform correction of the printhead slant which has been schematically described with reference to FIG. 5C.

Note that nozzle groups used for one period of time-divisional driving will be referred to as a set hereinafter. As for the printhead 11 having the arrangement shown in FIG. 3, ink orifices (nozzles) 0 to 15 are defined as set 0, ink orifices (nozzles) 16 to 31 are defined as set 1, and ink orifices (nozzles) 112 to 127 are defined as set 7.

<Control Circuit of Printing Apparatus (FIGS. 8 to 10)>

Figure 8:
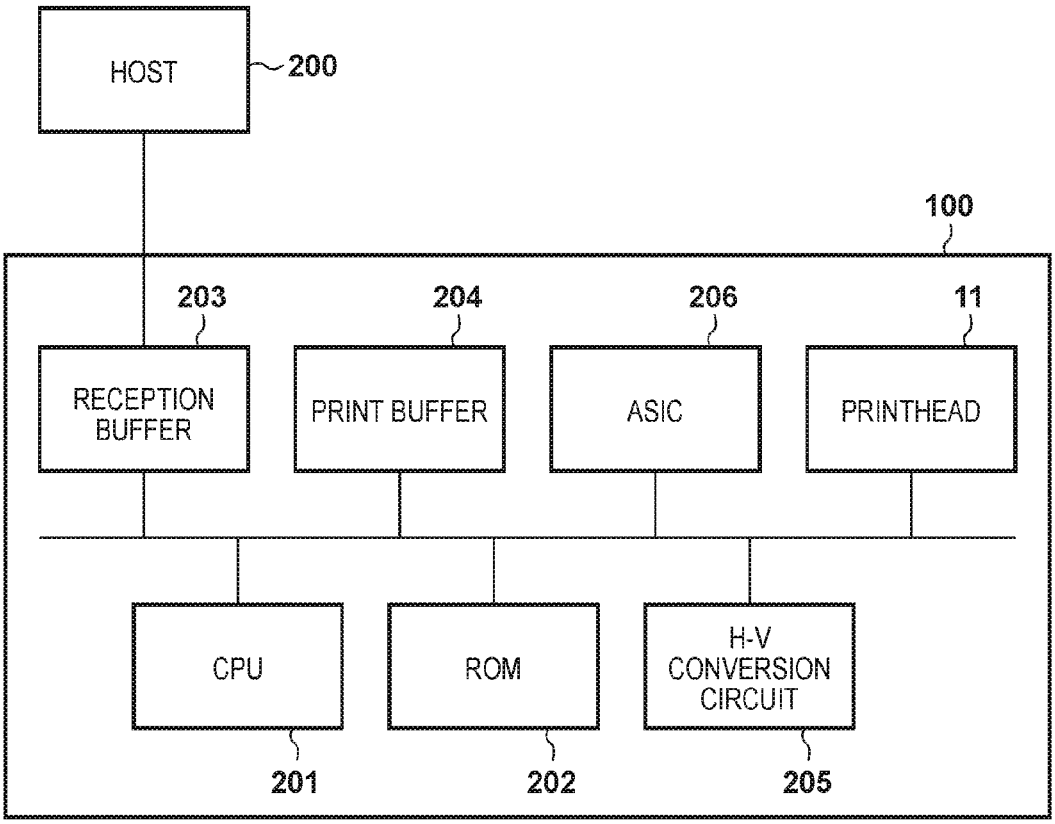
FIG. 8 is a block diagram showing the arrangement of a control circuit in a printing apparatus 100 shown in FIG. 1.

FIG. 8 is a block diagram showing the arrangement of a control circuit in the printing apparatus 100 shown in FIG. 1.

In the printing apparatus 100, reference numeral 201 denotes a CPU; and 202, a ROM storing a control program to be executed by the CPU 201. Raster image data received from an external apparatus such as a host 200 is stored in a reception buffer 203. The image data stored in the reception buffer 203 is compressed to reduce a transmission data amount from the host 200. Therefore, the image data is expanded by the CPU 201 or a compressed data expansion circuit (not shown), and stored in a print buffer 204. The print buffer 204 is implemented by, for example, a DRAM. The format of data stored in the print buffer 204 is a raster format. The print buffer 204 has a capacity capable of storing data of rasters, the number of which corresponds to the width of one scan printing operation.

The image data stored in the print buffer 204 undergoes H-V conversion processing executed by an H-V conversion circuit 205, and is stored in a nozzle buffer 211 included in an ASIC 206. Note that the detailed arrangement of the ASIC 206 will be described later. That is, the nozzle buffer (column buffer) 211 stores data in a column format. This data format corresponds to the arrangement of the nozzles. Note that the nozzle buffer (column buffer) 211 is, for example, an SRAM.

Figure 9:
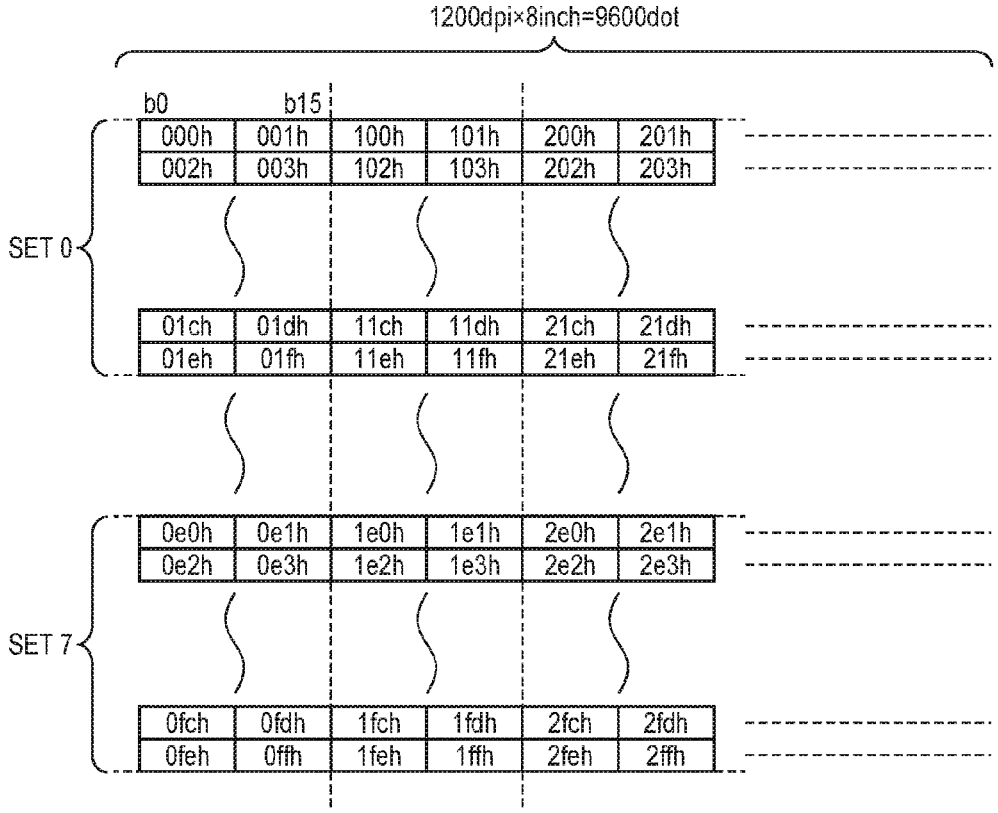
FIG. 9 is a view schematically showing the arrangement of image data in a print buffer 204.

FIG. 9 is a view schematically showing the arrangement of the image data in the print buffer 204.

Storage locations in the print buffer 204 are memory areas of addresses 000 to 0fe corresponding to the 128 print elements in the vertical direction and addresses in the horizontal direction, the number of which corresponds to the product of the resolution and the size of the print medium. Note that each address is based on a hexadecimal representation as indicated by h (hexadecimal) in FIG. 9. In this example, the memory areas can store data for 9,600 dots in a case where the print resolution is 1,200 dpi and the size of the print medium is 8 inches.

Referring to FIG. 9, b0 at address 000 holds print data corresponding to a print element of ink orifice (nozzle) number 0, and b1 next to b0 at address 000 holds print data of nozzle number 0 to be printed in the next column. In this way, as the memory area moves in the horizontal direction, print data to be printed in the next column is held. Similarly, at address 0fe, print data of a print element of ink orifice (nozzle) number 127 is held.

As described above, print data corresponding to a print element of the same ink orifice number (nozzle number) is held at each address of the print buffer 204. In practice, however, the first column is printed based on the print data in b0 at addresses 000 to 0fe, and then the second column is printed based on the print data in b1 at addresses 000 to 0fe.

The H-V conversion circuit 205 H-V-converts the print data stored in the print buffer 204 in the raster direction, and stores the converted print data in the nozzle buffer 211 in the column direction.

Figure 10:
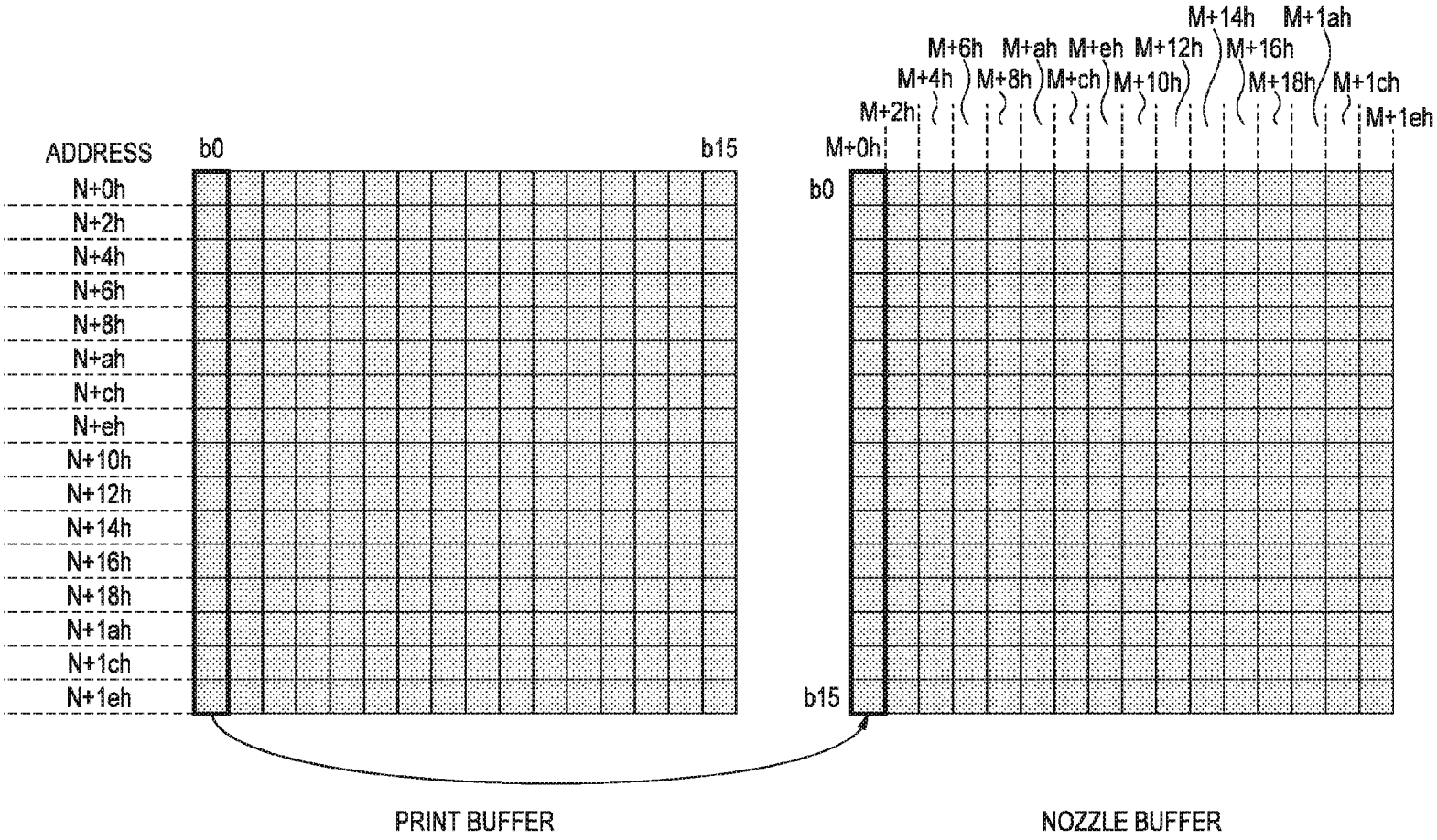
FIG. 10 is a view showing the operation of H-V conversion.

FIG. 10 is a view showing the operation of H-V conversion.

H-V conversion is performed for data of 16 bits×16 bits. Data in b0 at addresses N+0 to N+1E are read out from the print buffer 204, and written at address M+0 in the nozzle buffer 211. Next, data in b1 at addresses N+0 to N+1E are read out from the print buffer 204, and written at address M+2 in the nozzle buffer 211. Processing of performing the similar readout operation and write operation is repeatedly executed 16 times. This completes one operation of H-V conversion (H-V conversion of 16 bits×16 bits). Note that H-V conversion is performed for each nozzle group of time-divisional driving, and sequentially performed for groups 0 to 7.

FIG. 11 is a table showing the internal arrangement of the nozzle buffer 211.

Since H-V conversion is performed during a printing operation, two banks are included, as shown in FIG. 11, so that the write operation in the nozzle buffer 211 and the readout operation from the nozzle buffer 211 become exclusive operations. Each bank includes an area capable of storing print data of 16 columns. When the write operation is performed in bank 0, the readout operation is performed from bank 1. When the write operation is performed in bank 1, the readout operation is performed from bank 0.

Figure 12:
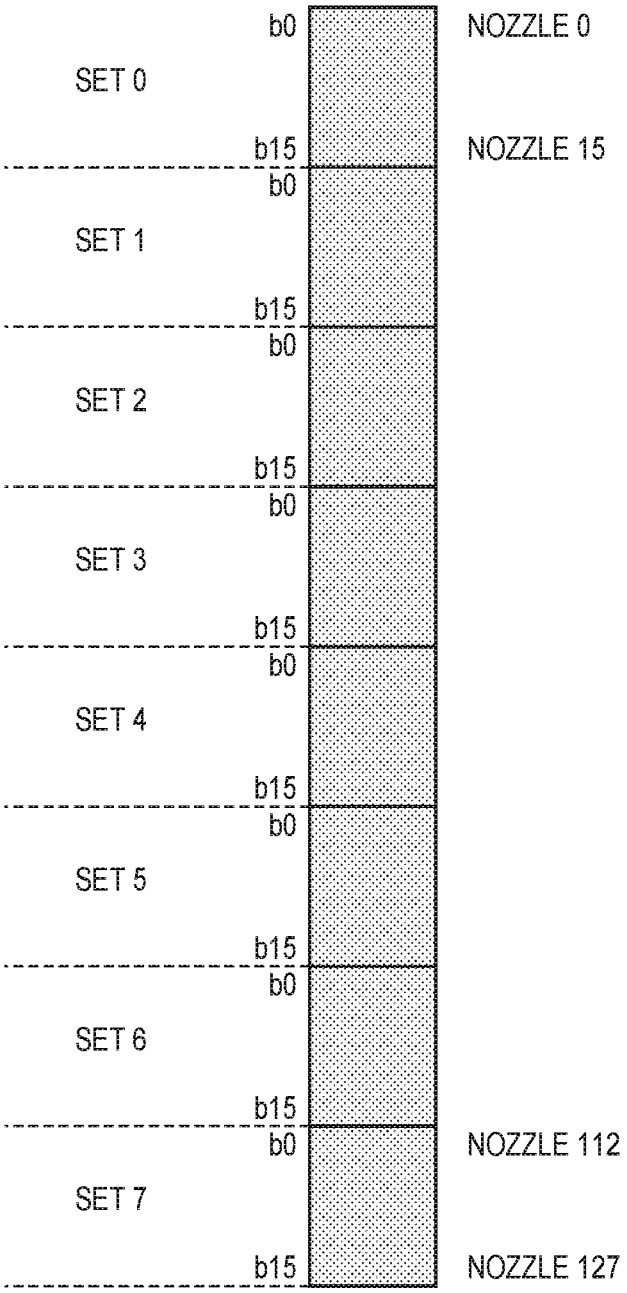
FIG. 12 is a view showing print data held in the nozzle buffer 211.

FIG. 12 is a view showing the print data held in the nozzle buffer 211. As shown in FIG. 12, the print data held in the nozzle buffer 211 are held in correspondence with the 128 print elements (that is, ink orifices (nozzles) 0 to 127).

Figure 13:
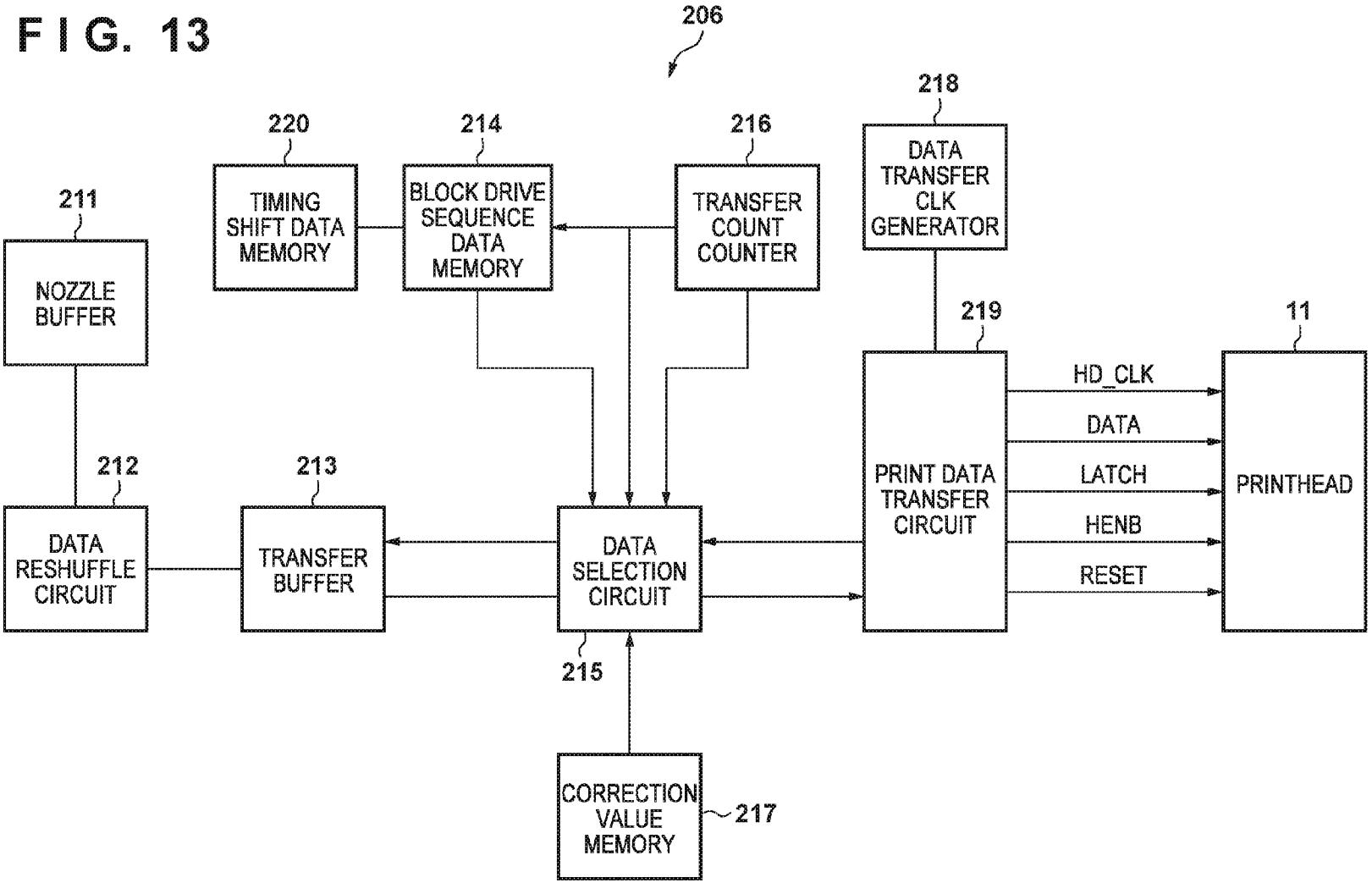
FIG. 13 is a block diagram showing the internal arrangement of an ASIC 206.

An arrangement for sequentially, time-divisionally driving the print elements will be described next with reference to an internal block diagram of FIG. 13 showing the ASIC 206.

A data reshuffle circuit 212 is a circuit for reshuffling the print data. This circuit writes, in a transfer buffer 213, the print data held in the nozzle buffer 211 in correspondence with the 128 print elements in unit of 8-bit print data to be simultaneously printed for each block (driving timing). As data stored in the transfer buffer 213, data corresponding to ink orifices (nozzles) of the same block number are stored at the same address. Note that the transfer buffer 213 is, for example, an SRAM.

FIG. 14 is a table showing the arrangement of the transfer buffer 213.

For example, bank 0 will be described with reference to FIG. 14. Print data of blocks 0 to 15 are sequentially held at addresses Ad0h to Adfh. Block 0 holds the print data in b0 of sets 0 to 7, and block 1 holds the print data in b1 of sets 0 to 7. Similarly, print data are held at addresses Ad10h to Ad1fh forming bank 1, and print data are held at addresses Ad20h to AD2fh forming bank 2. As shown in FIG. 14, a plurality of areas are allocated to the transfer buffer 213 in correspondence with the blocks and the print data are held in correspondence with the blocks.

The transfer buffer 213 has an arrangement formed from three banks each holding print data of 16 blocks, as shown in FIG. 14, so that the write operation and read operation become exclusive operations.

When the write operation is performed in bank 0, the readout operation is performed from banks 1 and 2. When the write operation is performed in bank 1, the readout operation is performed from banks 2 and 0. When the write operation is performed in bank 2, the readout operation is performed from banks 0 and 1.

Note that each bank holds print data corresponding to one column of the print element array, and the transfer buffer 213 holds print data of three columns of the print element array. As described above, the transfer buffer has an arrangement for storing print data of a plurality of columns. At the time of the readout operation, two banks are used to read out print data of two columns of the print element array. That is, a plurality of areas (banks), the number of which is smaller than that of column data areas (banks) each holding print data corresponding to one column of the print element array, are selected from the transfer buffer including the plurality of column data areas, and column data are read out from the selected banks.

Referring back to FIG. 13, a transfer count counter 216 is a counter circuit for counting the number of print timing signals, and is incremented for each print timing signal. The transfer count counter 216 counts from 0 to 15, and then returns to 0. Furthermore, the transfer count counter 216 counts a bank value in the transfer buffer 213, and increments the bank value by +1 when the transfer count counter 216 counts 16 times.

In a block drive sequence data memory 214, a sequence when sequentially driving the print elements of 16 divided block numbers 0 to 15 is recorded at addresses 0 to 15. A timing shift data memory 220 stores amounts by which the print timings of nozzle groups 0 to 15 are shifted.

A print data transfer circuit 219 increments the transfer count counter 216 using, as a trigger, a print timing signal generated based on, for example, an optical linear encoder. A data selection circuit 215 reads out, from the transfer buffer 213, the value in the block drive sequence data memory 214 and the print data corresponding to the counted bank value of the transfer count counter 216 in response to the print timing signal. Print data corrected in accordance with a correction amount held in a correction value memory 217 is transferred to the printhead 11 in synchronism with a data transfer CLK signal (HD_CLK) generated by a data transfer CLK generator 218.

FIG. 15 is a table showing an example of block drive sequence data written at addresses 0 to 15 in the block drive sequence data memory 214.

Referring to FIG. 15, block data indicating blocks 0 and 5 are stored at addresses 0 and 1 in the block drive sequence data memory 214, respectively. Similarly, block data indicating corresponding blocks are sequentially stored at addresses 2 to 15.

FIG. 16 is a table showing an example in which data for shifting the print timings of nozzle groups 0 to 15 stored in the timing shift data memory 220 are stored. Note that FIG. 16 shows data in the memory, and thus the data are represented in binary. A different numerical value is set as the data depending on the printhead slant. FIG. 16 shows an example in which numerical values of 0, −1, and −15 are respectively set for nozzle groups 0, 1, and 15 in the binary format.

FIG. 17 is a table showing the relationship between each nozzle group, ink orifice numbers (nozzle numbers), and a correction value after measurement of a printhead slant amount. Note that FIG. 17 shows each correction value by a decimal number with a minus (−) sign to represent a correction value after measurement of a printhead slant amount.

The data selection circuit 215 reads out block data 0000 (in this example, a numerical value indicating block 0) as a block enable signal from address 0 in the block drive sequence data memory 214 using the print timing signal as a trigger. Note that if the timing shift value for each nozzle group stored in the timing shift data memory 220 is not equal to 0, the readout address in the block drive sequence data memory 214 is shifted by the value. For example, as for nozzle group 1, the timing shift value (correction value) is −1, and the readout address in the block drive sequence data memory 214 is shifted to read out block data 0111 at address 15. Subsequently, corresponding print data is read out from the transfer buffer 213, and transferred to the printhead 11.

Similarly, in response to the next print timing signal, block data 0101 (in this example, a numerical value indicating block 5) is read out as a block enable signal from address 1 in the block drive sequence data memory 214. Print data corresponding to block data 0011 is read out from the transfer buffer 213, and transferred to the printhead 11.

Similarly, using the next print timing signal as a trigger, block data are sequentially read out from addresses 2 to 15 in the block drive sequence data memory 214. Print data corresponding to each block data is read out from the transfer buffer 213, and transferred to the printhead 11.

As describe above, the print data transfer circuit 219 reads out the block data set at addresses 0 to 15 in the block drive sequence data memory 214. The print data corresponding to each block data is read out from the transfer buffer 213, and transferred to the printhead 11, thereby executing printing for one column. That is, when the print timing signal is output 16 times, the block data of one column are read from the transfer buffer 213.

Figure 18:
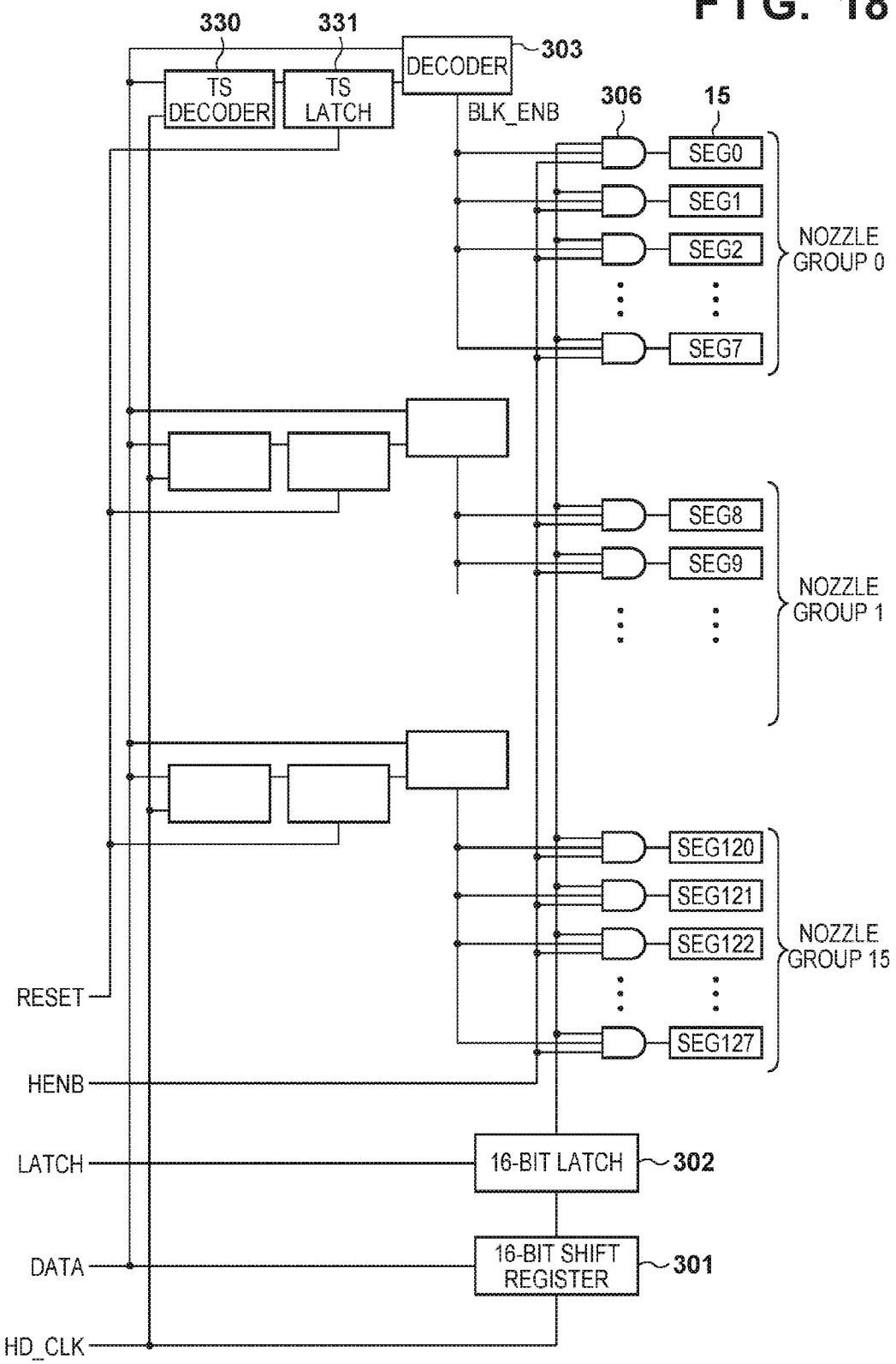
FIG. 18 is a circuit diagram showing the arrangement of a drive circuit provided in a printhead 11.

FIG. 18 is a circuit diagram showing the arrangement of a drive circuit provided in the printhead 11.

The drive circuit divides 128 print elements 15 into 16 adjacent nozzle groups adjacent to each other, and time-divisionally drives the eight print elements assigned to each nozzle group. Therefore, the 16 print elements assigned to the same block of time-divisional driving are driven at the same timing. A data signal, a driving signal, and the like to this drive circuit are sent from the print data transfer circuit 219 shown in FIG. 13.

A print data signal (DATA) is serially transferred to the printhead 11 in accordance with a clock signal (HD_CLK). The print data signal (DATA) is received by a 16-bit shift register 301, and then latched by a 16-bit latch 302 at the leading edge of a latch signal (LATCH) and inputted to an AND circuit 306.

An amount by which the print timings are changed for each nozzle group on a division heat timing basis is contained in the print data signal (DATA), decoded by a TS decoder 330, and held in a TS latch 331. Note that the latch timing of the TS latch 331 is based on input of a TS reset signal (RESET).

A block signal serving as the basis of time-divisional driving is contained in the print data signal (DATA), and decoded by a decoder 303. Furthermore, a block enable signal (BLK_ENB) is generated by shifting the driving timings in accordance with the numerical value held in the TS latch 331, and inputted to the AND circuit 306, thereby selecting the print elements 15 to be driven.

Only the print elements 15 designated by both the block enable signal (BLK_ENB) and the print data signal (DATA) are driven by a heater driving pulse signal (HENB), which is inputted to the AND circuit 306 to discharge ink droplets, thereby executing printing.

A difference in driving timing of the block enable signal (BLK_ENB) between a case in which no correction of the printhead slant is performed and a case in which correction of the printhead slant is performed will now be described.

Figure 19A:
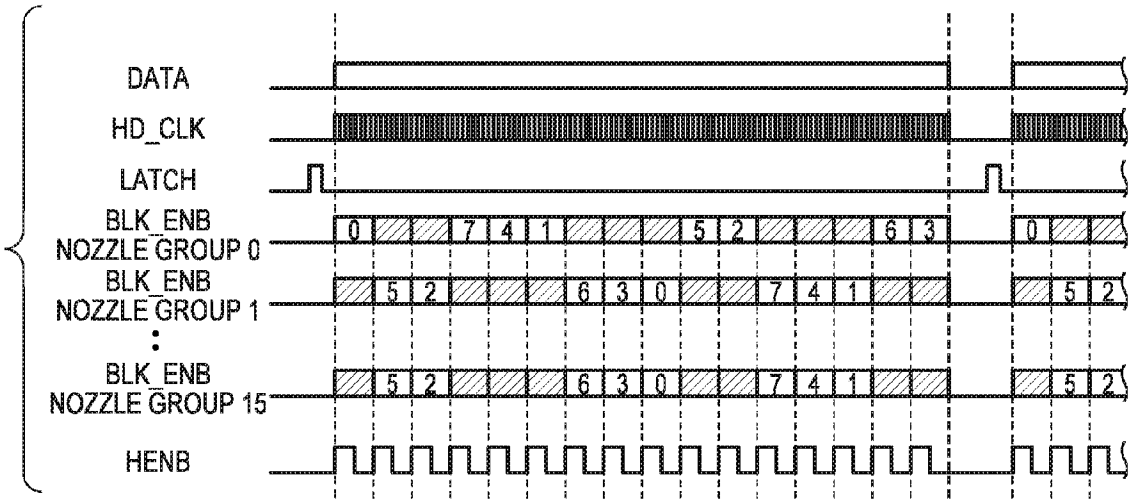
FIG. 19A is a timing chart showing an example of the driving timing of a block enable signal (BLK_ENB) when no correction of the printhead slant is performed.
Figure 19B:
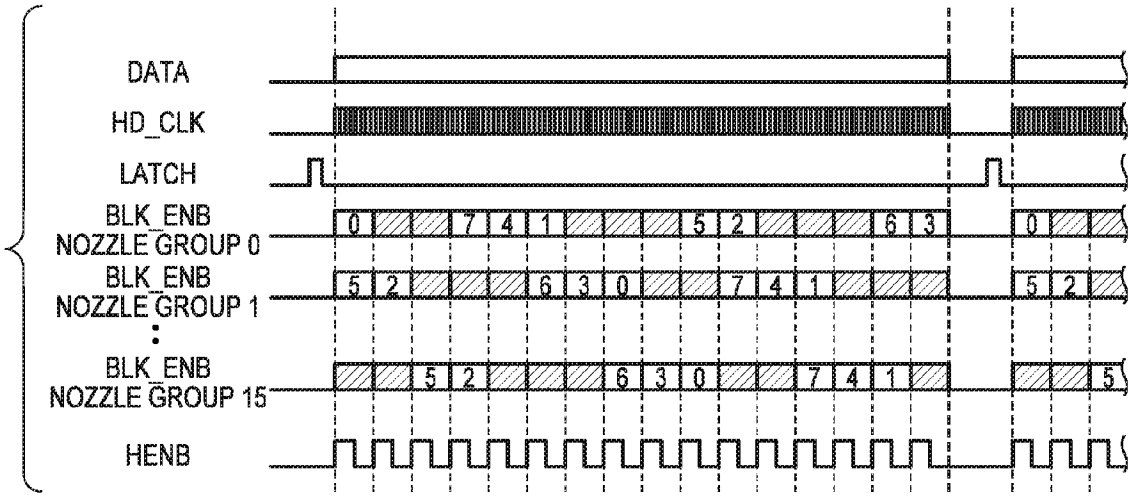
FIG. 19B is a timing chart showing an example of the driving timing of the block enable signal (BLK_ENB) when correction of the printhead slant is performed.

FIGS. 19A and 19B are timing charts respectively showing an example of the driving timing of the block enable signal (BLK_ENB) in a case where no correction of the printhead slant is performed and an example of the driving timing of the block enable signal (BLK_ENB) in a case where correction of the printhead slant is performed.

FIG. 19A shows an example of the driving timing of the block enable signal (BLK_ENB) in a case where no correction of the printhead slant is performed, and FIG. 19B shows an example of the driving timing of the block enable signal (BLK_ENB) in a case where correction of the printhead slant is performed.

FIG. 19A shows an example of a numerical value selected by the block enable signal (BLK_ENB) expanded by the decoder 303 for each nozzle group. In nozzle group 0, SEG0 of the print element 15 is selected in a case where the block enable signal (BLK_ENB) is "0", and SEG1 of the print element 15 is selected in a case where the block enable signal is "1". In nozzle group 1, SEG8 of the print element 15 is selected in a case where the block enable signal is "0", and SEG9 of the print element 15 is selected in a case where the block enable signal is "1". Note that in FIG. 19A, a shaded box indicates a timing at which the print element 15 is not used to print an image.

The driving timings, shown in FIG. 19A, of the print elements when no correction of the printhead slant is performed correspond to the state shown in FIG. 6B. In this state, as shown in FIG. 6B, block selection of nozzle group 0 and that of nozzle group 1 are complementary, and thus the block enable signals (BLK_ENB) shown in FIG. 19A are also complementary.

FIG. 19B is a timing chart showing an example of the driving timing of the block enable signal (BLK_ENB) in a case where correction of the printhead slant corresponding to the driving timings shown in FIG. 7B is performed.

In the example shown in FIG. 19B, the driving timings of the print elements of nozzle group 1 are advanced from the state of the driving timings shown in FIG. 19A by one division timing. This setting is indicated by the setting value of nozzle group 1 in the TS latch 331. This causes the decoder 303 to operate to shift the division timings, by the setting value, from the block drive sequence data stored in the block drive sequence data memory 214. In this way, it is possible to set, for each nozzle group, the driving timings of the print elements on a division timing basis.

Furthermore, in one-way printing and forward scan printing at the time of two-way printing, the block enable signal (BLK_ENB) indicating the driving timings has the value of a drive sequence of blocks 0→1→2→ . . . →15 for the printhead 11.

<Overview of Correction of Shift by Slant>

An overview of correction of a shift by a slant, which is executed by the inkjet printing apparatus having the above-described arrangement, will be explained. This inkjet printing apparatus has as its feature to correct a shift of dots by a slant. Therefore, although any method may be used to detect information (slant information) about a shift by a slant, an example in which information about a shift by a slant is acquired using an optical sensor will be described here.

Figure 20:
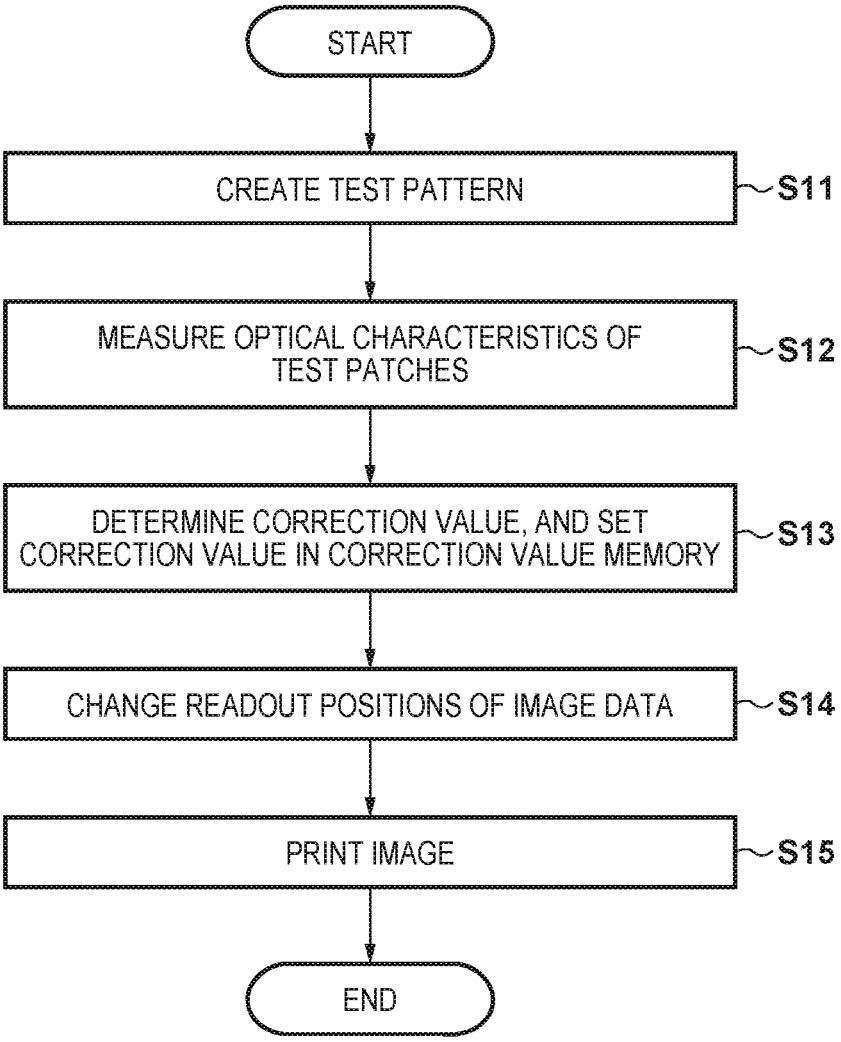
FIG. 20 is a flowchart illustrating an overview of detection of the shift value of a dot by a slant.

FIG. 20 is a flowchart illustrating an overview of detection of the shift value of dots by a slant.

In step S11, test pattern printing is executed. A test pattern is created by printing a plurality of test patches on the print medium using different discharge timings. In this example, since an optical sensor is used, it is possible to acquire information about a shift by a slant using the difference between the optical characteristics of the respective test patches.

In step S12, the optical characteristics of the respective test patches are measured using the optical sensor to detect information about a shift by a slant. In this example, the reflection optical densities of the test patches are measured as measurement of the optical characteristics to detect information about a shift by a slant. In step S13, correction information is determined based on the detected information about the shift by the slant, and set in the correction value memory 217.

Furthermore, in step S14, the readout positions of print data are changed based on the correction information set in the correction value memory 217. In step S15, an image is printed in the print medium.

Creation of the test pattern in step S11 and detection of the information about the shift by the slant by measurement of optical characteristics in step S12 will be described next. In this example, as the information about the shift by the slant, the shift amount in the main scanning direction of dots formed by the three ink orifices 13 on each of the upstream side and downstream side with respect to the sub-scanning direction as the two ends of the ink orifice array 141 is detected.

Figure 21A:
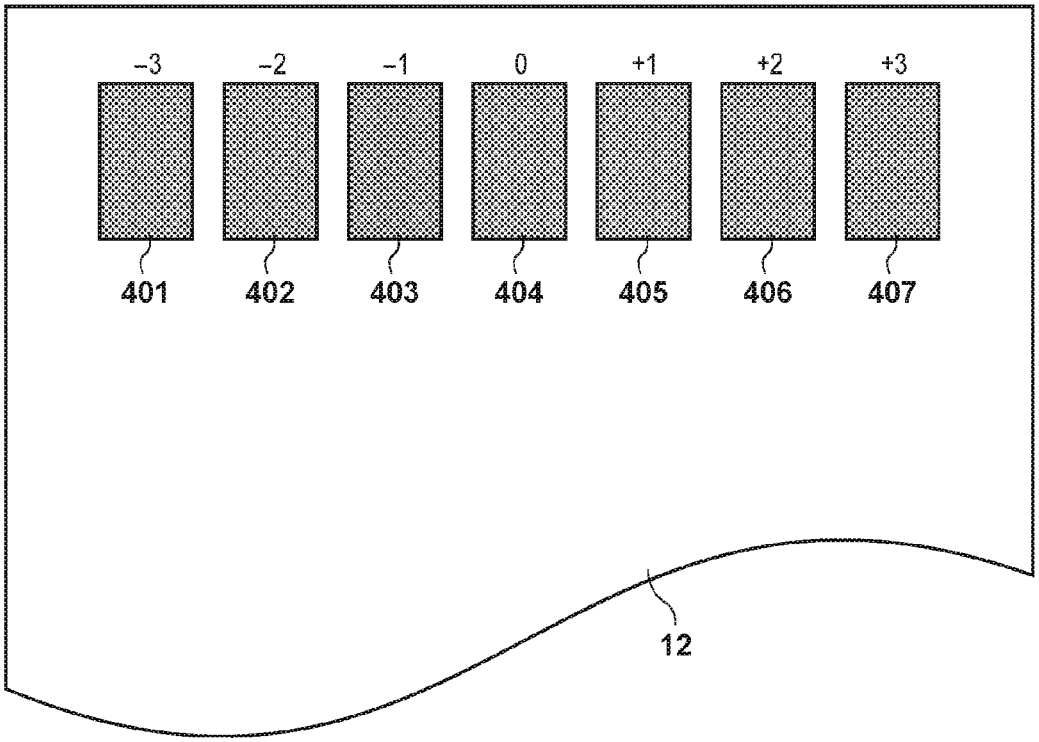
FIG. 21A is a view showing an example of a test pattern formed on a print medium 12 in step S11.
Figure 21B:
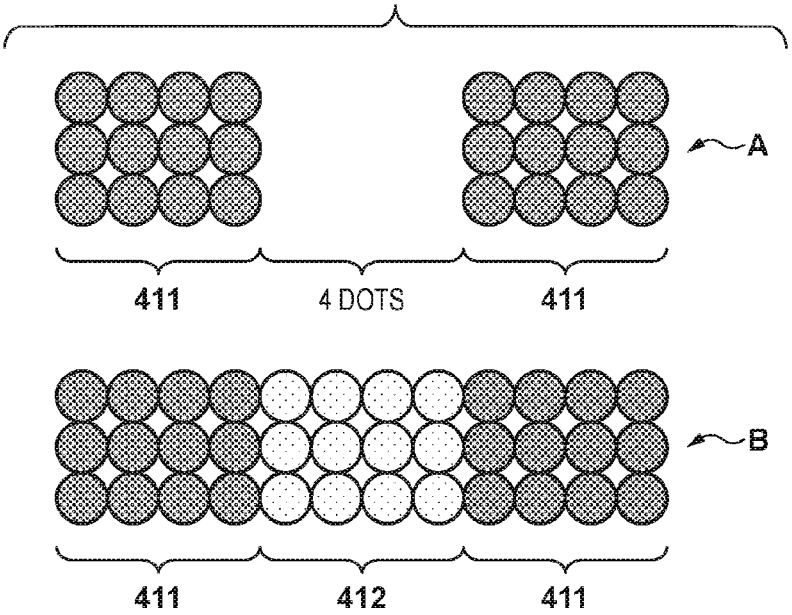
FIG. 21B is a view showing a dot arrangement included in a printed test patch.

FIG. 21A is a view showing an example of the test pattern formed on the print medium 12 in step S11. FIG. 21B is a view showing a dot arrangement included in a printed test patch.

As shown in FIG. 21A, the test pattern includes seven test patches 401 to 407. Each test patch is formed as follows.

In the first printing scan by the printhead 11, using the three ink orifices 13 on the upstream side with respect to the sub-scanning direction, two images 411 each including 3 dots in the sub-scanning direction and 4 dots in the main scanning direction are printed at an interval of 4 dots in the main scanning direction (A of FIG. 21B).

Next, the print medium 12 is conveyed, and in the second printing scan, an image 412 is printed using the three ink orifices on the downstream side in a blank region of 3 dots in the sub-scanning direction and 4 dots in the main scanning direction which has been created in the first printing scan. Note that if printing is executed in different scanning directions in the first and second scans at the time of creation of test patches, a shift may occur in dot forming position due to the difference in scanning direction. It is thus desirable to execute printing in the same direction in the first and second scans. In this example, in the first and second scans, the printhead scans from left to right in FIG. 21A, thereby executing printing (one-way printing).

The reference test patch 404 among the seven test patches shown in FIG. 21A is printed in the second printing scan so as to fill the blank region created in the first printing scan (B of FIG. 21B). On the other hand, with respect to the test patches 405, 406, and 407, images are printed in the second printing scan by delaying the driving timings of the ink orifices 13 on the downstream side. That is, images printed by the ink orifices on the downstream side are respectively created to shift by ½, 1, and 3/2 pixels in the right direction of the main scanning direction in FIG. 21A from the blank region created in the first printing scan. With respect to the test patches 403, 402, and 401, images are printed in the second printing scan by advancing the driving timings of the ink orifices 13 on the downstream side. That is, images printed by the ink orifices 13 on the downstream side are respectively created to shift by ½, 1, and 3/2 pixels in the left direction of the main scanning direction in FIG. 21A from the blank region created in the first printing scan.

Figure 22A:
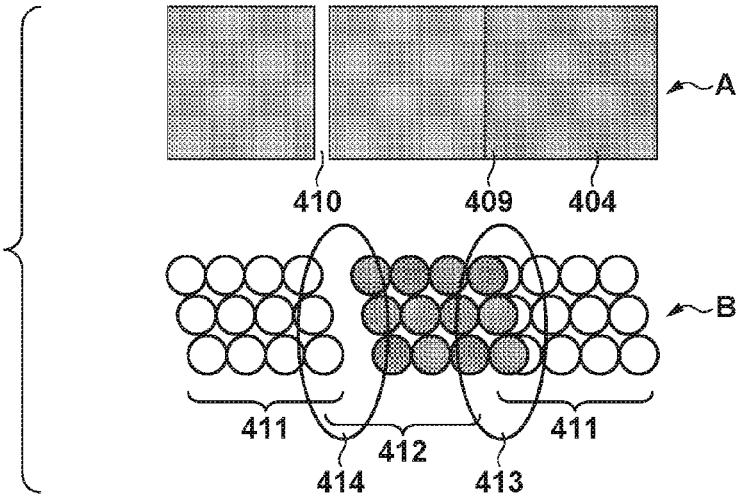
FIG. 22A is a view showing an image of the test patch when a shift by a slant occurs, and a dot arrangement at this time.
Figure 22B:
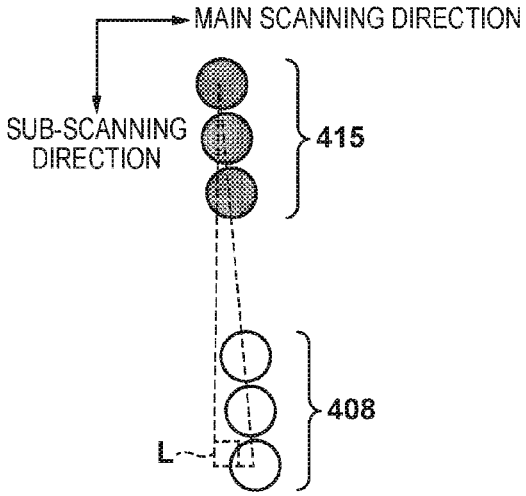
FIG. 22B is a view showing a shift in the main scanning direction when the shift by the slant occurs.
Figure 22C:
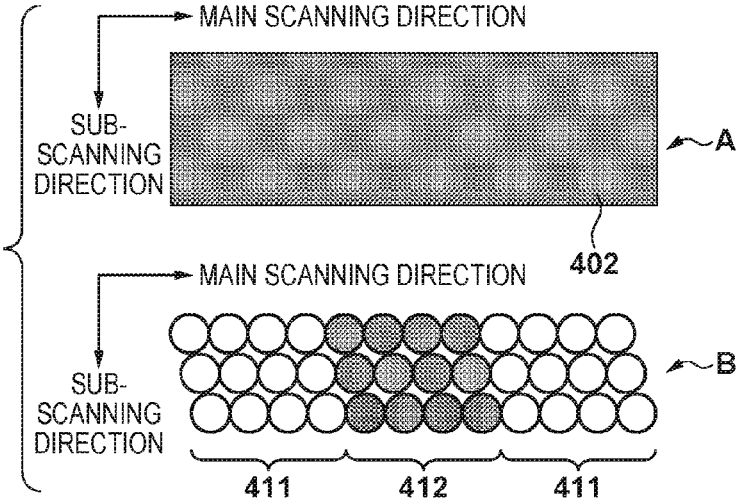
FIG. 22C is a view showing an image with a uniform print density in which neither a black stripe nor a white stripe is occurred when there is the shift by the slant.

FIG. 22A is a view showing the image of the test patch in a case where a shift by a slant occurs, and a dot arrangement at this time. FIG. 22B is a view showing a shift in the main scanning direction in a case where the shift by the slant occurs. FIG. 22C is a view showing an image with a uniform print density in which neither a black stripe nor a white stripe is generated in a case where the shift by the slant occurs. A of FIG. 22A shows the image of the printed test patch, and B of FIG. 22A shows the dot arrangement.

As is apparent from A of FIG. 22A, if the shift by the slant occurs, a black stripe 409 and a white stripe 410 are generated in the test patch 404. As shown in B of FIG. 22A, a portion 413 with dots overlapping each other and a portion 414 without any dots are generated in correspondence with the black stripe 409 and the white stripe 410, respectively. In a case where the shift by the slant occurs, a shift L occurs in dots 415 on the upstream side of the sub-scanning direction and dots 408 on the downstream side of the sub-scanning direction with respect to the main scanning direction, as shown in FIG. 22B.

In the test patch 404, an image is printed using the ink orifices 13 on the downstream side in the second printing scan so as to fill the blank region created in the first printing scan. Consequently, as shown in B of FIG. 22A, the overlapping portion 413 and the blank portion 414 are generated between the images 411 printed by the first printing scan and the image 412 printed by the second printing scan. As a result, the test patch undesirably includes the black stripe 409 and the white stripe 410, as shown in A of FIG. 22A. As described above, if the shift by the slant occurs, the black stripe and white stripe are generated in the reference test patch 404.

Detection of the slant amount (the shift amount in the main scanning direction with respect to the upstream-side dots and the downstream-side dots) will be described. The following description assumes that the test patch 402 of the seven test patches is an image with a uniform print density in which neither a black stripe nor a white stripe is generated, as shown in FIG. 22C. Note that A of FIG. 22C shows the test patch 402 representing the image with the uniform print density, and B of FIG. 22C shows details of the dot arrangement of the test patch.

In printing the test patch 402, the image 412 is printed by the second printing scan to shift by one pixel in the left direction of the main scanning direction in FIG. 22C from the blank region created in the first printing scan by advancing the driving timings of the print elements of the ink orifices 13 on the downstream side.

Therefore, if no shift by a slant occurs, it is expected that the upstream-side dots 415 and the downstream-side dots 408 overlap on the left side of the blank region to generate a black stripe, and a white stripe in which neither upstream-side dots 415 nor downstream-side dots 408 exist appears on the right side. Since, however, the shift by the slant occurs, the shift L in the main scanning direction occurs between the upstream-side dots 415 and the downstream-side dots 408, as shown in FIG. 22B. This shift L cancels the positional shift of the dots which is generated by advancing the driving timings of the ink orifices 13 on the downstream side, thereby generating the test patch with the uniform print density. Thus, the shift L in the main scanning direction between the upstream-side dots 415 and the downstream-side dots 408 is L=1 pixel, and it is possible to detect that the shift by the slant in the counter-clockwise direction including the shift in the main scanning direction has occurred.

As described above, the dot shift amount in the main scanning direction as the information about the shift by the slant can be detected by selecting the image with the uniform print density from the test patches formed by delaying or advancing the driving timings of the ink orifices on the downstream side.

Note that in step S12, the read reflection optical densities of the seven test patches are measured using the optical sensor. It is possible to detect the test patch with the uniform dot arrangement without any black stripe or white stripe by selecting the test patch for which a high output value of the reflection optical density can be obtained in optical measurement using the optical sensor.

For the sake of simplicity, the above arrangement for creation of the test patterns and detection of the information about the shift by the slant has been explained. In other words, in the above description, the test patch with the most uniform dot arrangement is simply selected using the optical sensor, and the information about the shift by the slant is detected based on the shift amount in the main scanning direction between the upstream-side dots and the downstream dots when forming the test patch.

However, the present invention is not limited to this arrangement. For example, the following arrangement may be adopted. That is, the optical characteristic of each patch is measured to select a test patch having the highest reflection optical density and a test patch having the second highest reflection optical density, and the reflection optical density difference between the two test patches is calculated. Then, if the reflection optical density difference is equal to or larger than a predetermined value, the shift amount of the test patch having the highest reflection optical density is adopted intact as the information about the shift by the slant. If the reflection optical density difference is smaller than the predetermined value, the average of the shift amounts of the test patch having the highest reflection optical density and the test patch having the second highest reflection optical density is adopted. Furthermore, an approximate line or approximate curve may be obtained based on the data of the optical characteristics of the respective test patches by linear approximation or polynomial approximation on each of the left and right sides of the test patch having the highest reflection optical density, and the information about the shift by the slant may be detected from the intersection point of the two left and right lines or curves.

Note that a correction method will be described below by assuming that the test patch 402 whose discharge timing is "−2" from the reference test patch has been detected as the most uniform image.

In step S13, correction information for correcting the shift by the slant in accordance with the shift amount of the dot arrangement in the main scanning direction which has been detected by measurement of the optical characteristics in step S12 is set in the correction value memory 217. In this example, information for associating, with each of sets 0 to 7, the number (correction value) of print elements for which the readout positions of the print data are changed is used as the correction information.

This correction information is set in a table format in the correction value memory 217, as shown in FIG. 17. In accordance with the correction information in a case where the shift of "−2", that is, L=1 by the slant occurs in the above-described arrangement, a correction value of 0 is set for nozzle group 0 as a reference and a correction value of −1 is set for nozzle group 1. Similarly, a correction value of −2 is set for nozzle group 2, a correction value of −3 is set for nozzle group 3, and a correction value of −15 is set for nozzle group 15.

Note that as a correction information determination method, that is, a method of determining a correction value for each nozzle group, there is provided a method of holding in advance a plurality of pieces of table information corresponding to the information about the shift by the slant. Furthermore, a correction value for reference nozzle group 0 may be set to 0, a correction value for nozzle group 15 may be determined based on the information about the shift by the slant, and a correction value for a set positioned in the middle may be determined by simple calculation.

FIG. 23 shows an example of the printhead with ink orifice numbers (nozzle numbers) 0 to 127, that is, the printhead including the 128 nozzles (ink orifices). This example shows a correction example when a slant of L=1 pixel occurs in the printhead including the 128 nozzles (ink orifices).

In step S14, the readout positions of the print data are changed based on the correction information set in the correction value memory 217, as described above. In step S15, an image is printed on the print medium based on the print data whose readout positions have been changed.

FIG. 23 is a table showing a nozzle number (ink orifice number: ND) assigned to each of the print elements of nozzle groups 0 to 15, a selection block (SB), a timing shift amount (TS) for each nozzle group (NG), print data (DATA), a data shift amount (DS), and a dot arrangement in a case where the slant of the printhead is −1.

Referring to FIG. 23, the print data indicate readout timings of the print data of the first to third columns assigned to the respective print elements, and the dot arrangement schematically represents a dot arrangement formed on the print medium in a case where printing is executed according to the timings without any shift by a slant. In a case where the readout positions of the print data are changed, if no shift by a slant occurs, the dot arrangement shown in FIG. 23 is obtained. However, as will be described later, due to the shift by the slant, each dot fits in a column in which the dot should be originally arranged.

FIG. 24 is a table showing a driving timing shift amount (timing shift: TS) and a data readout position change (data shift: DS) for each nozzle group (NG) with respect to a head slant (SLANT) of +3 to −3 of the printhead including the print elements of nozzle groups 0 to 15.

The timing shift value for each nozzle group is stored in the timing shift data memory 220 shown in FIG. 13. The timing shift value is transferred to the printhead 11 by the print data signal (DATA) shown in FIGS. 18 to 19B, decoded by the TS decoder 330, and held in the TS latch 331.

First Embodiment

As shown in FIGS. 7A to 7C already described, if the printhead slant is corrected, the maximum concurrent discharge number changes at each driving timing of time-divisional driving. To cope with this, in this embodiment, a printhead driving method for making the maximum concurrent drive number constant at each driving timing even if the printhead slant is corrected will be described.

Figures 25A, 25B, 25C:
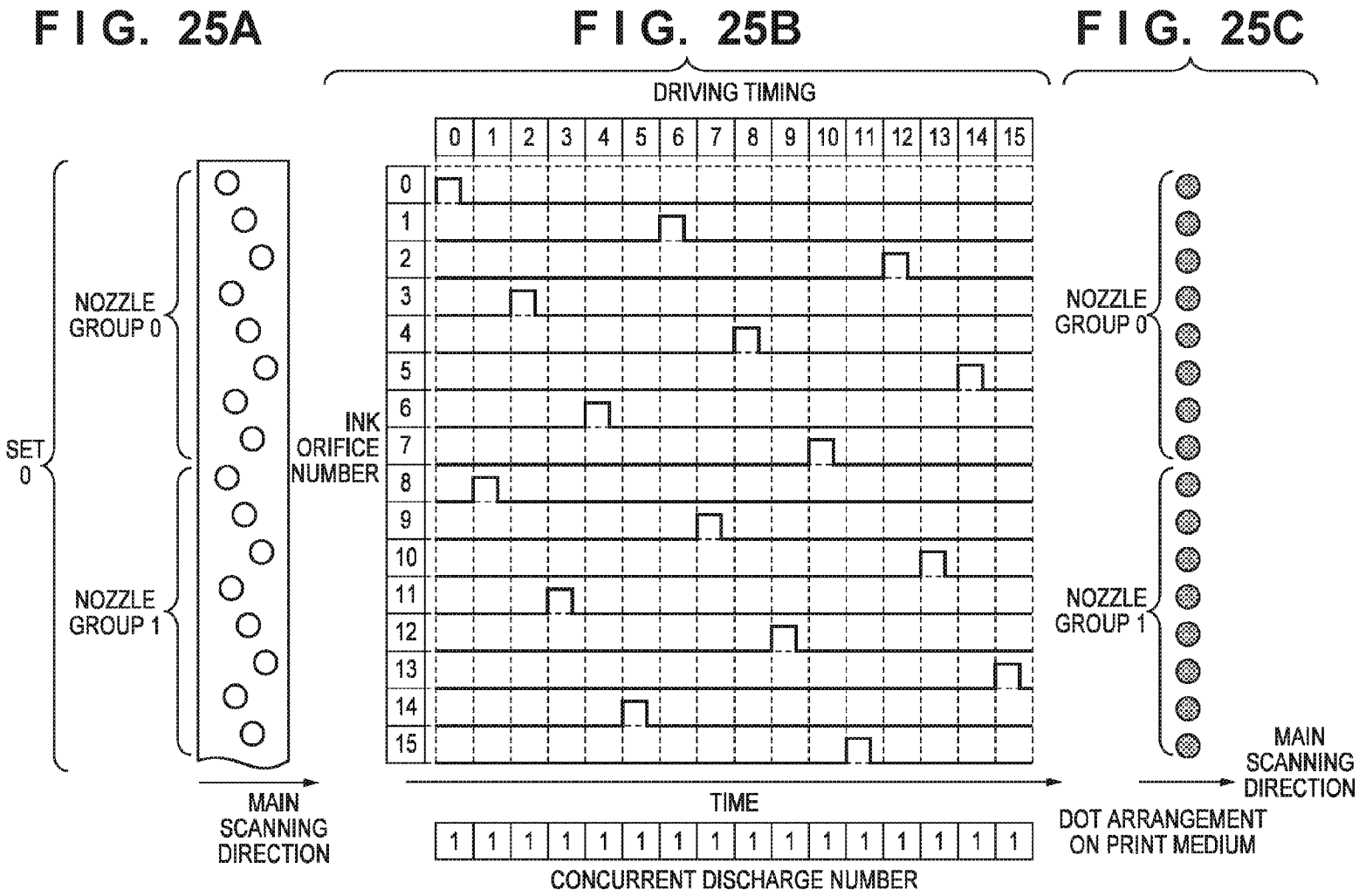
FIGS. 25A, 25B, and 25C are schematic views for explaining a printhead driving method according to the first embodiment.

FIGS. 25A to 25C are schematic views for explaining a printhead driving method according to the first embodiment. Note that in FIGS. 25A to 25C, a description of the same arrangement already described with reference to FIGS. 4A to 4C will be omitted, and only an arrangement unique to this embodiment will be explained.

As the arrangement example described above, in a printhead 11 including 128 ink orifices, eight adjacent orifices are set as a unit to form a nozzle group, and the driving timings are shifted in accordance with a printhead slant. A pattern different from that described above or that shown in FIG. 4B is used as a time-divisional driving pattern. That is, as will be apparent by comparing FIGS. 4A and 25A, the arrangement of the ink orifices of the printhead 11 is the same but the pattern of the driving timings of time-divisional driving is different from that shown in FIG. 4B, as shown in FIG. 25B.

In this embodiment, the driving timing for each nozzle (ink orifice) is shifted during a driving period assigned to each nozzle group in order to make the maximum concurrent drive number constant at each driving timing of time-divisional driving.

Figure 26A:
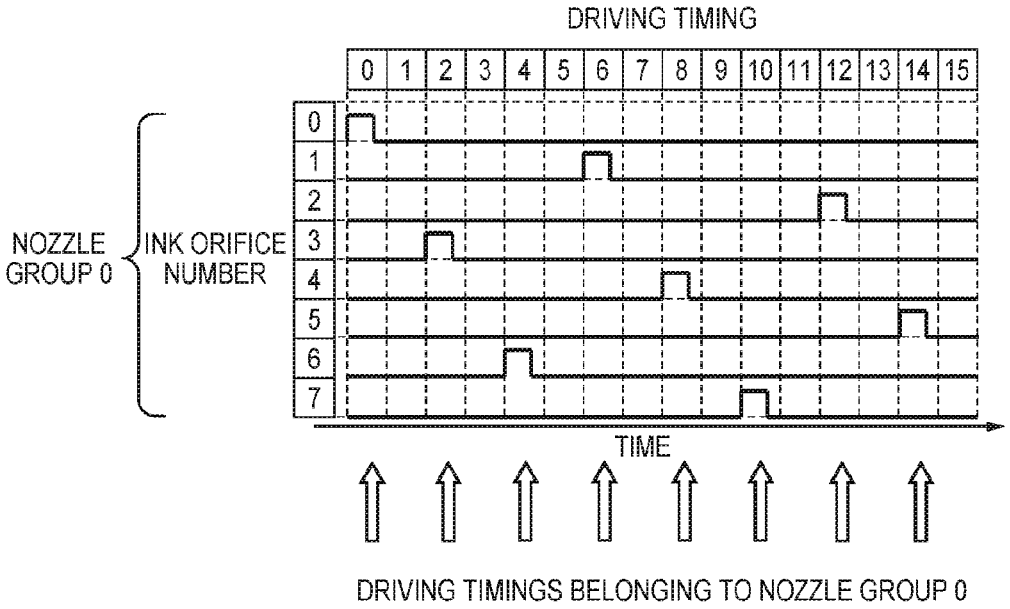
FIGS. 26A and 26B are schematic timing charts each for explaining driving timings assigned or belonging to a nozzle group.
Figure 26B:
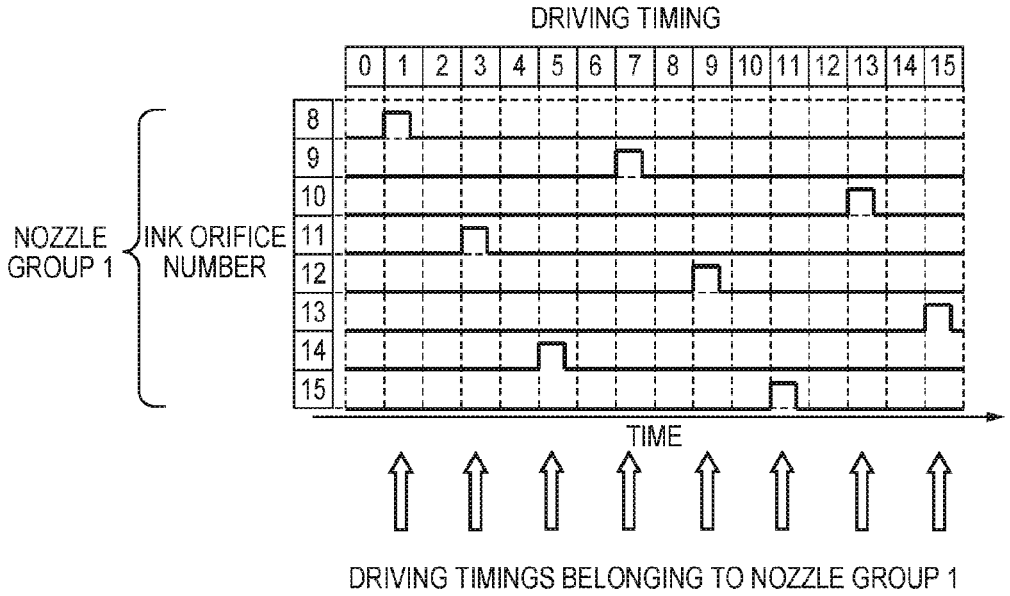

FIGS. 26A and 26B are schematic timing charts each for explaining driving timings assigned or belonging to a nozzle group. FIG. 26A shows, by up arrows, driving timings assigned to nozzle group 0, and FIG. 26B shows, by up arrows, driving timings assigned to nozzle group 1.

As is apparent from FIGS. 26A and 26B, even if the driving timing is shifted for each ink orifice, the maximum concurrent discharge number of the printhead remains unchanged by shifting the driving timing such that the driving timings of the print elements belonging to each nozzle group remain unchanged. In this embodiment, since the driving timings belonging to each nozzle group are alternate driving timings of the 16 driving timings obtained by dividing the print resolution (one column) in the main scanning direction, the driving timing is shifted for every two driving timings. Even if the printhead slant is corrected with this operation, the driving timings belonging to the nozzle group remain unchanged, and the maximum concurrent drive number of the whole printhead remains unchanged.

FIGS. 27A to 28C are schematic views showing examples in which the driving timings are shifted, as described above. In FIGS. 27A to 28C, a description of the same arrangement as that already described with reference to FIGS. 4A to 4C will be omitted, and only an arrangement unique to this embodiment will be explained.

Figures 27A, 27B, 27C:
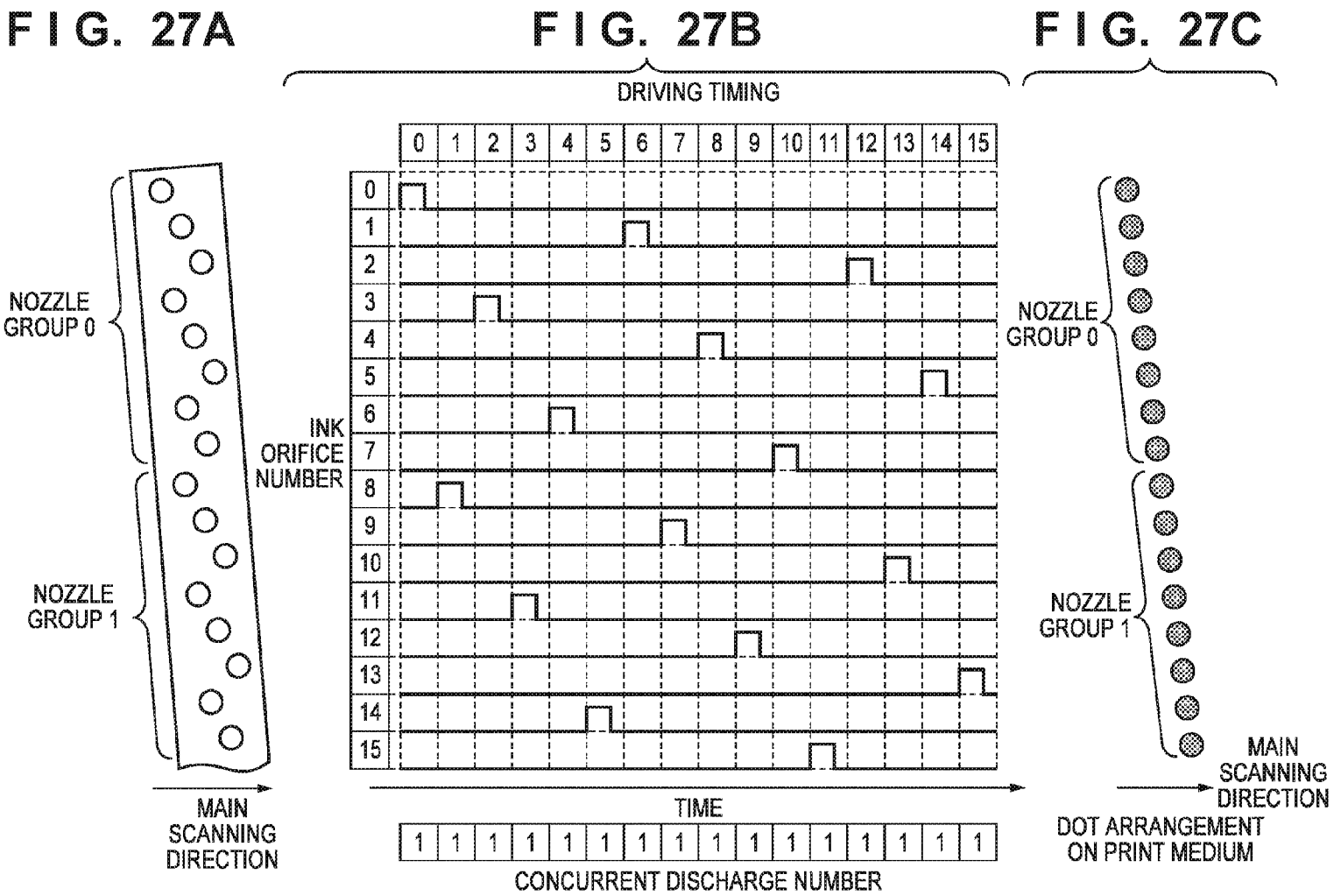
FIGS. 27A, 27B, and 27C are schematic views showing an example in which the driving timings are shifted.
Figures 28A, 28B, 28C:
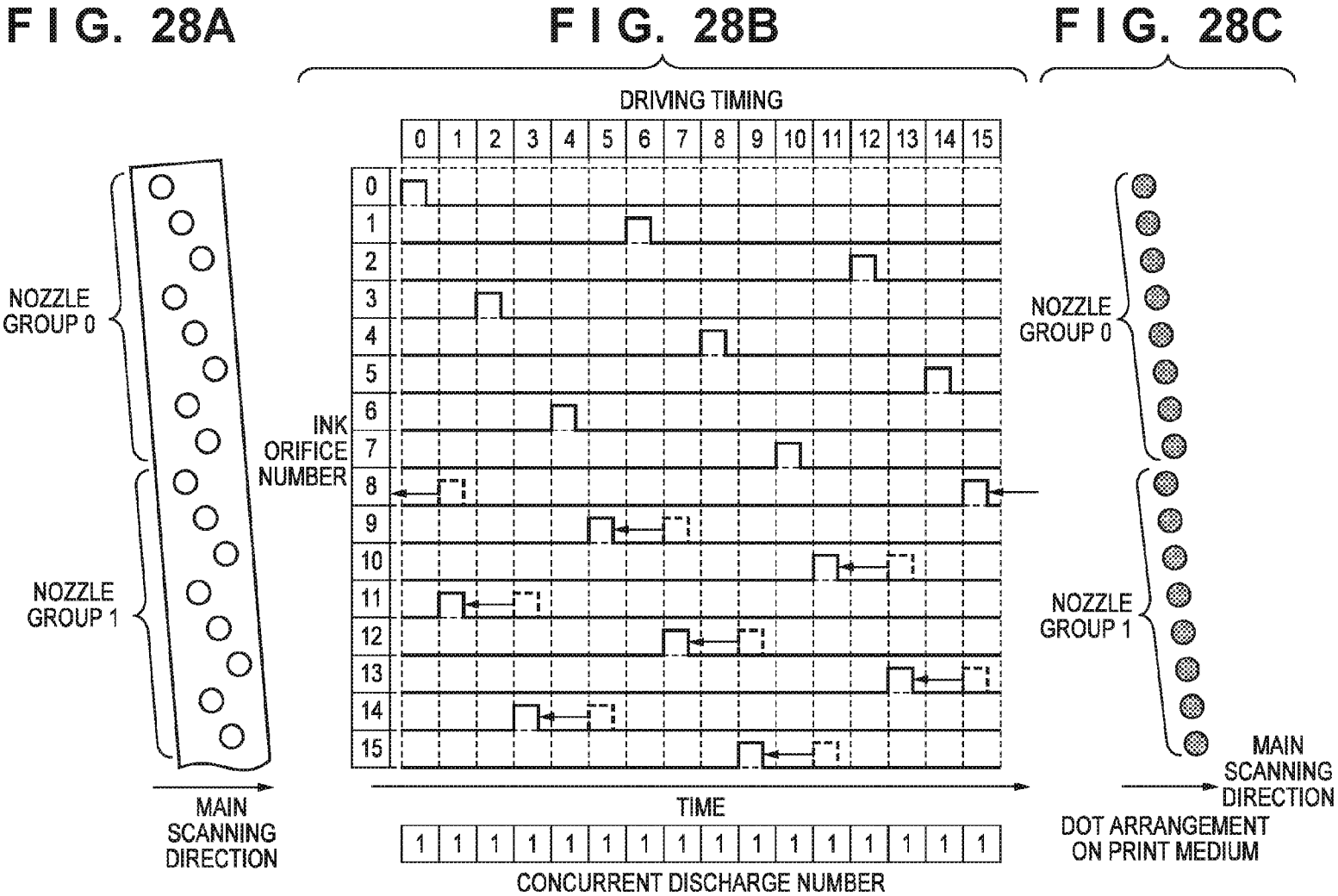
FIGS. 28A, 28B, and 28C are schematic views showing an example in which the driving timings are shifted.

FIGS. 27A to 27C show a state before the printhead slant is corrected. As shown in the lower portion of FIG. 27B, the counts (concurrent discharge numbers) of the respective driving timings are all "1"s. To the contrary, FIG. 28B shows, by solid lines, a state after the printhead slant is corrected in which the driving timings of nozzle group 1 are shifted forward by two timings. FIG. 28B shows the state before correction (the state shown in FIG. 27B) by dotted lines. As is apparent from FIG. 28B, the driving timings of the print elements belonging to nozzle group 0 after correction of the printhead slant remain unchanged from those before correction of the printhead slant, and the maximum concurrent drive numbers of nozzle groups 0 and 1 remain unchanged. Similarly, the maximum concurrent drive number of the whole printhead also remains unchanged.

Figures 29A, 29B, 29C:
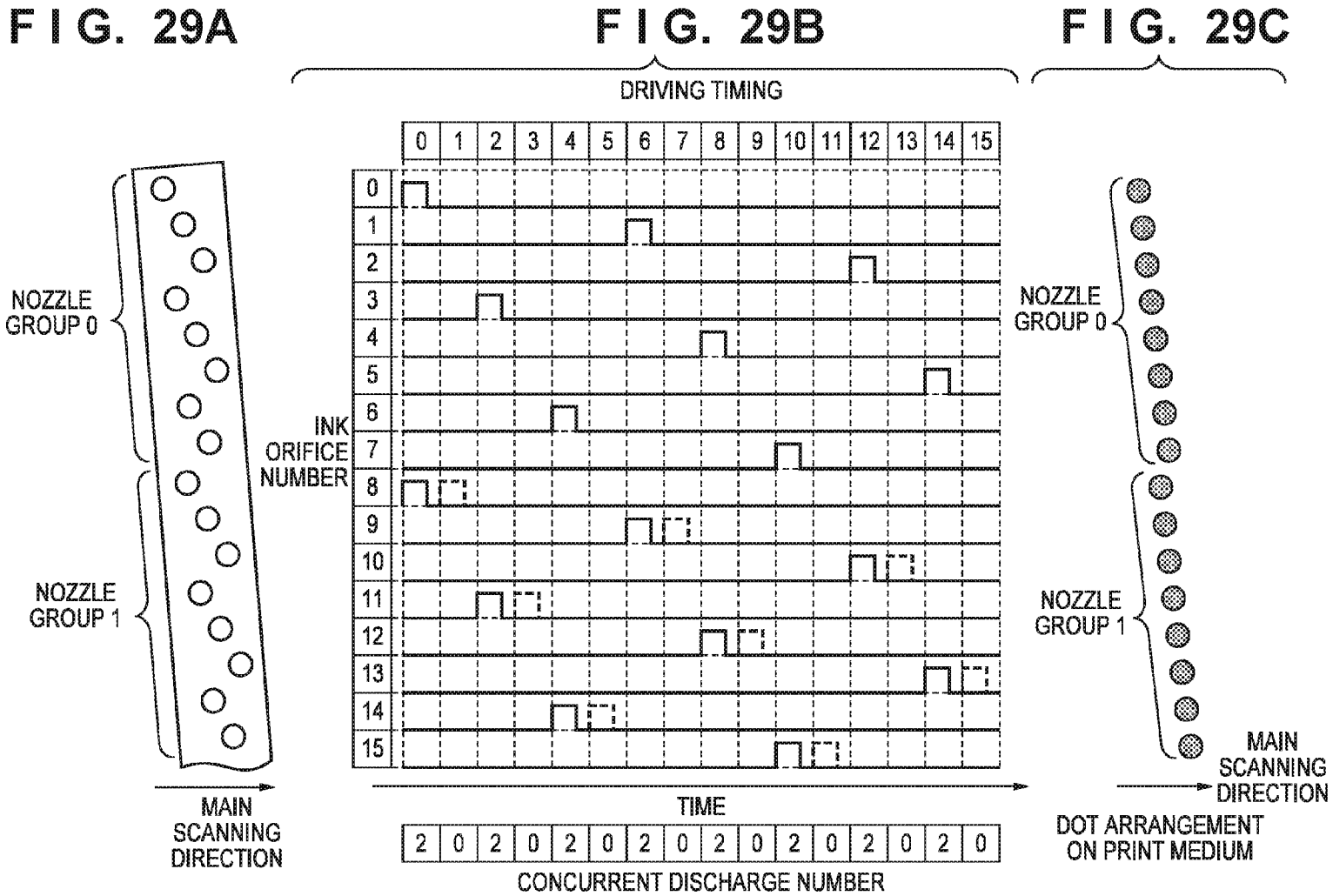
FIGS. 29A, 29B, and 29C are views showing, as a reference example, an example in which the driving timings of the print elements of the nozzle group are shifted by departing from the arrangement in which "the driving timing for each nozzle (ink orifice) is shifted during a driving period assigned to each nozzle group".

FIGS. 29A to 29C are views showing, as a reference example, an example in which the driving timings of the print elements of the nozzle group are shifted by departing from the arrangement in which "the driving timing for each nozzle (ink orifice) is shifted during a driving period assigned to each nozzle group".

In the example shown in FIGS. 29A to 29C, although the print elements of each nozzle group have alternate driving timings, a timing shift of one driving timing is performed. Referring to FIG. 29B, solid lines indicate a state after the printhead slant is corrected, and dotted line indicate a state before correction is performed. The count (concurrent discharge number) for each driving timing of nozzle groups 0 and 1 is shown in the lower portion of FIG. 29B, and it is apparent that the maximum concurrent drive number has changed.

FIG. 30 is a table showing the driving timing for each nozzle (ink orifice) and a dot arrangement in a case where correction of a head slant of −2 is performed in the printhead 11 including the 128 ink orifices. FIG. 31 is a table showing a print element timing shift amount and a print data readout position setting for each nozzle group with respect to the measurement value of the printhead slant (the shift by the head slant) according to the first embodiment.

As shown in FIG. 31, in this embodiment, every time the measurement value of the shift by the printhead slant shifts by two, the shift amount of the driving timings of the print elements of each nozzle group is changed. Note that the meanings of reference symbols in FIGS. 30 and 31 are the same as those in FIGS. 23 and 24 and a description thereof will be omitted.

According to the above-described embodiment, therefore, dots printed by discharging ink droplets onto the print medium can be aligned in line by matching the driving timings of the print elements with the positions of the ink orifices. This can correct deterioration of the print image quality by a shift in dot arrangement caused by the printhead slant, and implement driving which does not exceed the maximum concurrent drive number of each block in time-divisional driving.

Furthermore, the driving timings of the print elements assigned to each nozzle group are not always necessary to have equal time intervals. However, approximately equal time intervals are desirable to align, with higher accuracy, the landing positions of ink droplets obtained by correcting the printhead slant and to obtain a high quality print image.

Second Embodiment

An example in which in a case where eight nozzle groups are formed with respect to 128 ink orifices so that each nozzle group includes 16 adjacent ink orifices and the 128 print elements are divided into 16 blocks and time-divisionally driven, the driving timings of the print elements of each nozzle group are set will be described here.

In this case, all the driving timings are assigned to each nozzle group once. Nozzle group 0 has the same settings as those for set 0, and nozzle group 1 has the same settings as those for set 1. In this arrangement, since the driving timing of the print element of each ink orifice is shifted within a driving period assigned to each nozzle group, a timing shift by one driving timing can be performed for each nozzle group. This makes it possible to correct a printhead slant more finely than in the first embodiment.

Figures 32A, 32B, 32C:
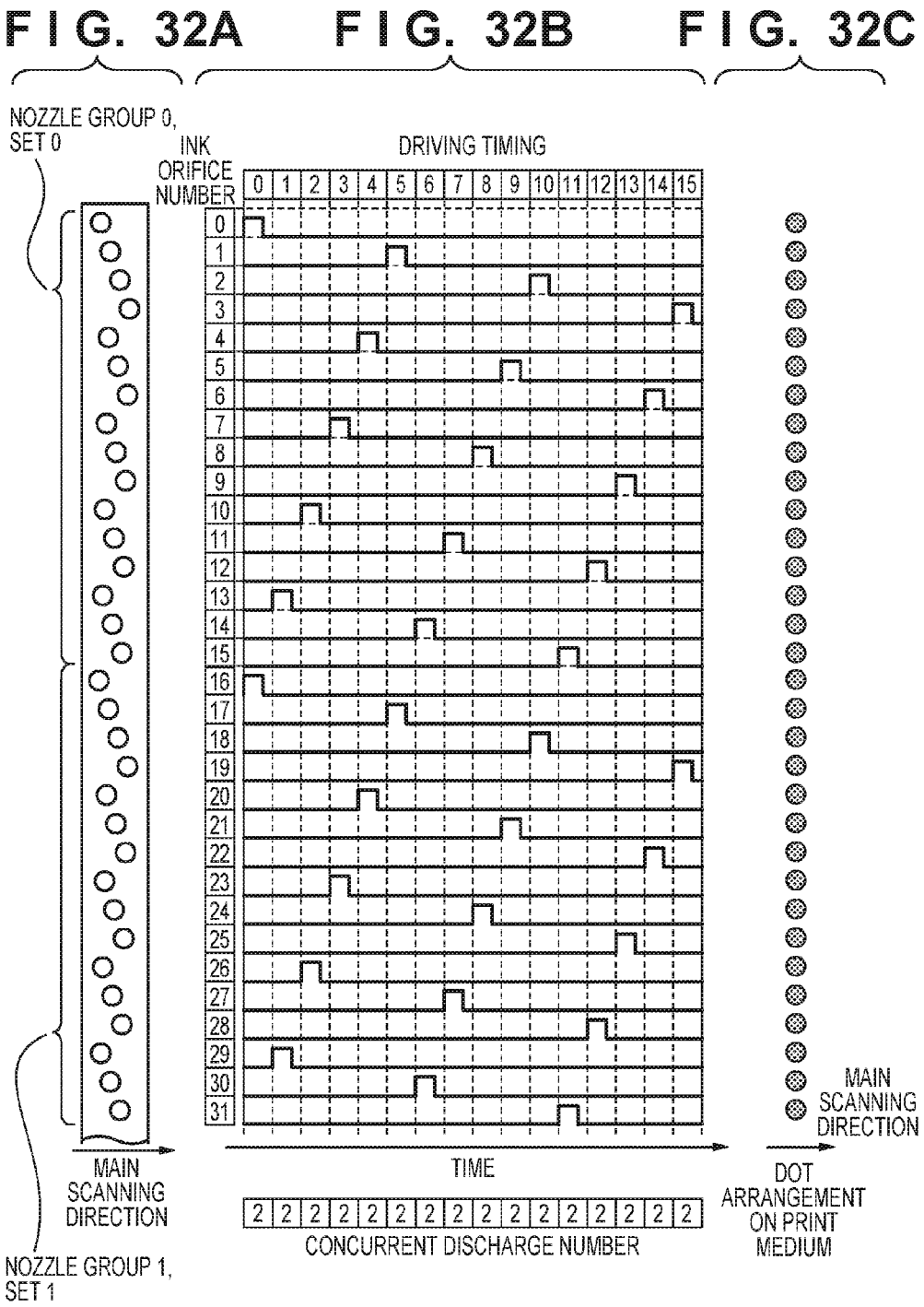
FIGS. 32A, 32B, and 32C are schematic views for explaining a printhead driving method according to the second embodiment.

FIGS. 32A to 32C are schematic views for explaining a printhead driving method according to the second embodiment. Note that in FIGS. 32A to 32C, a description of the same arrangement as that already described with reference to FIGS. 4A to 4C or 25A to 25C will be omitted, and only an arrangement unique to this embodiment will be explained.

As shown in FIG. 32A, each nozzle group is assigned with 16 ink orifices (print elements), that is, print elements of one period of time-divisional driving. As the correspondence between each driving timing of time-divisional driving and the arrangement of ink orifices, the correspondence described with reference to FIGS. 4A to 4C is used.

Figures 33A, 33B, 33C:
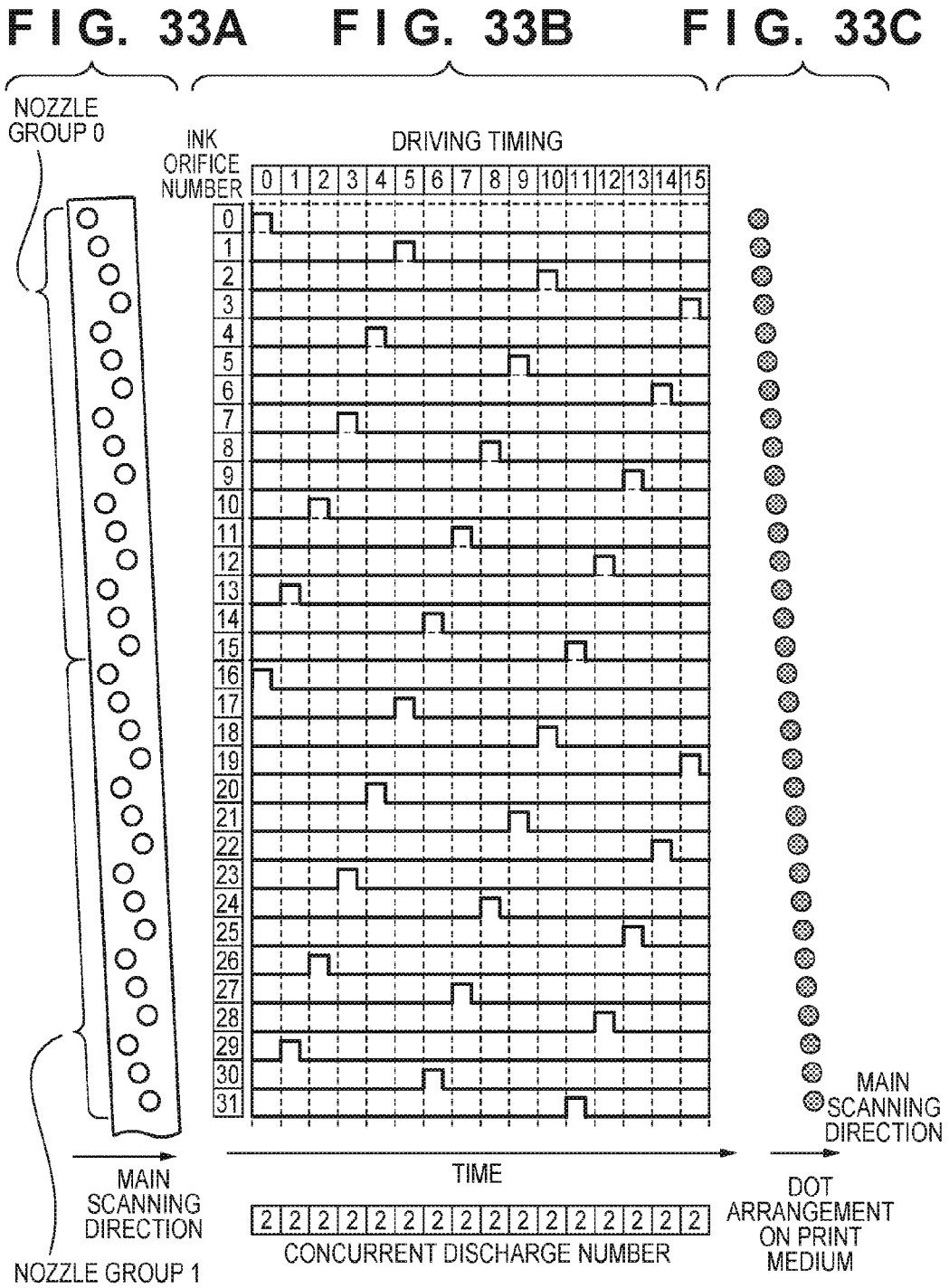
FIGS. 33A, 33B, and 33C are schematic views for explaining a state before correction of a printhead slant.
Figures 34A, 34B, 34C:
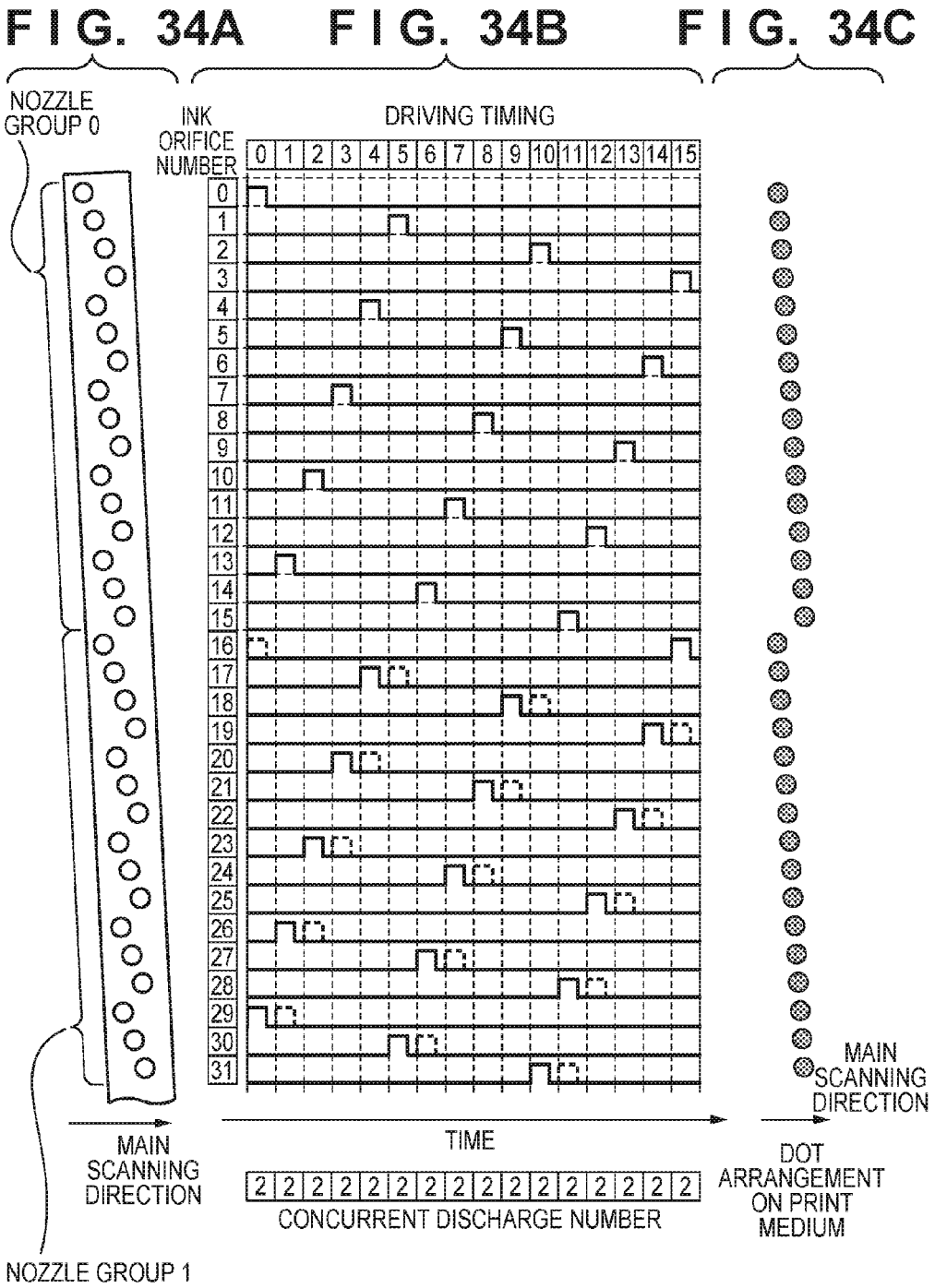
FIGS. 34A, 34B, and 34C are schematic views for explaining a case in which correction of a shift of −1 by a slant is performed.

FIGS. 33A to 33C are schematic views for explaining a state before correction of the printhead slant, and FIGS. 34A to 34C are schematic views for explaining a case in which correction of a shift of −1 by a slant is performed. Note that in each of the lower portions of FIGS. 32B and 33B, a numerical value (concurrent discharge number) obtained by counting, for each driving timing, the maximum concurrent drive number of nozzle groups 0 and 1 before correction is shown.

FIGS. 34A to 34C are schematic views for explaining a state in which the printhead slant is corrected by advancing the driving timings of the print elements of nozzle group 1 by one.

Referring to FIG. 34B, solid lines indicate a state after correction of the printhead slant, and dotted lines indicate a state before correction. Since one driving opportunity is assigned to each of all the driving timings of the print elements of each nozzle group, even if the driving timings assigned to the print elements of the nozzle group are shifted by one driving timing, the maximum concurrent drive number remains unchanged. The maximum concurrent drive numbers of nozzle groups 0 and 1 at the time of correction are shown in the lower portion of FIG. 34B. By comparing the maximum concurrent drive numbers with those shown in FIG. 33B, it is recognized that the maximum concurrent drive number of the whole printhead remains unchanged.

Figure 35:
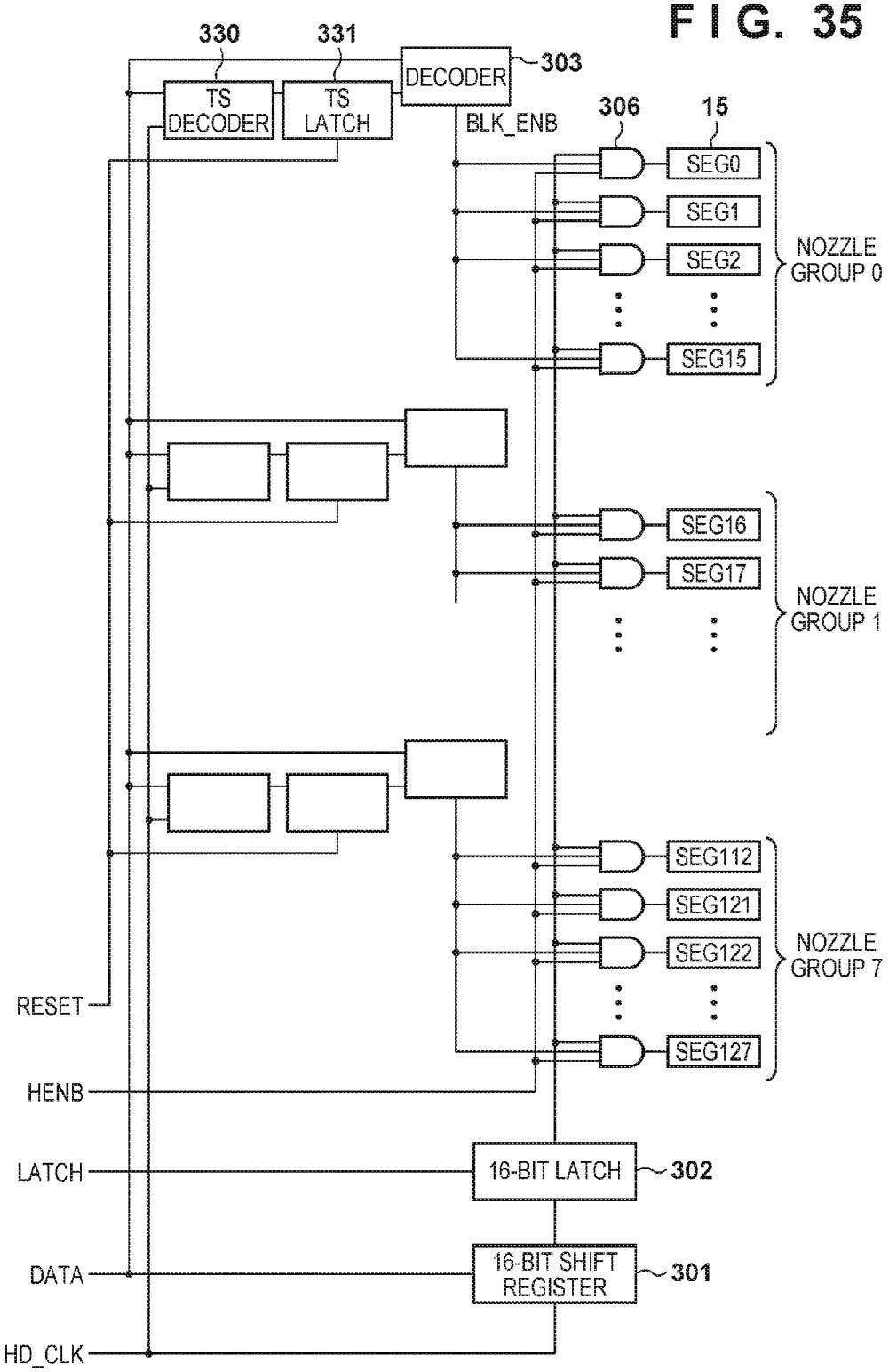
FIG. 35 is a circuit diagram showing the arrangement of a drive circuit provided in a printhead 11 according to the second embodiment.

FIG. 35 is a circuit diagram showing the arrangement of a drive circuit provided in the printhead 11 according to the second embodiment. Note that in FIG. 35, the same reference numerals and symbols as those already described with reference to FIG. 18 denote the same components and a description thereof will be omitted. In the arrangement shown in FIG. 35, a nozzle group is formed for every 16 adjacent print elements, and thus 8 nozzle groups (nozzle groups 0 to 7) are included.

Figure 36A:
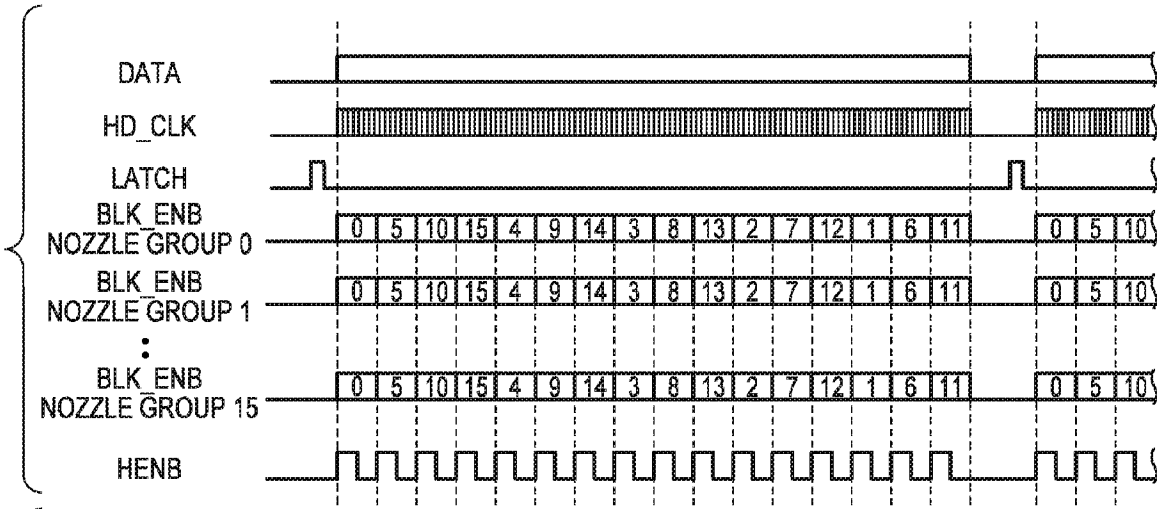
FIGS. 36A and 36B are timing charts respectively showing the driving timings before and after correction of a printhead slant using the drive circuit of the printhead 11 shown in FIG. 35.
Figure 36B:
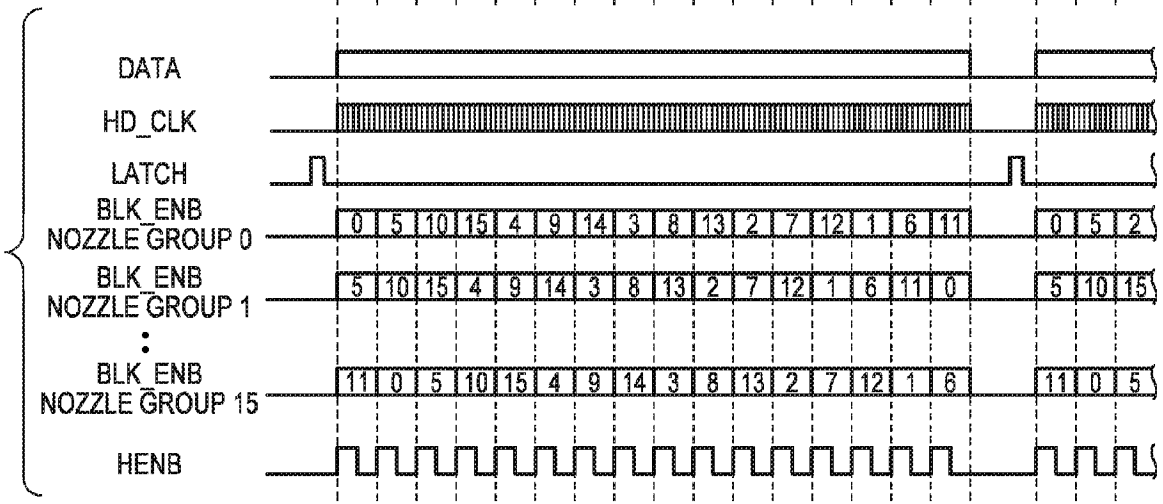

FIGS. 36A and 36B are timing charts respectively showing the driving timings before and after correction of the printhead slant using the drive circuit of the printhead 11 shown in FIG. 35. In this embodiment, it is apparent from FIGS. 36A and 36B that one set of driving timings is assigned to each nozzle group. FIG. 36A shows the driving timings before correction of the printhead slant, and FIG. 36B shows the driving timings after correction of the printhead slant. The driving timings of nozzle group 1 are advanced by one driving timing with respect to the driving timings of nozzle group 0.

FIG. 37 is a schematic table showing an example of the driving timing for each ink orifice and a dot arrangement in a case where correction is performed for the printhead with a shift of −1 by a slant according to the second embodiment.

FIG. 38 is a table showing the relationship between a driving timing shift amount and a print data shift amount for each nozzle group. Note that the meanings of reference symbols in FIGS. 37 and 38 are the same as those in FIGS. 23 and 24 and a description thereof will be omitted.

According to the above-described embodiment, therefore, dots printed by discharging ink droplets onto the print medium can be aligned in line by arranging the driving timings of the print elements to match with the positions of the ink orifices, similarly to the first embodiment. This can correct deterioration of the print image quality by a shift in dot arrangement caused by the printhead slant, and implement driving which does not exceed the maximum concurrent drive number of each block in time-divisional driving.

Furthermore, in this arrangement, since the driving timings can be corrected by one driving timing for every 16 ink orifices, finer correction of the head slant can be performed. With respect to the correspondence between the ink orifices and the driving timings, if the driving timings are respectively assigned to the 16 print elements once, the intervals between the driving timings of the print elements belonging to the nozzle group are approximately equal to each other. Thus, it is possible to correct the printhead slant without changing the maximum concurrent drive number.

In the first embodiment, the dot arrangement is adjusted for every 8 ink orifices. To the contrary, in the second embodiment, the dot arrangement is adjusted for every 16 ink orifices. Therefore, if the printhead slant is very large, a shift in dot arrangement at the boundary between nozzle groups can be made smaller. In this point, the second embodiment is superior to the first embodiment.

Third Embodiment

Figures 39A, 39B, 39C:
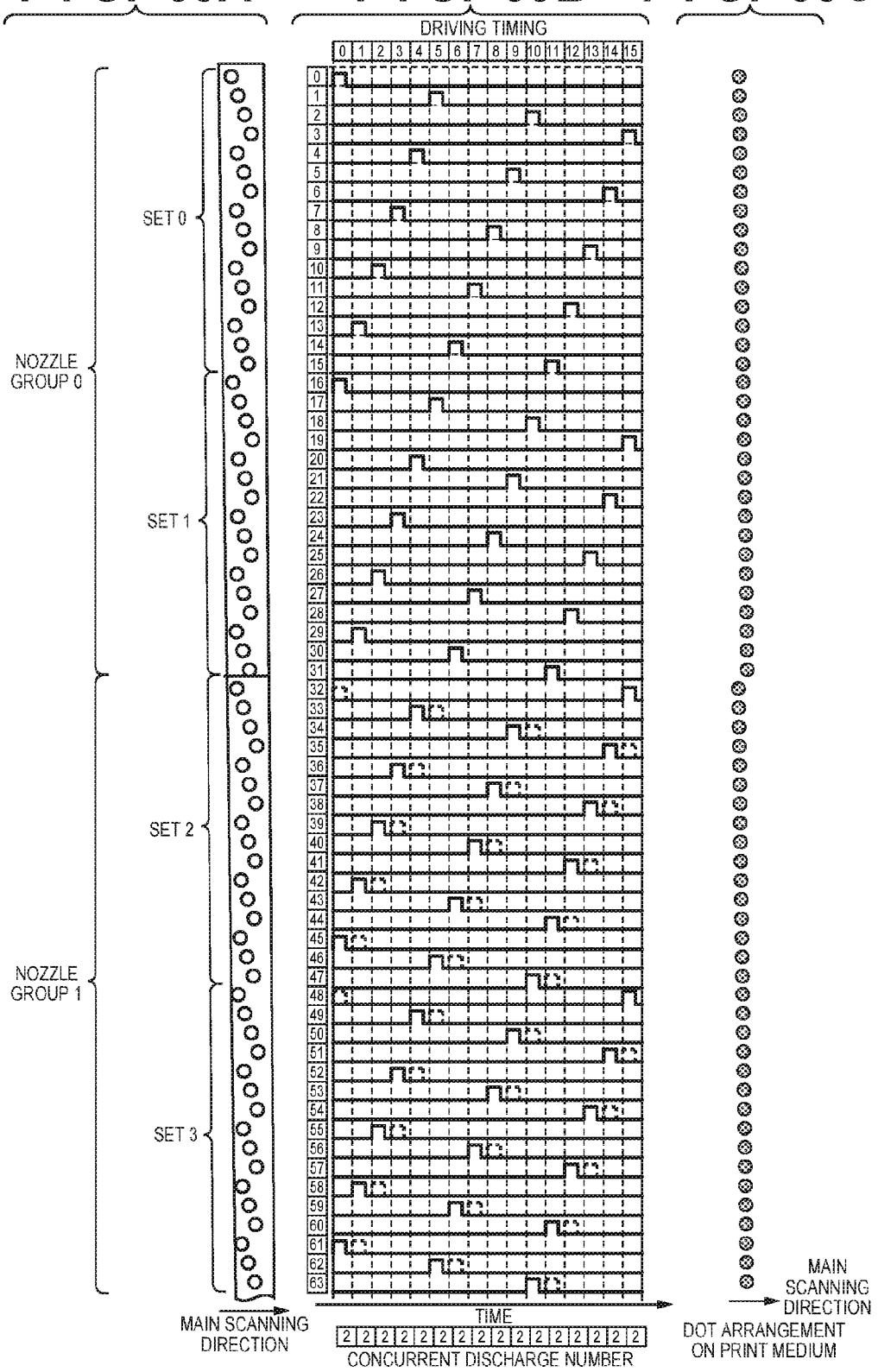
FIGS. 39A, 39B, and 39C are schematic views for explaining a printhead driving method according to the third embodiment.

FIGS. 39A to 39C are schematic views for explaining a printhead driving method according to the third embodiment. Note that in FIGS. 39A to 39C, a description of the same arrangement as that already described with reference to FIGS. 4A to 4C, 25A to 25C, or 32A to 32C will be omitted, and only an arrangement unique to this embodiment will be explained.

In this embodiment, a printhead slant is corrected by forming one nozzle group by 32 ink orifices. In this example, the ink orifices of the two periods of time-divisional driving, that is, the ink orifices of two sets form one nozzle group. In this case, the driving timings are assigned twice to the print elements of each nozzle group. Therefore, in this embodiment as well, even if a timing shift by one driving timing is performed for each nozzle group, the maximum concurrent drive numbers remain unchanged, similarly to the second embodiment.

Consequently, as for a printhead having a long print width and a large number of ink orifices, if a plurality of sets are assigned to one nozzle group, as in this embodiment, it is possible to suppress the number of nozzle groups, and simplify the drive circuit of the printhead. This can reduce the cost of the drive circuit of the printhead.

Fourth Embodiment

An arrangement example in a case where the intervals between the driving timings assigned to the print elements of each nozzle group are not equal to each other will be described. Note that to avoid a repetitive description, the arrangement of the nozzle groups of a printhead 11 and the correspondence between the print element of each ink orifice and a driving timing are the same as those described with reference to FIGS. 4A to 4C. As is apparent from FIGS. 4A to 4C, eight adjacent ink orifices form one nozzle group.

Figure 40A:
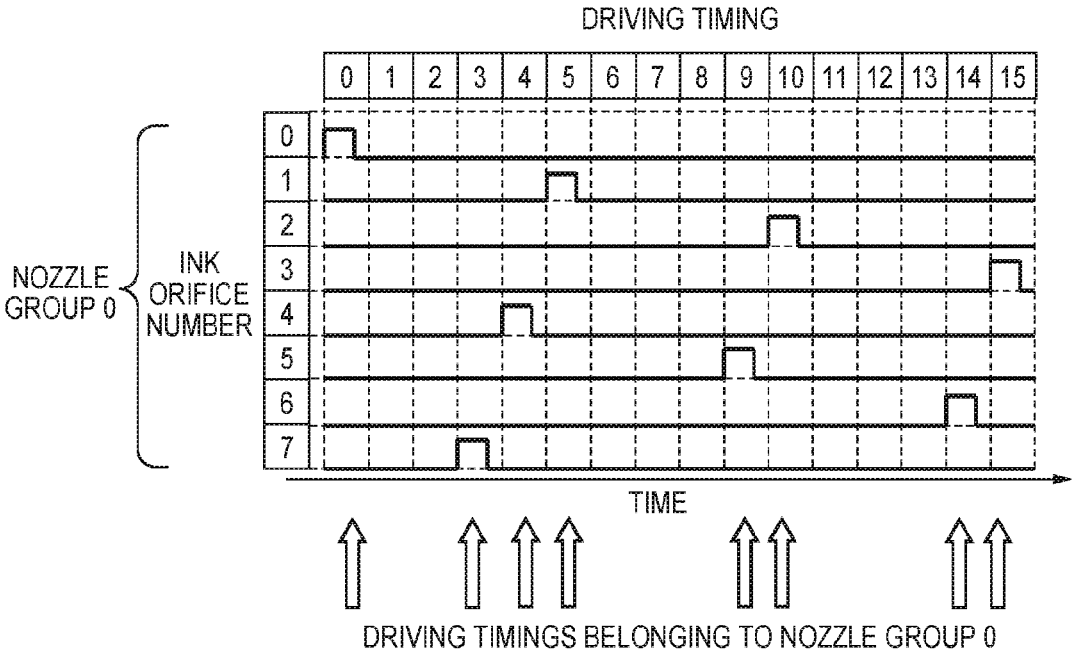
FIGS. 40A and 40B are schematic views each for explaining the driving timings of print elements assigned or belonging to a nozzle group according to the fourth embodiment.
Figure 40B:
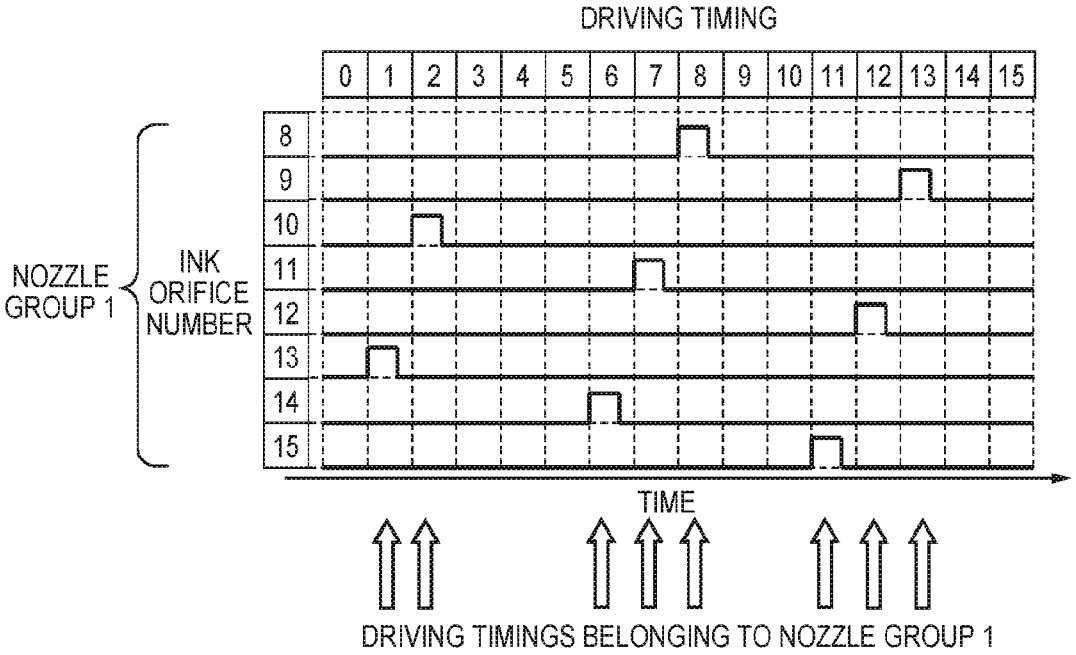

FIGS. 40A and 40B are schematic views each for explaining the driving timings of print elements assigned or belonging to a nozzle group according to this embodiment. FIG. 40A shows, by up arrows, the driving timings of print elements assigned to nozzle group 0, and FIG. 40B shows, by up arrows, the driving timings of print elements assigned to nozzle group 1.

As shown in FIGS. 40A and 40B, in this embodiment, the driving timings of the respective print elements in time-divisional driving do not have approximately equal time intervals.

FIGS. 41A to 42C are schematic views for explaining a driving timing shift according to this embodiment. Note that in FIGS. 41A to 42C, a description of the same arrangement already described with reference to FIGS. 4A to 4C will be omitted, and only an arrangement unique to this embodiment will be explained.

Figures 41A, 41B, 41C:
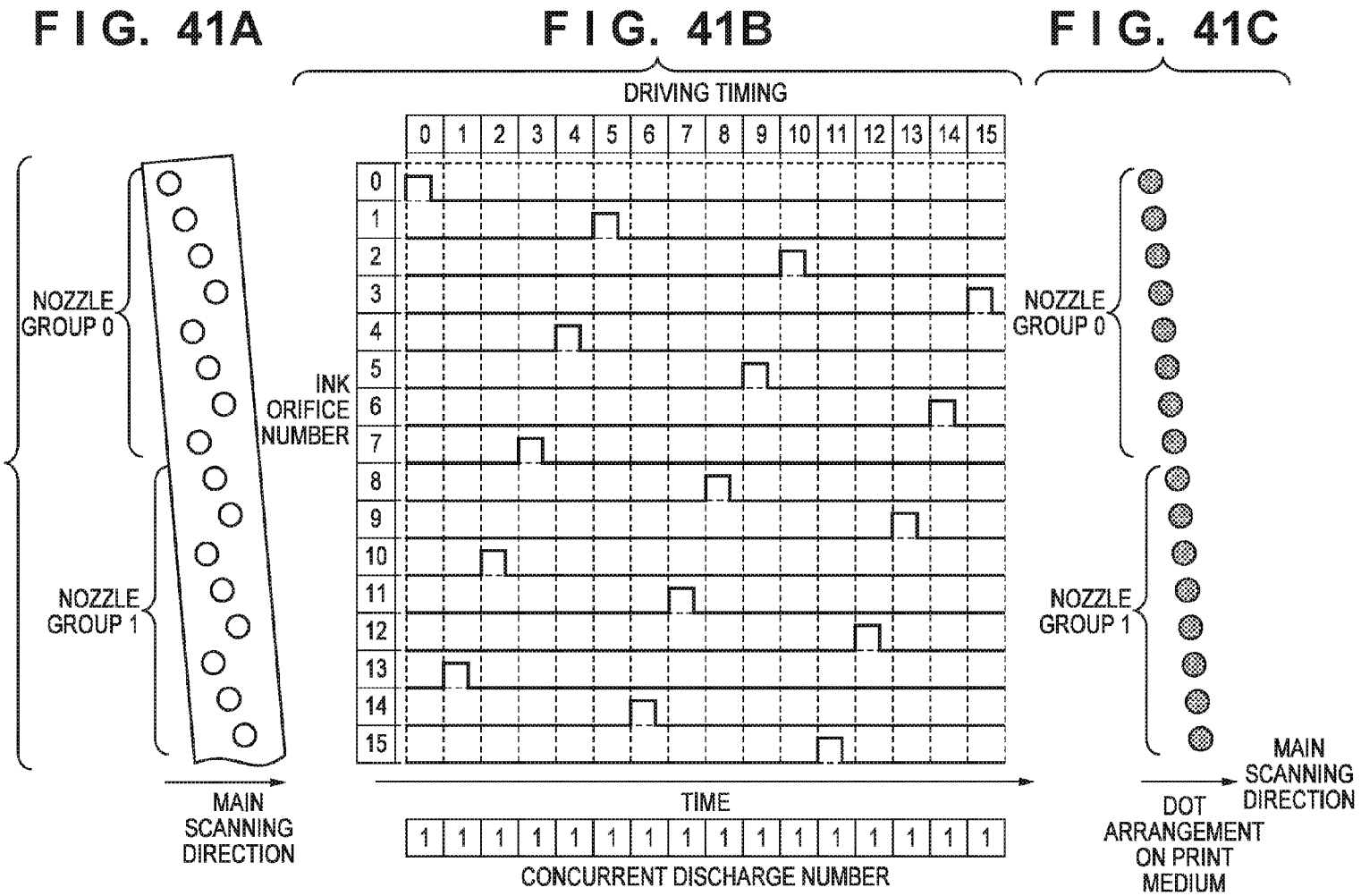
FIGS. 41A, 41B, and 41C are schematic views for explaining a driving timing shift according to the fourth embodiment.
Figures 42A, 42B, 42C:
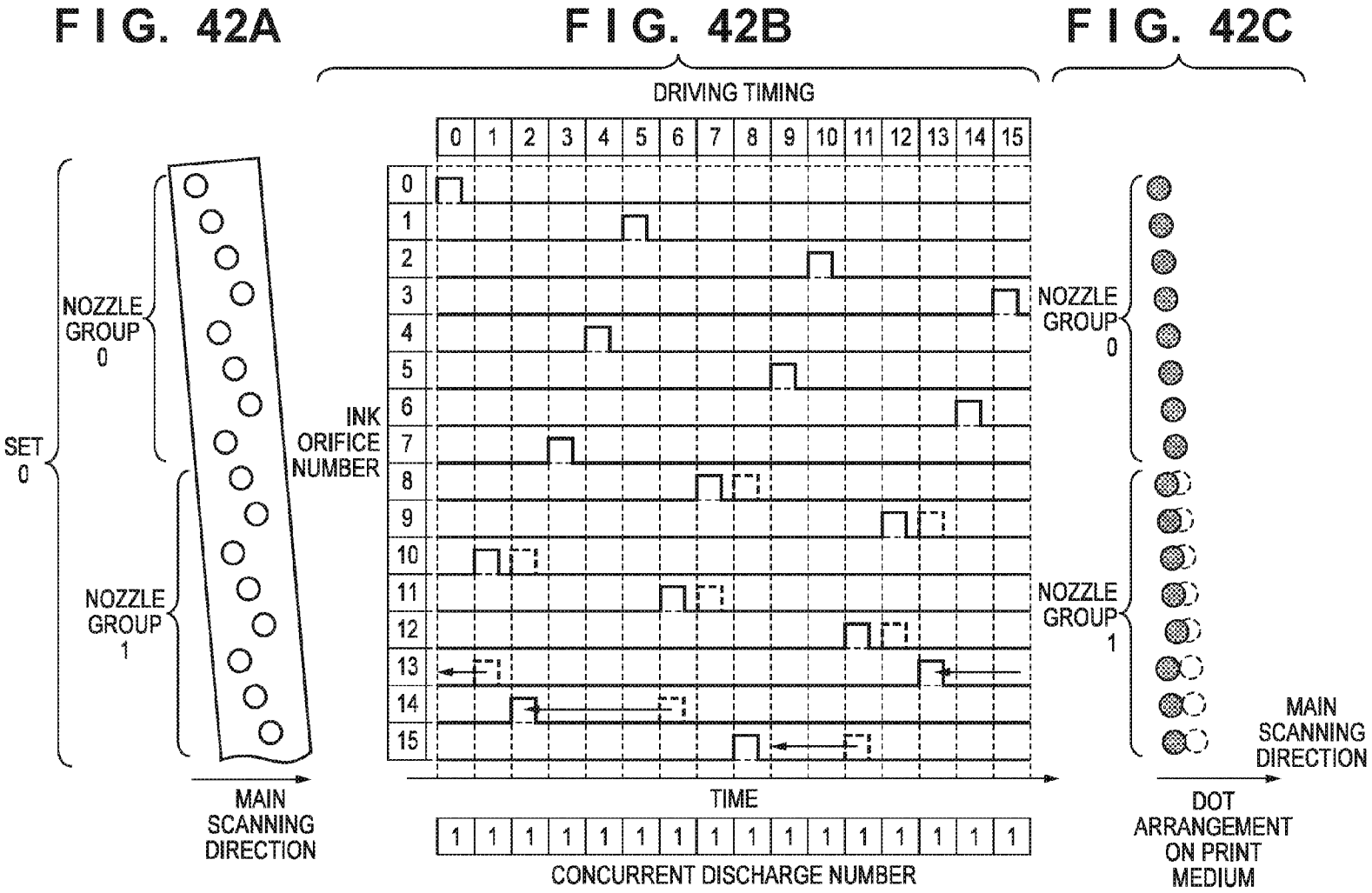
FIGS. 42A, 42B, and 42C are schematic views for explaining a driving timing shift according to the fourth embodiment.

FIGS. 41A to 41C show a state before a printhead slant is corrected according to this embodiment. To the contrary, FIGS. 42A to 42C show a state after the driving timings assigned to the print elements of nozzle group 1 are shifted. Referring to FIG. 42B, solid lines indicate a state after correction of the printhead slant, and dotted line indicate a state before correction of the printhead slant.

As will be apparent by comparing FIGS. 41B and 42B, the maximum concurrent drive number for each driving timing is the same as that before correction of the printhead slant. As described above, it is possible to correct the printhead slant without changing the maximum concurrent drive number by shifting the driving timing assigned to each print element of each nozzle group within a driving period.

Furthermore, as will be apparent by comparing FIGS. 42B and 28B, while the driving timing shift amount is constant for the print elements of each nozzle group in the first embodiment, the shift amount may change for each print element of each nozzle group in the fourth embodiment. That is, as is apparent from FIG. 42B, the driving timings of print elements corresponding to ink discharge numbers 8 to 12 of nozzle group 1 are shifted forward by "one". The driving timings for ink orifice numbers 13 and 14 are shifted forward by "four", and the driving timing for ink orifice number 15 is shifted forward by "three". This makes the intervals between the driving timings unequal.

FIGS. 43A to 43D are schematic views for explaining a case in which a landing shift occurs in a case where ink droplets are intended to linearly land on a print medium.

Figures 43A, 43B, 43C, 43D:
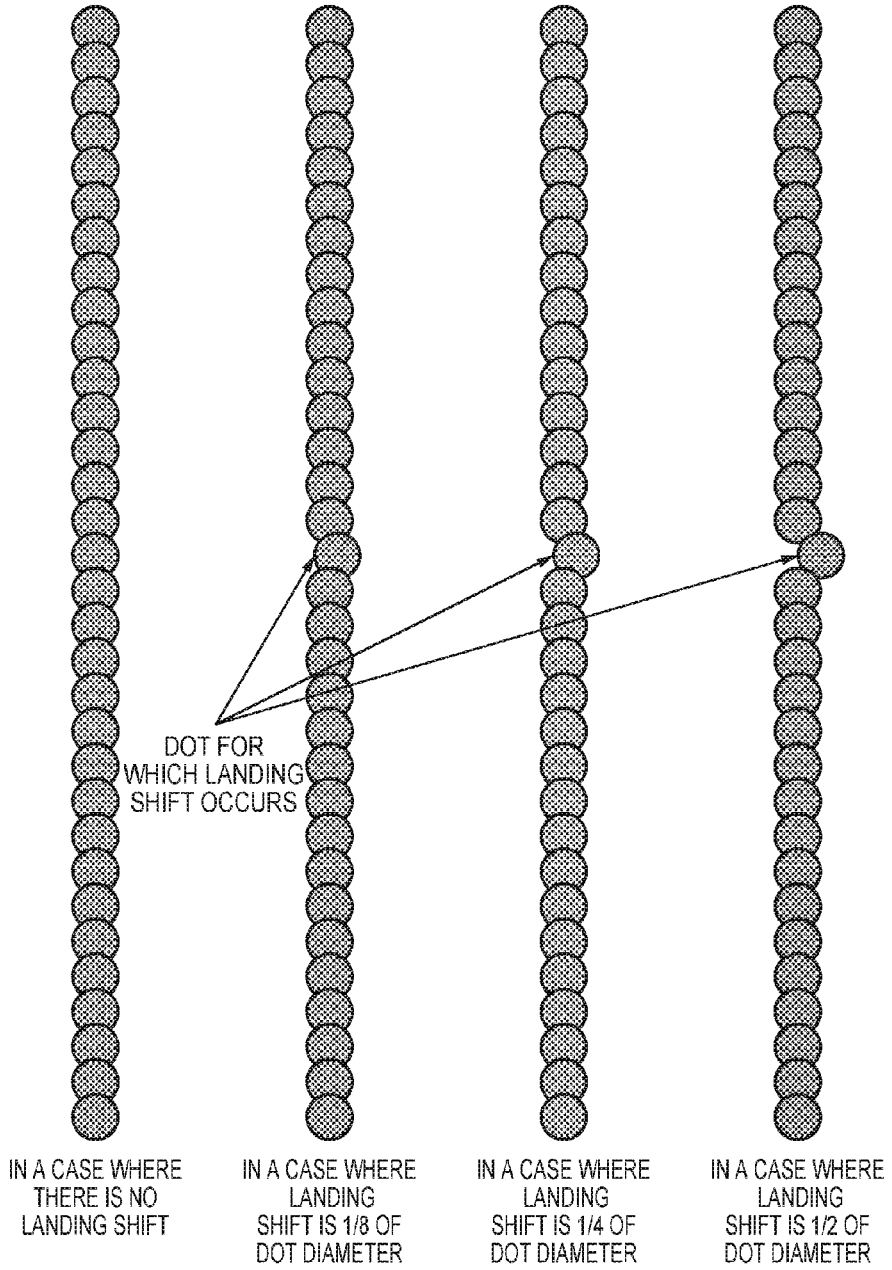
FIGS. 43A, 43B, 43C, and 43D are schematic views for explaining a case in which a landing shift occurs when ink droplets are intended to linearly land on a print medium.
Figures 44A, 44B, 44C:
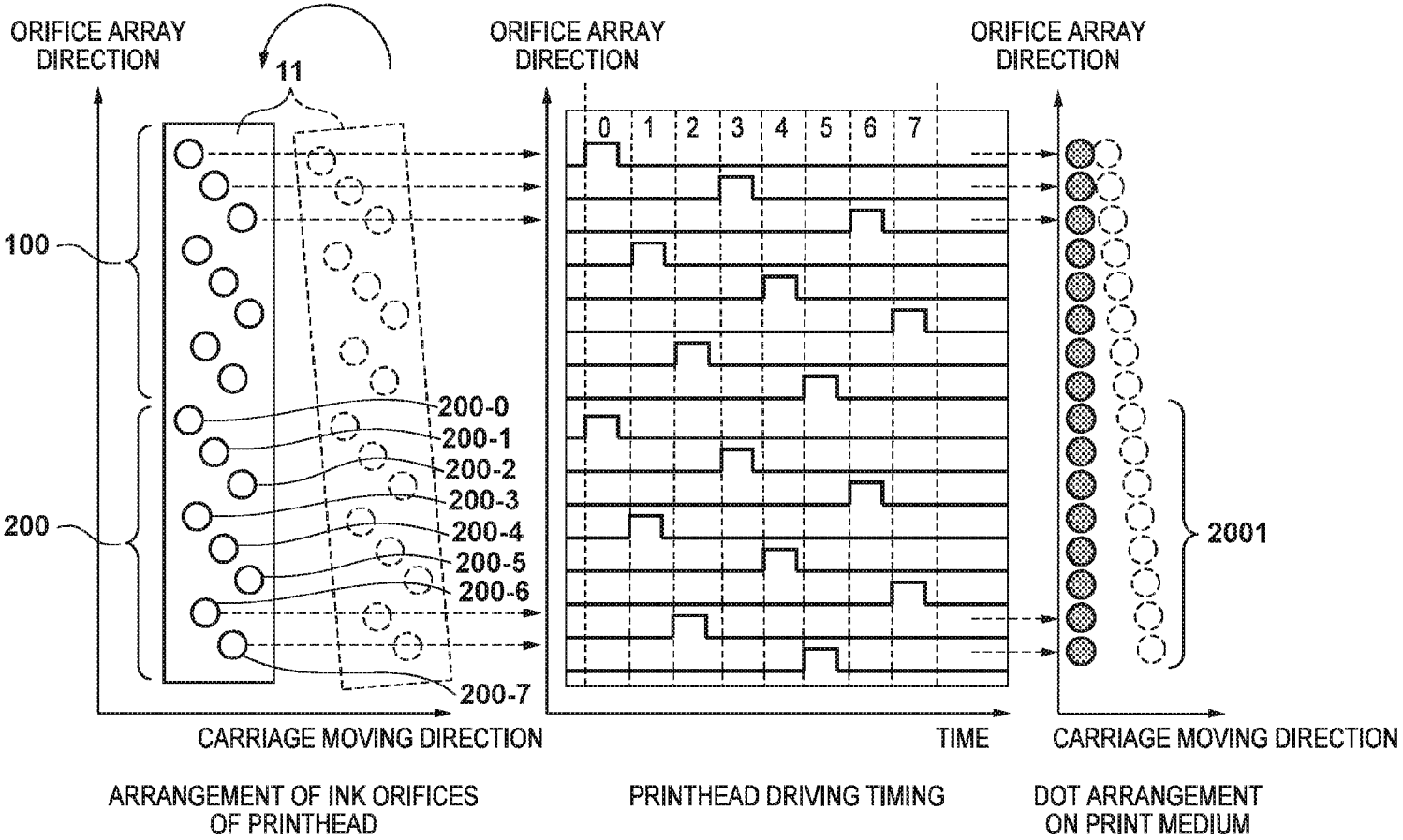
FIG. 44A PRIOR ART
FIG. 44B PRIOR ART
FIG. 44C PRIOR ART
FIGS. 44A, 44B, and 44C are views showing the relationship between the driving timings of a printhead including 16 ink orifices and a dot arrangement on a print medium.

FIG. 43A shows a dot arrangement in a case where there is no landing shift. FIG. 43B shows a dot arrangement in a case where a landing shift is ⅛ of a dot diameter. FIG. 43C shows a dot arrangement in a case where a landing shift is ¼ of the dot diameter. FIG. 43D shows a dot arrangement in a case where a landing shift is ½ of the dot diameter.

As will be apparent by comparing FIGS. 43A to 43D, if a landing shift is smaller than ⅛ of the dot diameter, it is difficult for a human eye to recognize the landing shift, and thus it is considered that there is practically no problem.

Assume that in the printhead 11 including 128 ink orifices, the dot diameter is 30 μm, the print resolution is 1,200 dpi, and the time-divisional drive block number is 16 (that is, one nozzle group is formed from eight ink orifices). In this case, a landing shift amount (ΔS) of ⅛ of the dot diameter is 30/8≈3.8, thereby obtaining:

$$\Delta S = 3.8\ \mu m$$

Furthermore, the minimum unit (SMIN) of the driving timing shift amount is 25.4/1,200×1,000/16≈1.3, thereby obtaining:

$$SMIN = 1.3\ \mu m$$

Therefore, it can be determined that the driving timing shift amount (PS) which practically poses no problem is about 3 or less driving timings according to 3.8/1.3≈3.

As described above, in this embodiment, as shown in FIG. 42B, the shift amounts of the driving timings of the print elements of each nozzle group fall within the range from 1 to 4. Furthermore, the interval between the driving timings of the print elements of the respective ink orifices changes within the range from 1 to 4.

That is, by setting, as a reference, an operation of shifting the driving timing of the print element by one before and after correction, there is a condition that the landing position shifts by up to "three" driving timings. In this case, the driving timing shift amount is 3 or less, and a driving timing shift according to this embodiment can be executed while maintaining the acceptable level in terms of the quality of a print image.

Therefore, according to the above-described embodiment, in a case where the intervals between the driving timings assigned to the print elements of each nozzle group are approximately equal to each other or variations of the driving timing intervals are equal to or smaller than ⅛ of the dot diameter in terms of a distance on the print medium, a driving timing shift is effective.

Note that an example in which the driving timings of time-divisional driving are set by equally dividing the print time of the print resolution (column) in the main scanning direction has been described above. The present invention, however, is not limited to this. For example, the timings of time-divisional driving may be packed forward within the range of the print time of one column and used so as to leave a margin to absorb a variation in the print time of one column caused by variations in the operation of hardware. In this case as well, the present invention can perform correction of the printhead slant while maintaining the acceptable level of the quality of a print image in a case where variations of the intervals between the driving timings of the print elements assigned to each nozzle group are equal to or smaller than ⅛ of the dot diameter in terms of a distance on the print medium.

In the above embodiments, a method of changing a driving timing of a print element in a printing apparatus in which a printhead moves with respect to a print medium has been described. However, the method is also applicable to a printing apparatus in which a print medium moves in a scanning direction as indicated by FIG. 4C with respect to a fixed printhead.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-045082, filed Mar. 6, 2015, which is hereby incorporated by reference herein in its entirety.

What is claimed is:

1. A printing apparatus which mounts a printhead including a plurality of print elements arrayed in a predetermined pitch in a predetermined direction, and prints an image on a print medium while relatively scanning the printhead, and discharging ink from the printhead to the print medium, the apparatus comprising:

a time-divisional drive unit configured to time-divisionally drive the plurality of print elements in predetermined order by dividing a time corresponding to a print resolution in a scanning direction of the printhead into a plurality of times such that one print element of the plurality of print elements which is driven at one driving timing and another print element of the plurality of print elements which is driven at a next driving timing are apart from each other for more than two print element pitch, and setting the divided times as driving timings; and a change unit configured to change, using the divided time as a unit, the driving timings for each of a plurality of groups, which is formed from a predetermined number of adjacent print elements of the plurality of print elements in the time-divisional driving.

2. The apparatus according to claim 1, wherein the change by the change unit is performed within a range of the time corresponding to the print resolution.

3. The apparatus according to claim 1, wherein the change by the change unit is performed such that numbers of print elements concurrently driven in the time-divisional driving at respective driving timings are equal to each other.

4. The apparatus according to claim 1, wherein after the change by the change unit, intervals between the driving timings of the print elements belonging to each group are equal to each other.

5. The apparatus according to claim 1, wherein a plurality of sets each including print elements corresponding to one period of the time-divisional driving are formed for a plurality of adjacent groups of the plurality of groups, and the change unit changes the driving timings so as to give, for each period of the time-divisional driving, one driving opportunity to each print element included in each of the plurality of sets.

6. The apparatus according to claim 1, wherein after the change by the change unit, intervals between the driving timings of the print elements belonging to each group are not equal to each other.

7. The apparatus according to claim 6, wherein variations of time intervals between the driving timings are not larger than ⅛ of a dot diameter printed by the printhead in terms of a distance on the print medium.

8. The apparatus according to claim 1, further comprising:

a test-pattern print unit configured to print a predetermined test pattern on the print medium by the printhead;

a read unit configured to read the test pattern printed by the test-pattern print unit; and a detection unit configured to detect, based on information read by the read unit, a shift by a slant upon mounting the printhead.

9. The apparatus according to claim 8, wherein the change by the change unit is performed to correct the shift by the slant detected by the detection unit.

10. The apparatus according to claim 9, further comprising a storage unit configured to store a correction amount for performing the correction in accordance with the detected shift by the slant.

11. The apparatus according to claim 1, wherein the plurality of print elements of the printhead are arranged in a staggered pattern in the predetermined direction by setting a predetermined number of print elements as a unit, thereby forming a print element array.

12. The apparatus according to claim 11, wherein the driving timings are determined in accordance with the staggered arrangement of the plurality of print elements.

13. A control method for a printing apparatus which mounts a printhead including a plurality of print elements arrayed in a predetermined pitch in a predetermined direction, and prints an image on a print medium while relatively scanning the printhead, and discharging ink from the printhead to the print medium, the method comprising:

dividing a time corresponding to a print resolution in a scanning direction of the printhead into a plurality of times such that one print element of the plurality of print elements which is driven at one driving timing of a time divisional drive and another print element of the plurality of print elements which is driven at a next driving timing of the time divisional drive are apart from each other for more than two print element pitch;

forming a plurality of groups each including a predetermined number of adjacent print elements of the plurality of print elements upon time-divisionally driving the plurality of print elements in predetermined order by setting the divided times as driving timings; and controlling to execute printing by changing, using the divided time as a unit, the driving timings for each of the plurality of groups.

14. The method according to claim 13, wherein the change is performed within a range of the time corresponding to the print resolution.

15. The method according to claim 13, wherein the change is performed such that numbers of print elements concurrently driven in the time-divisional driving at respective driving timings are equal to each other.

16. The method according to claim 13, wherein after the change, intervals between the driving timings of the print elements belonging to each group are equal to each other.

17. The method according to claim 13, wherein a plurality of sets each including print elements corresponding to one period of the time-divisional driving are formed for a plurality of adjacent groups of the plurality of groups, and the driving timings are changed so as to give, for each period of the time-divisional driving, one driving opportunity to each print element included in each of the plurality of sets.

18. The method according to claim 13, wherein after the change, intervals between the driving timings of the print elements belonging to each group are not equal to each other.

19. The method according to claim 13, further comprising:

printing a predetermined test pattern on the print medium by the printhead;

reading the printed test pattern; and detecting, based on the read information, a shift by a slant upon mounting the printhead.

20. The method according to claim 19, wherein the change is performed to correct the detected shift by the slant.

* * * * *